US009701127B2

(12) United States Patent
Kawate et al.

(10) Patent No.: US 9,701,127 B2
(45) Date of Patent: Jul. 11, 2017

(54) LIQUID CONTAINER

(71) Applicant: SEIKO EPSON CORPORATION, Tokyo (JP)

(72) Inventors: Hiroyuki Kawate, Hokuto (JP); Tokujiro Okuno, Kitakyushu (JP); Yoshiyuki Tanaka, Matsumoto (JP); Katsutomo Tsukahara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/895,154

(22) PCT Filed: Jun. 5, 2014

(86) PCT No.: PCT/JP2014/003004
§ 371 (c)(1),
(2) Date: Mar. 1, 2016

(87) PCT Pub. No.: WO2014/196205
PCT Pub. Date: Dec. 11, 2014

(65) Prior Publication Data

US 2016/0176195 A1 Jun. 23, 2016

(30) Foreign Application Priority Data

Jun. 6, 2013 (JP) ..... 2013-119571
Mar. 14, 2014 (JP) ..... 2014-051789
Mar. 14, 2014 (JP) ..... 2014-051791

(51) Int. Cl.
*B41J 2/175* (2006.01)
*B41J 29/13* (2006.01)

(52) U.S. Cl.
CPC ..... *B41J 2/17526* (2013.01); *B41J 2/1752* (2013.01); *B41J 2/17506* (2013.01);*B41J 2/17513* (2013.01); *B41J 2/17553* (2013.01); *B41J 2/17559* (2013.01); *B41J 29/13* (2013.01)

(58) Field of Classification Search
CPC ..... B41J 2/17526; B41J 2/17506; B41J 2/17513
See application file for complete search history.

(56) References Cited

U.S. PATENT DOCUMENTS 5,860,363 A 1/1999 Childers et al.
6,203,147 B1 3/2001 Battey et al.
(Continued)

FOREIGN PATENT DOCUMENTS

CN 101585265 A 11/2009
JP 59-212272 A 12/1984
(Continued)

*Primary Examiner* — Jason Uhlenhake
(74) *Attorney, Agent, or Firm* — Stroock & Stroock & Lavan LLP

(57) ABSTRACT

A liquid container that is detachably mountable on a liquid consuming device comprises a liquid container body that is at least partly formed from a material having flexibility and is configured to contain a liquid; an operation member that is located at one end of the liquid container body and is configured to include a holdable grip surface; and a liquid supply portion that is configured to have a liquid supply port at one end. The operation member is configured such that the grip surface is offset relative to the liquid supply port in an axial direction of the liquid supply portion.

17 Claims, 46 Drawing Sheets

(56) References Cited

U.S. PATENT DOCUMENTS

| | | | | |
|---|---|---|---|---|
| 6,416,166 | B1 * | 7/2002 | Robinson | B41J 2/1752 347/19 |
| 7,891,789 | B2 | 2/2011 | Hibbard et al. | |
| 2002/0171713 | A1 * | 11/2002 | Ueno | B41J 2/17509 347/49 |
| 2005/0243148 | A1 | 11/2005 | Miyazawa et al. | |
| 2008/0284810 | A1 | 11/2008 | Shimizu et al. | |
| 2009/0290001 | A1 | 11/2009 | Domae | |
| 2014/0063145 | A1 | 3/2014 | Iwamuro et al. | |

FOREIGN PATENT DOCUMENTS

| | | | |
|---|---|---|---|
| JP | 2001232812 | A | 8/2001 |
| JP | 2002120382 | A | 4/2002 |
| JP | 2004-168341 | A | 6/2004 |
| JP | 2005212262 | A | 8/2005 |
| JP | 2006069030 | A | 3/2006 |
| JP | 2007090646 | A | 4/2007 |
| JP | 2009172918 | A | 8/2009 |
| JP | 2009202346 | A | 9/2009 |
| JP | 2010208095 | A | 9/2010 |
| JP | 2010264728 | A | 11/2010 |
| JP | 2011235652 | A | 11/2011 |
| JP | 2012-116202 | A | 6/2012 |
| JP | 2012116102 | A | 6/2012 |
| JP | 2012139852 | A | 7/2012 |
| JP | 2012158343 | A | 8/2012 |
| NO | 2014/034111 | A1 | 3/2014 |
| WO | 2004/037541 | A1 | 5/2004 |

* cited by examiner

F13-F13 SECTIONAL VIEW

VIEWED FROM ARROW F16B

F17Da-F17Da PARTIALLY SECTIONAL VIEW

F17Db-F17Db PARTIALLY SECTIONAL VIEW

F18-F18 PARTIAL SECTIONAL VIEW

F20-F20 PARTIAL SECTIONAL VIEW

F22-F22 SECTIONAL VIEW

F23-F23 SECTIONAL VIEW

F26-F26 SECTIONAL VIEW

F28A-F28A SECTIONAL VIEW

LIQUID CONTAINER

CROSS-REFERENCE TO RELATED APPLICATIONS

This application is the national phase application under 35 U.S.C. §371 based on and claiming the benefit of International Patent Application No. PCT/JP2014/003004 filed on Jun. 5, 2014, which claims the benefit of priority from Japanese Patent Application No. 2013-119571, filed on Jun. 6, 2013, Japanese Patent Application No 2014-051789, filed on Mar. 14, 2014, and Japanese Patent Application No 2014-051791, filed on Mar. 14, 2014, the entire contents of each of which is incorporated herein by reference for all purposes.

TECHNICAL FIELD

The present invention relates to a technology relating to a liquid container used for a liquid consuming device.

BACKGROUND ART

According to a generally known technique, a liquid container body is contained in a pullout-type cartridge case and is mounted on a liquid consuming device to supply ink contained in the liquid container body to the liquid consuming device (for example, Patent Literature 1). Patent Literature 1 discloses a liquid container that includes a liquid containing bag configured to contain a liquid and a casing configured to contain the liquid containing bag (cartridge case) (for example, Patent Literature 1), as the technique for supplying the liquid to a printer as the liquid consuming device. In the technique of Patent Literature 1, the cartridge case is configured to be pulled out relative to the printer. After the liquid containing bag is mounted on the cartridge case, the liquid container is inserted into the printer. This connects the liquid container with the printer and causes ink contained in the liquid containing bag to flow toward the printer via a liquid supply port provided in the liquid containing bag.

CITATION LIST

Patent Literature

PTL 1: WO 2004/037541

SUMMARY

Technical Problem

The above prior art needs to make the liquid container body contained in the cartridge case when the liquid container body is mounted on the liquid consuming device. The user is required to hold the liquid container body having flexibility. This leads to inconvenience in handling and makes it difficult to mount the liquid container body to the liquid consuming device. When the user holds the liquid container body, an external force is directly applied to the liquid container body and is likely to damage the liquid container body. Damaging the liquid container body may cause a problem that the contained liquid leaks outside.

In the technique of Patent Literature 1, in the process of connecting the liquid container body with the printer, the liquid containing bag and the liquid supply port are arranged to be arrayed in a horizontal direction. This may result in expanding the size of a container assembly on the printer side to contain the liquid container body. This configuration also needs a cartridge case to support the liquid containing bag in the horizontal direction. This may result in increasing the manufacturing cost of the liquid container. This configuration also needs to connect the liquid container with the printer after the liquid containing bag is mounted on the cartridge case. This may complicate the procedure (mounting process) to connect the liquid container with the printer.

A first object of the invention is to provide a liquid container having the improved handling property in the process of mounting the liquid container on a liquid consuming device. A second object of the invention is to provide a liquid container having the reduced likelihood that the user directly touches a liquid container body. A third object of the invention is to provide a liquid container that is readily mountable on the liquid consuming device. A fourth object of the invention is to reduce the space occupied by a liquid container. A fifth object is to provide a liquid container that is readily connectable with the liquid consuming device. Other needs with regard to the prior art include cost reduction, resource saving, easy manufacture and improved usability.

Solution to Problem

In order to solve at least part of the problems described above, the invention may be implemented by aspects described below.

(1) According to one aspect of the invention, there is provided a liquid container that is detachably mountable on a liquid consuming device. The liquid container comprises a liquid container body that is at least partly formed from a material having flexibility and is configured to contain a liquid; an operation member that is located at one end of the liquid container body and is configured to include a holdable grip surface; and a liquid supply portion that is configured to have a liquid supply port at one end. The operation member is configured such that the grip surface is offset relative to the liquid supply port in an axial direction of the liquid supply portion. In the liquid container of this aspect, the grip surface is offset relative to the liquid supply port in the axial direction. This configuration causes the liquid supply port to be not hidden by the operation member but to be visually recognizable when the user holds the grip surface of the operation member to mount the liquid container on the liquid consuming device. This configuration facilitates mounting of the liquid container on the liquid consuming device. The user holds the operation member and has no need to touch the liquid container body. This reduces the likelihood that the liquid container body is damaged to cause leakage of the liquid.

(2) In the liquid container of the above aspect, the liquid supply portion may be protruded outward from the operation member in the axial direction. In the liquid container of this aspect, the liquid supply portion is protruded outward from the operation member in the axial direction. This configuration causes the liquid supply portion to be visually recognizable when the user holds the grip surface to mount the liquid container on the liquid consuming device. This facilitates the user to recognize the mounting direction of the liquid container and thereby further facilitates mounting of the liquid container on the liquid consuming device.

(3) The liquid container of the above aspect may further comprise a positioning structure that is configured to position the liquid container relative to the liquid consuming device in mounting the liquid container on the liquid consuming device. In the liquid container of this aspect, the positioning structure works to position the liquid container and thus enables the liquid container to be adequately mounted on the liquid consuming device (in the adequate mounting state).

(4) In the liquid container of the above aspect, the operation member may further include a container-side electrical connection structure that is configured to be connectable with a device-side electrical connection structure provided on the liquid consuming device. The container-side electrical connection structure may be configured to be offset relative to the grip surface in the axial direction of the liquid supply portion. In the liquid container of this aspect, the container-side electrical connection structure is made visible when the user holds the grip surface of the operation member to mount the liquid container on the liquid consuming device. This configuration facilitates mounting of the liquid container on the liquid consuming device.

(5) In the liquid container of the above aspect, the container-side electrical connection structure may be protruded from the operation member in a direction substantially parallel to a protruding direction of the liquid supply portion. In the liquid container of this aspect, the container-side electrical connection structure and the liquid supply portion are protruded in the substantially parallel direction. This configuration facilitates the user to simultaneously recognize the container-side electrical connection structure and the liquid supply portion when the liquid container is mounted on the liquid consuming device. This facilitates connection of the liquid supply portion with the liquid consuming device and electrical connection of the container-side electrical connection structure with the device-side electrical connection structure of the liquid consuming device.

(6) In the liquid container of the above aspect, the container-side electrical connection structure may be arrayed with the liquid supply portion in a direction substantially parallel to the grip surface. The configuration of the liquid container of this aspect further facilitates electrical connection of the container-side electrical connection structure with the device-side electrical connection structure and connection of the liquid supply portion with the liquid consuming device.

(7) According to another aspect of the invention, there is provided a liquid container that is configured to be connectable with a liquid consuming device. The liquid container comprises a liquid container body that is configured to contain a liquid; and a liquid supply portion that is located in one end portion of the liquid container body, that is configured to support the liquid container body on an upper side of the liquid container body in a direction of gravity when the liquid container is connected to the liquid consuming device, and that is moved in a connecting direction including a component of a first direction that is a horizontal direction to be connectable with a liquid introducing portion of the liquid consuming device.

In the liquid container of this aspect, in the process of connecting the liquid container with the liquid consuming device, the liquid supply portion supports the liquid container body to be hung in the direction of gravity. This configuration eliminates the need to support the liquid container body in a horizontal direction in the process of connecting the liquid container with the liquid consuming device and thereby suppresses size expansion of the liquid consuming device in the horizontal direction. This configuration also eliminates the need for a casing to support the liquid container body in the horizontal direction. This reduces the total number of components and simplifies the configuration. The liquid supply portion is located above the liquid container body in the direction of gravity. This causes the connecting part (for example, the liquid supply portion) to be readily visible in the process of connecting to the liquid consuming device and thereby facilitates the connecting operation.

(8) In the liquid container of the above aspect, the connecting direction may be the first direction.

In the liquid container of this aspect, the connecting direction is one direction. This further facilitates the connecting operation.

(9) In the liquid container of the above aspect, the liquid supply portion may have a liquid supply port at one end to receive the liquid introducing portion inserted therein. The liquid supply port may be open toward a direction including a component of the first direction.

In the liquid container of this aspect, the liquid container is moved in the connecting direction, so that the liquid introducing portion of the liquid consuming device is readily inserted into the liquid supply port. This further facilitates connection of the liquid container with the liquid consuming device.

(10) The liquid container of the above aspect may further comprise a container-side electrical connection structure that is located on an one end portion-side of the liquid container, works in cooperation with the liquid supply portion to support the liquid container body on the upper side of the liquid container body in the direction of gravity when the liquid container is connected to the liquid consuming device, and is moved in the connecting direction to be connectable with a device-side electrical connection structure of the liquid consuming device.

In the liquid container of this aspect, in the process of connecting the liquid container with the liquid consuming device, the liquid supply portion and the container-side electrical connection structure support the liquid container body to be hung in the direction of gravity. In other words, the liquid supply portion and the container-side electrical connection structure more securely support the liquid container body. The container-side electrical connection structure is located above the liquid container body in the direction of gravity. This causes the connecting part (for example, the container-side electrical connection structure) to be readily visible in the process of connecting to the liquid consuming device and thereby facilitates the connecting operation.

(11) In the liquid container of the above aspect, the liquid supply portion and the container-side electrical connection structure may be arranged to be arrayed along a second direction that is orthogonal to the direction of gravity and the first direction when the liquid container is connected to the liquid consuming device.

In the liquid container of this aspect, the liquid supply portion and the container-side electrical connection structure are arrayed along the second direction. This configuration enables the positions of the liquid supply portion and the container-side electrical connection structure to be readily recognizable when the liquid container is moved in the connecting direction including the component of the first direction. This ensures connection of the liquid supply portion and the container-side electrical connection structure with the liquid consuming device with high accuracy.

(12) In the liquid container of the above aspect, the one end portion of the liquid container body may have a first end portion that is one end portion in the second direction and a second end portion that is the other end in the second direction. The liquid supply portion and the container-side electrical connection structure may be arranged at positions closer to a center of the one end portion in the second direction than the first end portion and the second end portion.

In the process of connecting the liquid container with the liquid consuming device, when one of the liquid supply portion and the container-side electrical connection structure is connected prior to the other, the liquid container body is likely to be rotated about the connected one as the point of support. The configuration of the liquid container of this aspect reduces the amount of rotation of the liquid container in the case where one of the liquid supply portion and the container side electrical connection structure is connected prior to the other, compared with a configuration that the liquid supply portion and the container-side electrical connection structure are arranged at positions closer to the first end portion and the second end portion than the center of the one end portion.

(13) The liquid container of the above aspect may further comprise a handle member that is provided on the one end portion-side of the liquid container body to be holdable. The handle member may comprise a first handle end that is one end in the second direction and a second handle end that is the other end in the second direction. The liquid supply portion and the container-side electrical connection structure may be located between the first handle end and the second handle end in the second direction.

In the liquid container of this aspect, the user can readily position the liquid supply portion and the container-side electrical connection structure relative to the liquid consuming device by simply gripping the handle member. This accordingly facilitates connection of the liquid supply portion and the container-side electrical connection structure with the liquid consuming device. Even in the case where the liquid container is rotated about the handle member, this configuration reduces the amount of rotation of the liquid supply portion and the container side electrical connection structure. This improves the operability in the process of connecting the liquid container with the liquid consuming device.

(14) In the liquid container of the above aspect, the liquid supply portion and the container-side electrical connection structure may be arranged at positions across a center of the handle member in the second direction.

In the liquid container of this aspect, the liquid supply portion and the container-side electrical connection structure further reduces the effect of rotation even when the liquid container is rotated about the handle member. This configuration improves the operability in the process of connecting the liquid container with the liquid consuming device and thereby ensures secure connection of the liquid container with the liquid consuming device.

(15) In the liquid container of the above aspect, in an initial state of the liquid container that the liquid is contained in the liquid container body prior to consumption of the liquid by the liquid consuming device, when the liquid container body is located on a lower side of the liquid supply portion and the container-side electrical connection structure in the direction of gravity, the liquid container body may comprise a first chamber that is connected with the handle member; and a second chamber that is located below the first chamber in the direction of gravity and has a greater length than length of the first chamber in the first direction.

In the liquid container of this aspect, the first chamber has the smaller length in the first direction than the second chamber. This reduces the likelihood that the first chamber interferes with smooth connection of the liquid supply portion and the container-side electrical connection structure with the liquid consuming device when the liquid container is moved in the connecting direction including the component of the first direction to be connected to the liquid consuming device.

(16) In the liquid container of the above aspect, in an initial state of the liquid container that the liquid is contained in the liquid container body prior to consumption of the liquid by the liquid consuming device, the liquid supply portion and the container-side electrical connection structure may be arranged at positions in the second direction across a center of gravity of the liquid container body in a connecting state that connection of the liquid container to the liquid consuming device is completed.

The configuration of the liquid container of this aspect reduces the amount of rotation of the liquid container about the liquid supply portion or the container-side electrical connection structure as the point of support in the connecting state.

(17) The liquid container of the above aspect may further comprise a pressing portion that is configured to be pressed in the connecting direction when the liquid container is connected to the liquid consuming device.

The liquid container of this aspect is movable in the connecting direction by the user's press of the pressing portion. This configuration facilitates connection of the liquid container with the liquid consuming device.

(18) In the liquid container of the above aspect, the pressing portion may be located at a position opposite to the liquid supply portion and the container-side electrical connection structure.

The configuration of the liquid container of this aspect stabilizes the motions of the liquid supply portion and the container-side electrical connection structure to the motions along the connecting direction when the user presses the pressing portion to move the liquid container in the connecting direction.

All the plurality of components included in the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as a device including one or more components among a plurality of components, i.e., a liquid container body, an operation member and a liquid supply portion. More specifically, this device may have or may not have the liquid container body. This device may have or may not have the operation member. This device may have or may not have the liquid supply portion. This aspect solves at least one of the various problems, for example, downsizing of the device, cost reduction, resource saving, easy manufacture and improvement of the usability. Part or all of the technical features in each of the aspects of the liquid container described above may be applied to this device. The "substantially parallel" state includes not only completely parallel state but approximately parallel state including a slight error or a slight deviation. The "substantially parallel" state accordingly includes the state that is not completely parallel in the range that achieves the advantageous effects described in the specification hereof. The "plane" in the specification hereof includes a flat surface, a surface with slight concavity and convexity and a slightly bent surface.

For example, another aspect of the invention may be implemented as a device including one or more components among a plurality of components, i.e., a liquid container body and a liquid supply portion. More specifically, this device may have or may not have the liquid container body. This device may have or may not have the liquid supply portion. This aspect solves at least one of the various problems, for example, downsizing of the device, cost reduction, resource saving, easy manufacture and improvement of the usability. Part or all of the technical features in each of the aspects of the liquid container described above may be applied to this device.

The invention may be implemented by any of various aspects other than the liquid container, for example, a method of manufacturing the liquid container and a liquid consuming system including the liquid container and a liquid consuming device.

DESCRIPTION OF EMBODIMENTS

A. Embodiment

A-1. Configuration of Liquid Consuming System

Figure 1:
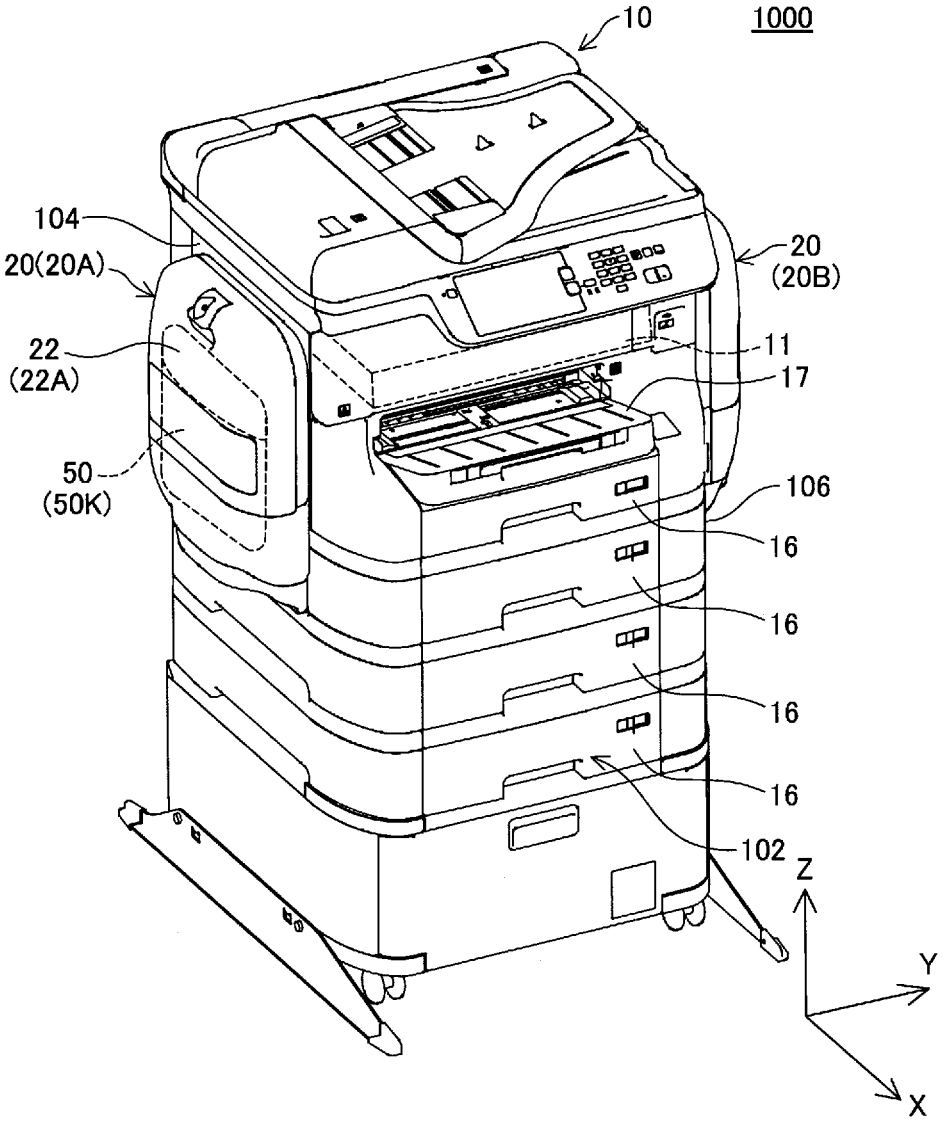
FIG. 1 is a first perspective view illustrating the general configuration of a liquid consuming system.
Figure 2:
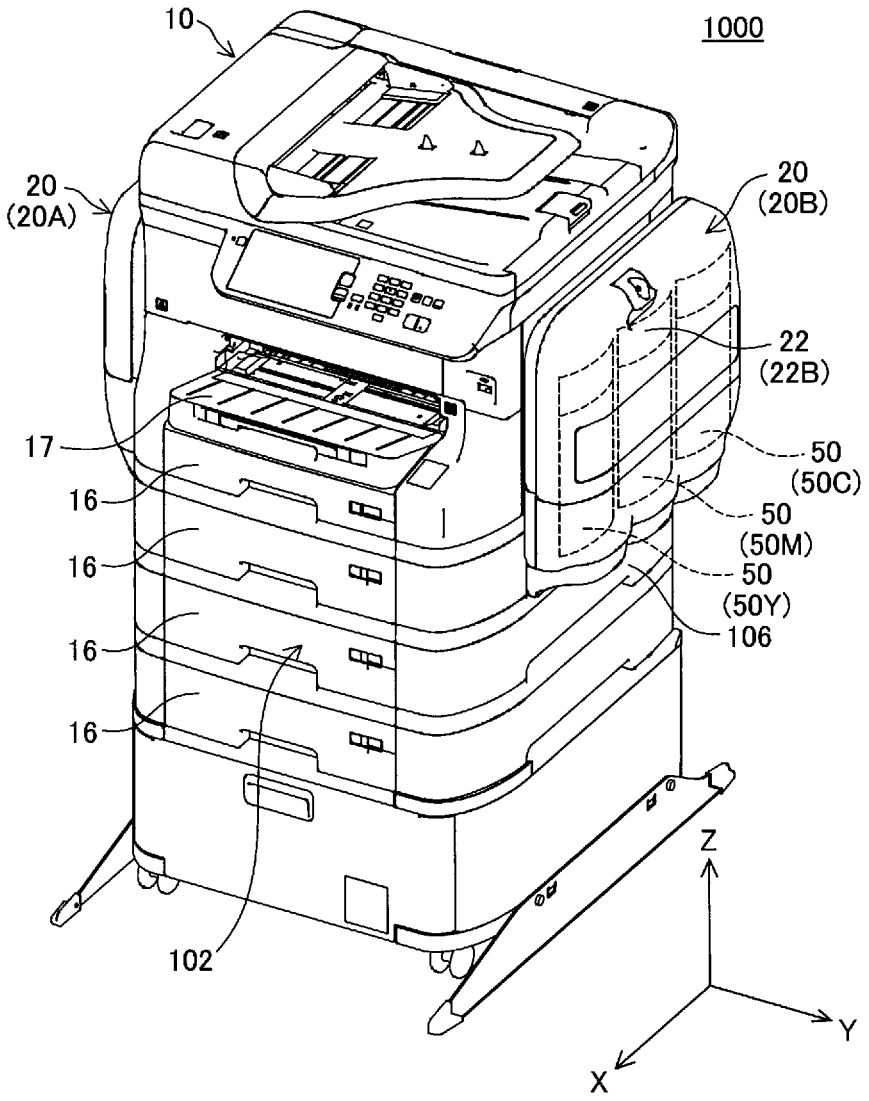
FIG. 2 is a second perspective view illustrating the general configuration of the liquid consuming system.
Figure 3:
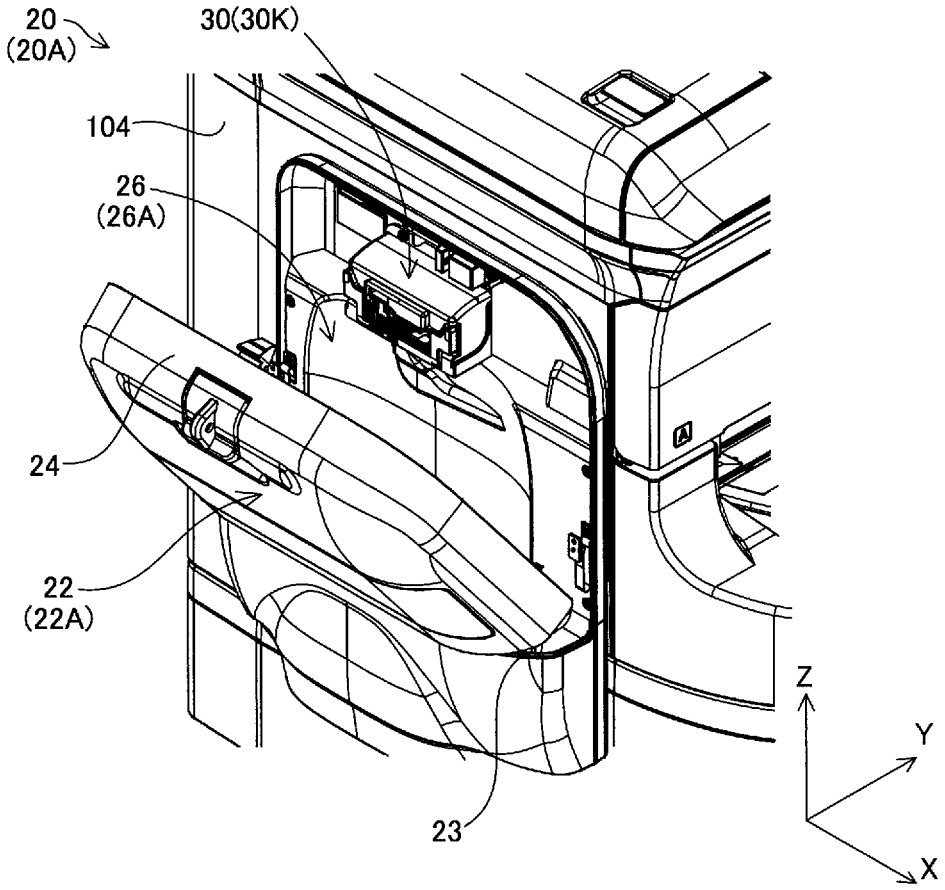
FIG. 3 is a first diagram illustrating a liquid supply device.
Figure 4:
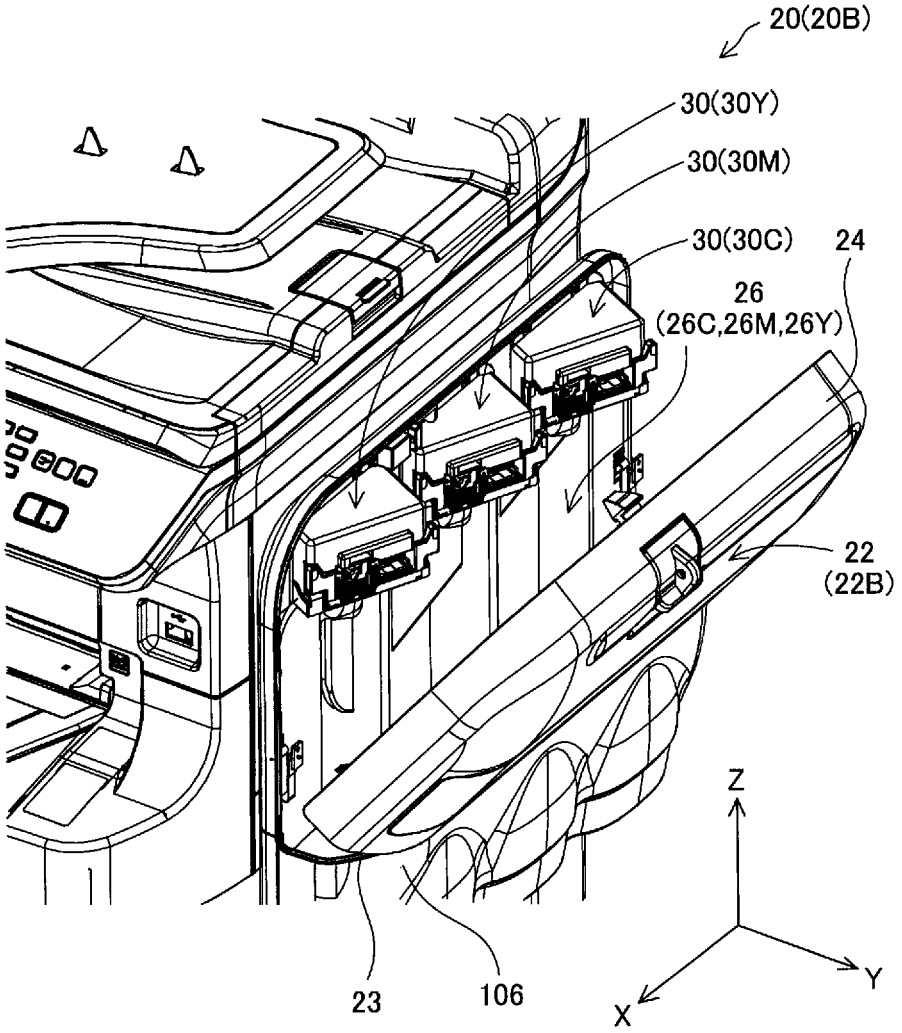
FIG. 4 is a second diagram illustrating the liquid supply device.

FIG. 1 is a first perspective view illustrating the general configuration of a liquid consuming system 1000. FIG. 2 is a second perspective view illustrating the general configuration of the liquid consuming system 1000. FIG. 3 is a first diagram illustrating a liquid supply device 20. FIG. 4 is a second diagram illustrating the liquid supply device 20. FIGS. 3 and 4 illustrate the state that liquid containers described later are demounted. X, Y and Z axes orthogonal to one another are shown in FIGS. 1 to 4.

As shown in FIG. 1, the liquid consuming system 1000 includes a printer 10 as a liquid consuming device and two liquid supply devices 20. In the use state of the liquid consuming system 1000, the printer 10 is placed on a horizontal plane defined by an X-axis direction and a Y-axis direction. In other words, a Z-axis direction is a vertical direction (top-bottom direction); −Z-axis direction is vertically downward direction and +Z-axis direction is vertically upward direction. The liquid supply devices 20 are configured to supply inks as liquids to the printer 10. Each liquid container 50 (liquid container unit 50) included in the liquid supply device 20 is detachably connected (attached) to the printer 10.

The printer 10 is an inkjet printer. The printer 10 includes a recording mechanism 11, feed trays 16 and an eject tray 17. A plurality of the feed trays 16 are provided at different height positions in the vertical direction. The feed trays 16 are placed on a device first surface (device front surface) 102 of the printer 10. The feed trays 16 contain recording media (for example, paper sheets) on which images such as characters and letters are printed (recorded) by the printer 10.

The recording mechanism 11 includes a record head (not shown) configured to eject ink. The record head is connected with the liquid supply devices 20 through flow pipes such as tubes. The record head uses ink supplied from the liquid supply device 20 and ejects the ink on the recording medium to perform recording (printing). The recording medium after recording is discharged to the eject tray 17.

The two liquid supply devices 20 are respectively placed on a device second surface (also called device first side surface or device first side wall) 104 and a device third surface (also called device second side surface or device second side wall) 106 arranged to intersect with the device first surface (also called device front surface or device front wall) 102 of the printer 10. The device first surface 102 to the device third surface 106 are surfaces respectively perpendicular to the installation surface of the printer 10 in the use state of the printer 10. The device second surface 104 and the device third surface 106 are opposed to each other. In the description hereof, the liquid supply device 20 provided on the device second surface 104 is also called first liquid supply device 20A, and the liquid supply device 20 provided on the device third surface 106 is also called second liquid supply device 20B. When there is no need to distinguish between the first and the second liquid supply devices 20A and 20B, the first and the second liquid supply devices 20A and 20B are simply called liquid supply device 20.

As shown in FIG. 1, the first liquid supply device 20A includes one cover member 22, one liquid container 50 and one mounting assembly unit 30 (shown in FIG. 3). As shown in FIG. 2, the second liquid supply device 20B includes one cover member 22, three liquid containers 50 and three mounting assembly units 30 provided corresponding to the respective liquid containers 50 (shown in FIG. 4). The two cover members 22 are distinguishable from each other by using symbols "22A" and "22B". The four liquid containers 50 are distinguishable from one another by using symbols "50K", "50C", "50M" and "50Y". The four mounting assembly units 30 are distinguishable from one another by using symbols "30K", "30C", "30M" and "30Y". The numbers of the cover members 22, the liquid containers 50 and the mounting assembly units 30 are not limited to this example. For example, the number of the liquid containers 50 may be three or less or may be five or more. The number of the mounting assembly units 30 may be determined corresponding to the number of the liquid containers 50. The number of the cover members 22 may be one or may be three or more.

The four liquid containers 50 contain (are filled with) different types of inks. According to this embodiment, yellow (Y), magenta (M), cyan (C) and black (K) inks are contained in the respective different liquid containers 50. The liquid container 50K has a liquid container body configured to contain black ink. The liquid container 50C has a liquid container body configured to contain cyan ink. The liquid container 50M has a liquid container body configured to contain magenta ink. The liquid container 50Y has a liquid container body configured to contain yellow ink. As shown in FIGS. 3 and 4, the liquid container 50 is contained in a housing space 26 defined by the cover member 22. More specifically, the liquid container 50K is contained in a housing space 26A (FIG. 3), and the liquid containers 50C, 50M and 50Y are contained in a housing space 26B (FIG. 4).

The mounting assembly units 30 shown in FIGS. 3 and 4 serve to mount the liquid containers 50 in a detachable manner. The mounting assembly unit 30K is placed inside of the cover member 22A, and the mounting assembly units 30C, 30M and 30Y are placed inside of the cover member 22B. As shown in FIG. 3, the mounting assembly unit 30K is provided on the device second surface 104 of the printer 10. As shown in FIG. 4, the mounting assembly units 30C, 30M and 30Y are provided on the device third surface 106 of the printer 10. In the state that the liquid container 50 is mounted on the mounting assembly unit 30, the ink contained in the liquid container 50 is supplied to the record head of the printer 10 by a supply mechanism (not shown) with a pump function included in the printer 10.

As shown in FIGS. 3 and 4, the cover member 22 is arranged to be openable and closable by rotating the other end 24 on the upper side in the vertical direction about one end 23 on the lower side in the vertical direction as the support point. After consumption of the ink contained in the liquid container 50, the user opens the cover member 22 and demounts the exhausted liquid container 50 from the mounting assembly unit 30. The use then mounts a new liquid container 50 to the mounting assembly unit 30 and closes the cover member 22.

A-2. Configuration of Mounting Assembly Unit 30

Figure 5:
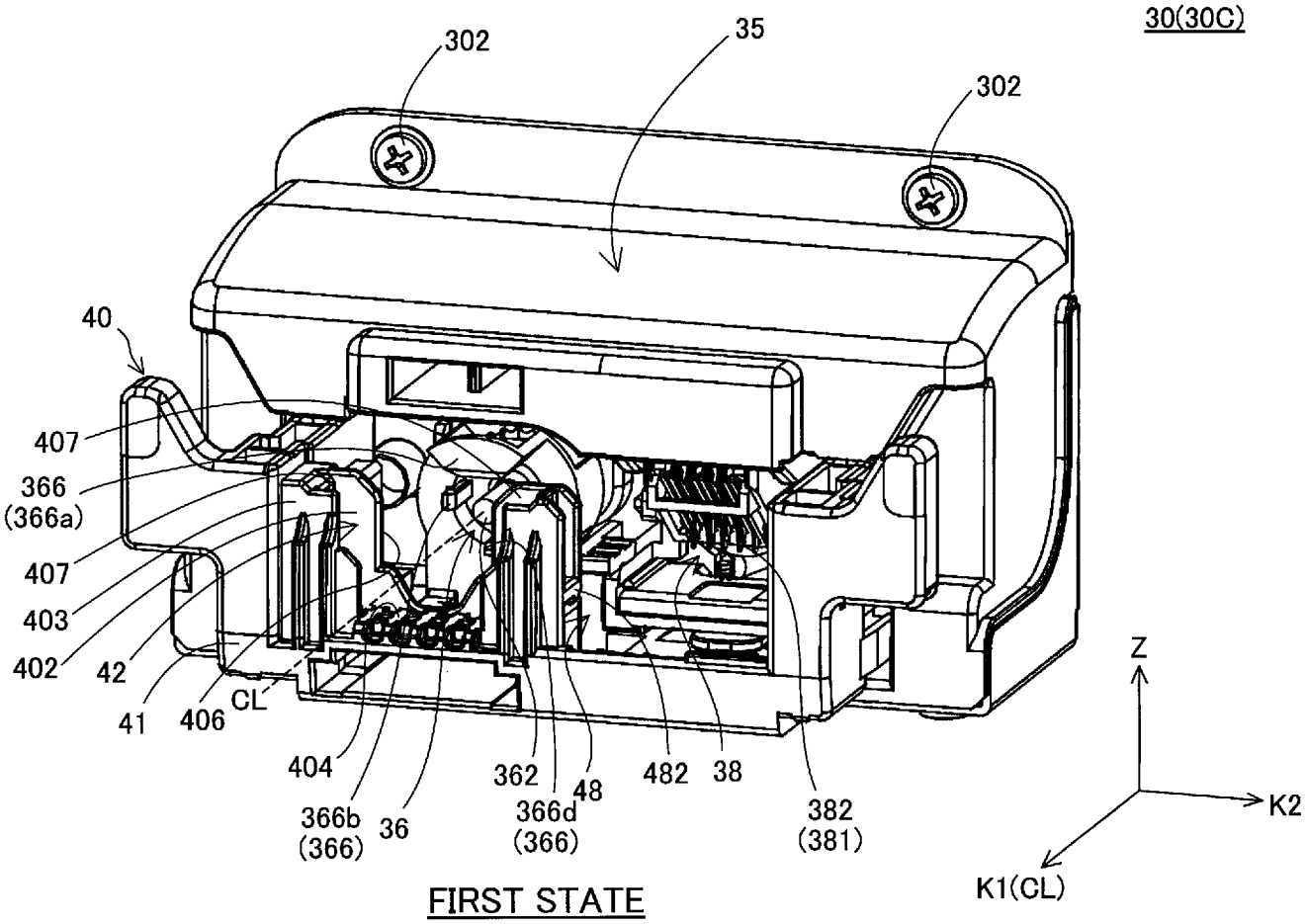
FIG. 5 is a first perspective view illustrating a mounting assembly unit.
Figure 6:
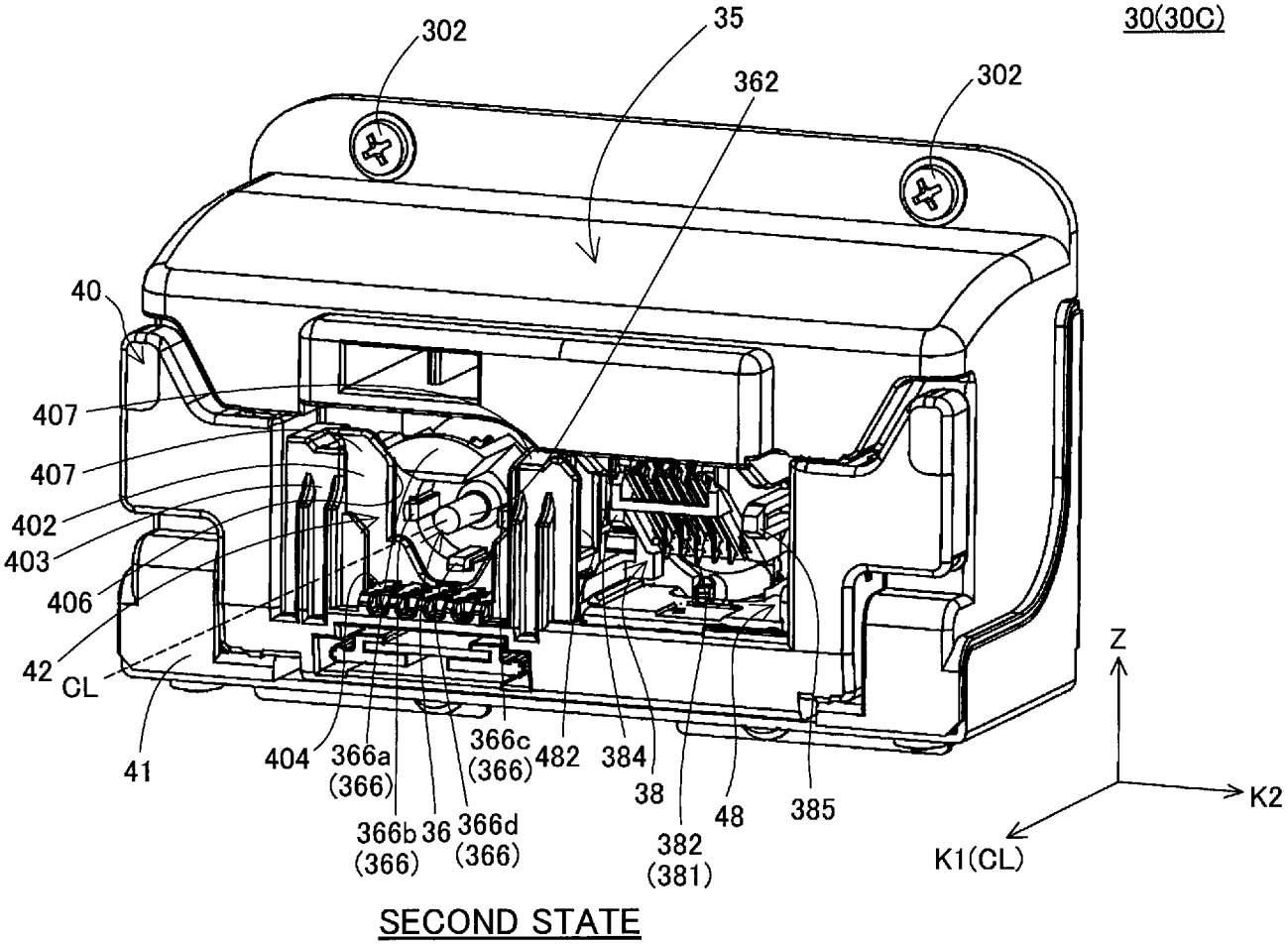
FIG. 6 is a second perspective view illustrating the mounting assembly unit.

FIG. 5 is a first perspective view illustrating the mounting assembly unit 30. FIG. 6 is a second perspective view illustrating the mounting assembly unit 30. FIG. 5 illustrates a first state (setting state) in which a movable member 40 is protruded outward relative to a stationary member 35. FIG. 6 illustrates a second state (mounting state) in which the movable member 40 is placed in the stationary member 35. The following describes the configuration of the mounting assembly unit 30C as an example with reference to FIGS. 5 and 6. The other mounting assembly units 30K, 30M and 30Y have the same configuration as that of the mounting assembly unit 30C. As shown in FIG. 5, the mounting assembly unit 30 includes the stationary member 35 and the movable member 40.

The liquid container 50 is mounted on the mounting assembly unit 30 by the following two operations. The state that the liquid container 50 is mounted on the mounting assembly unit 30 is also called "mounting state (connecting state)". The "mounting state (connecting state)" denotes the state that a liquid supply portion 57 (liquid flow portion 57) of the liquid container 50 described later is connected with a liquid introducing portion (liquid introducing needle) 362 of the mounting assembly unit 30 and that a circuit board (container-side electrical connection structure) 582 of the liquid container 50 is electrically connected with an electrical connection structure (device-side electrical connection structure) 382 of the mounting assembly unit 30. In the mounting state, the ink contained in the liquid container 50 can be flowed to the printer 10. In the description hereof, the container-side electrical connection structure 582 may be regarded as a contact portion cp.

*First Operation

The user makes the mounting assembly unit 30 in the first state and subsequently sets the liquid container 50 in the movable member 40.

*Second Operation

After the first operation, the user presses the movable member 40 against the stationary member 35 via the liquid container 50 and thereby makes the mounting assembly unit 30 in the second state.

In the second state of the mounting assembly unit 30, the motion of the movable member 40 relative to the stationary member 35 in a +K1-axis direction is restricted by a lock mechanism. In the second state, the lock mechanism is unlocked by pressing the movable member 40 inward (−K1-axis direction) relative to the stationary member 35. The movable member 40 may be then moved to be protruded outward (+Z-axis direction) relative to the stationary member 35, so that the state of the mounting assembly unit 30 may be changed from the second state to the first state.

The stationary member 35 is fixed to the surface 104 or 106 of the printer 10 (FIGS. 3 and 4) by means of a plurality of screws 302 serving as fixation elements. More specifically, the mounting assembly unit 30K (FIG. 3) is fixed to the second surface 104 by means of a plurality of screws 302, and the mounting assembly units 30C, 30M and 30Y (FIG. 4) are fixed to the third surface 106 by means of a plurality of screws 302.

The stationary member 35 has a liquid introducing mechanism 36 and a contact mechanism 38. The liquid introducing mechanism 36 includes the liquid introducing portion 362. A liquid supply assembly of the liquid container 50 described later is connected with the liquid introducing portion 362, so that the ink contained in the liquid container 50 is flowed. The liquid introducing portion 362 communicates with the record head of the printer 10.

The liquid introducing portion 362 is formed in a needle-like shape to have an inner cavity for ink flow. The liquid introducing portion 362 is extended along a center axis CL. A direction along this center axis CL (direction in which the liquid introducing portion 362 is extended) is specified as K1-axis direction. The K1-axis direction is orthogonal to the Z-axis direction. A direction orthogonal to both the K1-axis direction and the Z-axis direction is specified as K2-axis direction. A plane defined by the K1-axis direction and the K2-axis direction is parallel to the plane defined by the X-axis direction and the Y-axis direction shown in FIG. 1. With respect to the K1-axis direction, the outward direction of the printer 10 is +K1-axis direction, and the inward direction of the printer 10 is −K1-axis direction.

The liquid introducing mechanism 36 and the contact mechanism 38 are arrayed along the K2-axis direction. With respect to the K2-axis direction, the direction from the liquid introducing mechanism 36 toward the contact mechanism 38 is +K2-axis direction, and the direction from the contact mechanism 38 toward the liquid introducing mechanism 36 is −K2-axis direction. With respect to the mounting assembly unit 30, the Z-axis direction is also called "height direction", the K1-axis direction is also called "width direction", and the K2-axis direction is also called "depth direction".

As shown in FIGS. 5 and 6, the contact mechanism 38 includes an electrical connection structure (device-side electrical connection structure) 382 with a plurality of (nine in this embodiment) device-side terminals 381 and a plurality of (two in this embodiment) device-side substrate positioning structures 384 and 385. In the mounting state of the liquid container 50, the device-side terminals 381 of the electrical connection structure 382 comes into contact with (is electrically connected with) the circuit board of the liquid container 50. This establishes communication to transmit various information (for example, the color of ink contained in the liquid container 50 and the date of manufacture of the liquid container 50) between the circuit board of the liquid container 50 and the printer 10. The device-side terminals 381 are formed from elastically deformable metal leaf springs. The device-side substrate positioning structures 384 and 385 are arranged on both sides of the electrical connection structure 382 in the K2-axis direction (along which the liquid introducing mechanism 36 and the contact mechanism 38 are arrayed). The device-side substrate positioning structures 384 and 385 serve to eventually position the circuit board of the liquid container 50 relative to the electrical connection structure 382 when the liquid container 50 is mounted on the mounting assembly unit 30. The device-side substrate positioning structures 384 and 385 are members extended along the K1-axis direction.

The movable member 40 is configured to be movable along the K1-axis direction relative to the stationary member 35. The movable member 40 includes a base portion 41, a supply assembly support portion 42 and a substrate support portion 48. The supply assembly support portion 42 and the substrate support portion 48 are respectively connected with the base portion 41. The supply assembly support portion 42 and the substrate support portion 48 are members extended from the base portion 41 in the +Z-axis direction (upward).

The supply assembly support portion 42 is a member serving to position the liquid container 50 (more specifically, its liquid supply assembly) relative to the liquid introducing portion 362. When the mounting assembly unit 30 is viewed along the K1-axis direction, the supply assembly support portion 42 is located at a position overlapping with the liquid introducing portion 362. The supply assembly support portion 42 is formed in a concave shape in the −Z-axis direction. The supply assembly support portion 42 has grooves 407 formed on both sides thereof in the K2-axis direction. A positioning structure of the liquid container 50 described later enters the grooves 407, so as to restrict the motion of the liquid supply assembly of the liquid container 50 and roughly position the liquid container 50 relative to the mounting assembly unit 30. More specifically, a plurality of planes defining the supply assembly support portion 42 (for example, a first support plane 402, second support planes 403 and a third support plane 404) serve to restrict the motion of the liquid supply assembly of the liquid container 50 and roughly position the liquid container 50 relative to the mounting assembly unit 30. The first support plane 402 of the supply assembly support portion 42 located on the liquid introducing portion 362-side has a cutout 406. The cutout 406 is formed in a concave shape open on the +Z-axis direction side. When the mounting assembly unit 30 is viewed along the K1-axis direction, the cutout 406 is located at a position overlapping with the liquid introducing portion 362. In the first state that the movable member 40 is moved to the most +K1-axis direction position relative to the stationary member 35, the cutout 406 is located on the +K1-axis direction side of the liquid introducing portion 362. As shown in FIG. 6, in the second state, an end of the liquid introducing portion 362 is located inside of the cutout 406.

The substrate support portion 48 is a member serving to position the liquid container 50 (more specifically, its circuit board) relative to the contact mechanism 38. When the mounting assembly unit 30 is viewed along the K1-axis direction, the substrate support portion 48 is located at a position overlapping with the contact mechanism 38. The substrate support portion 48 is formed in a concave shape in the −Z-axis direction. A plurality of planes defining the substrate support portion 48 (for example, a first substrate support plane 482) serve to restrict the motion of the circuit board of the liquid container 50.

As described above, the movable member 40 is used to connect the liquid container 50 to the printer 10. The movable member 40 is thus also called "connecting member 40". The connecting member 40 is colored with the color of ink contained in the liquid container 50K 50C, 50M or 50Y which the mounting assembly unit 30 is to be connected with, among the plurality of liquid containers 50K, 50C, 50M and 50K containing different colors of inks. For example, the connecting member 40 of the mounting assembly unit 30Y that is to be connected with the liquid container 50Y containing yellow ink is colored with yellow. Herein "colored with the color of ink" includes colored with a similar color to the color of ink. The "similar color" may be any color in an identifiable range of the liquid container 50 to be connected when the user visually recognizes the connecting member 40. The "similar color" means, for example, colors having the hue differences of 0 (zero) to 3 in the 20 color wheel (also called modified Munsell color wheel) employed in JIS standards (JIS Z 8102).

A-3. Configuration of Liquid Container 50

Figure 7:
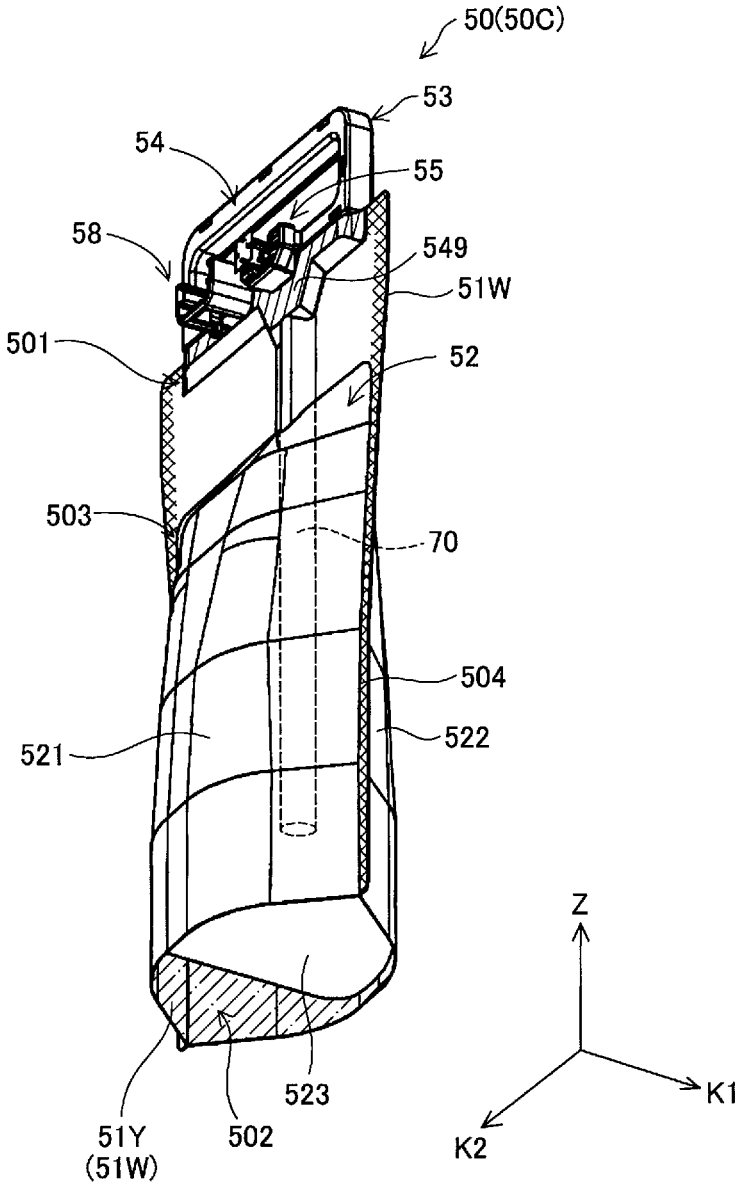
FIG. 7 is a first perspective view illustrating a liquid container.
Figure 8:
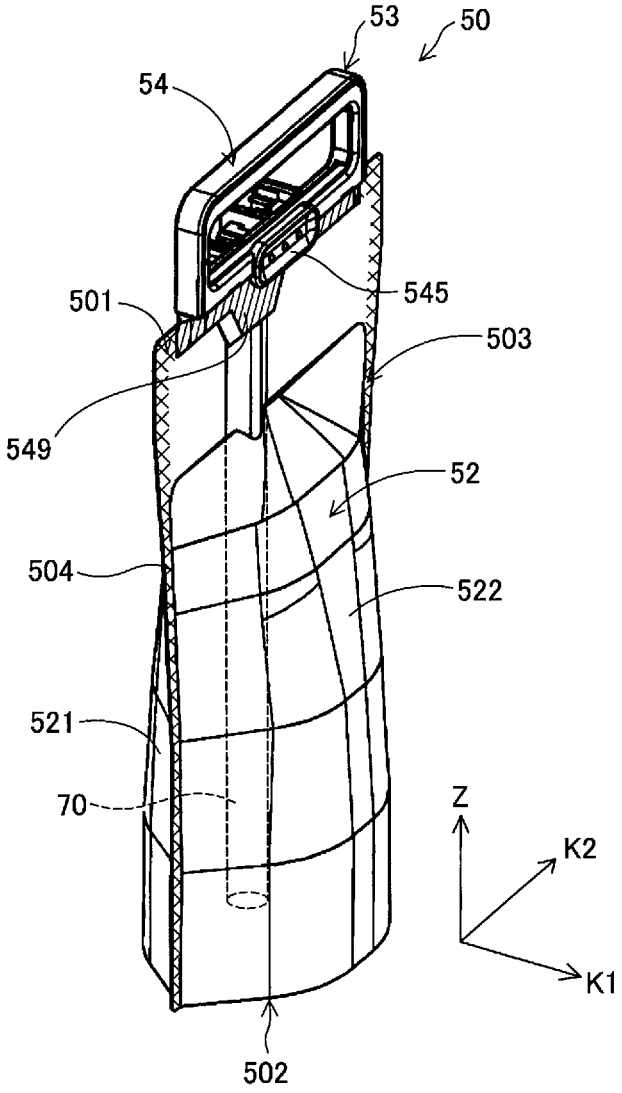
FIG. 8 is a second perspective view illustrating the liquid container.
Figure 8A:
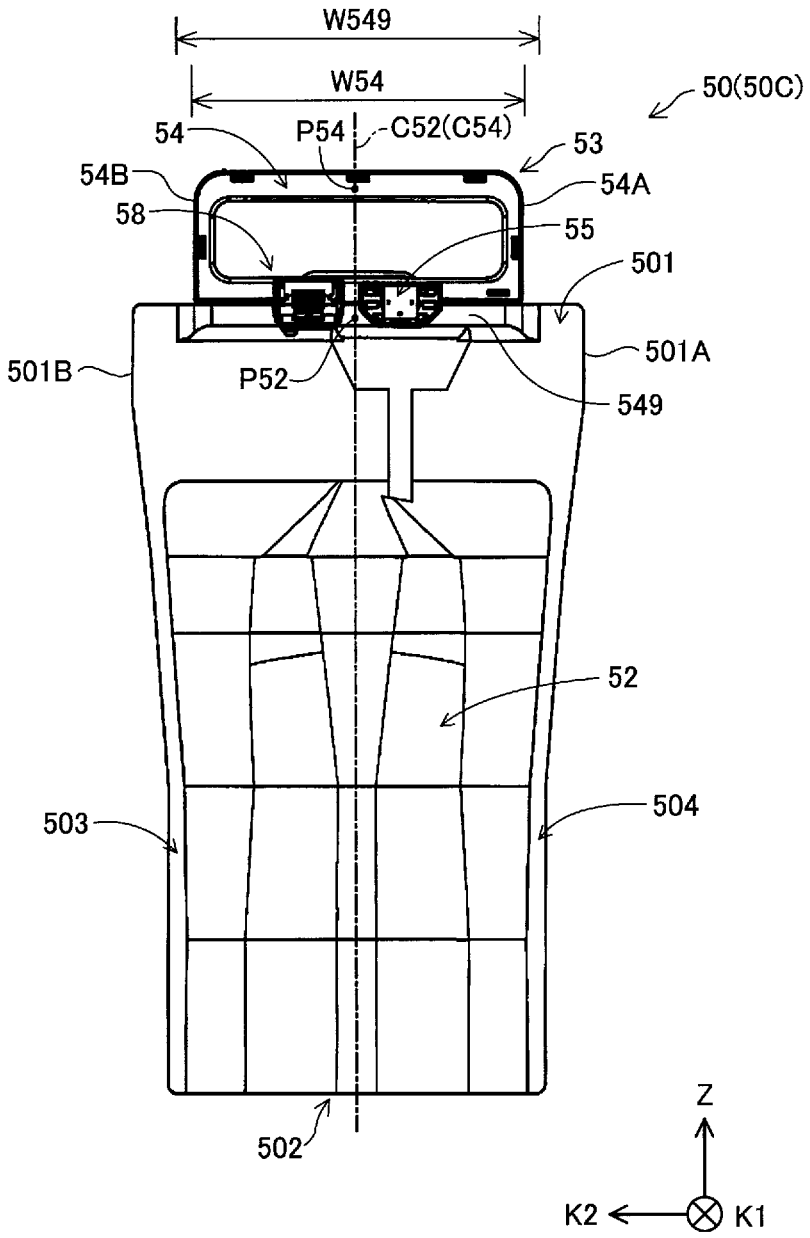
FIG. 8A is a front view illustrating the liquid container.
Figure 8B:
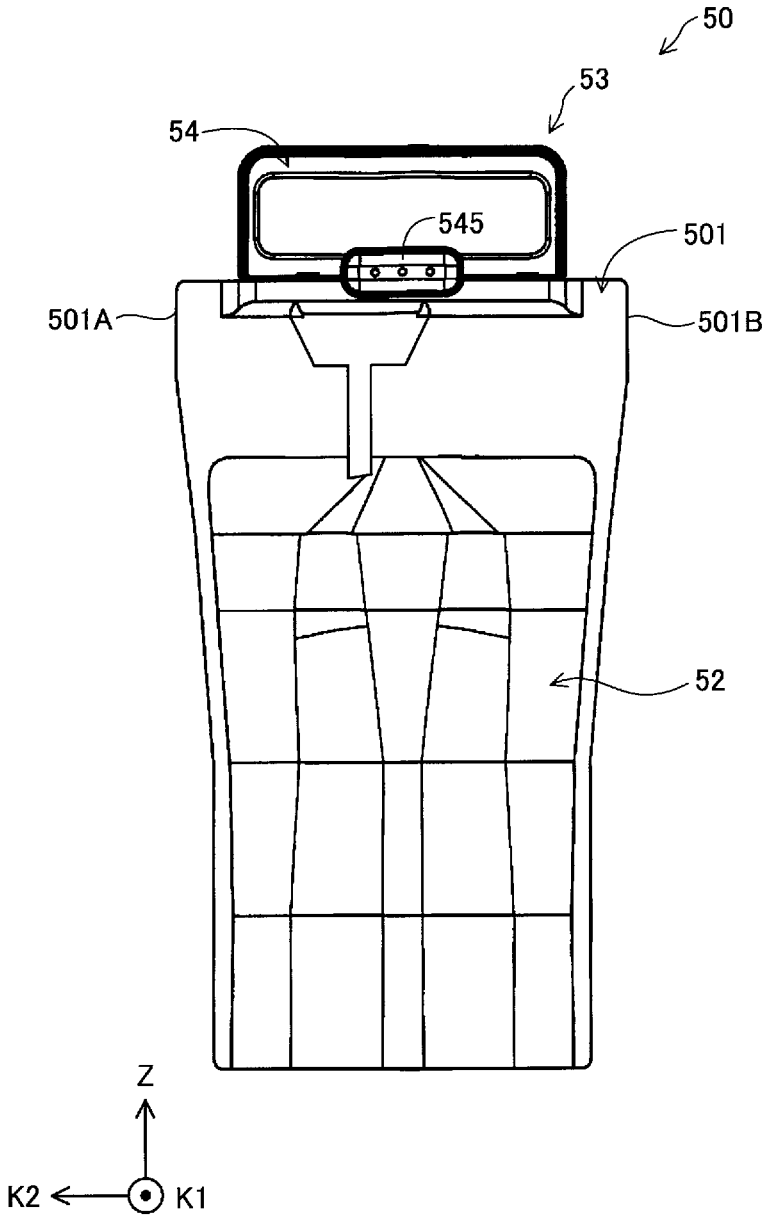
FIG. 8B is a rear view illustrating the liquid container.

FIG. 7 is a first perspective view illustrating the liquid container 50. FIG. 8 is a second perspective view illustrating the liquid container 50. FIG. 8A is a front view illustrating the liquid container 50. FIG. 8B is a rear view illustrating the liquid container 50. FIGS. 7, 8, 8A and 8B include Z axis, K1 axis and K2 axis in the state that the liquid container 50 is mounted on the mounting assembly unit 30 (in the mounting state). FIGS. 7, 8, 8A and 8B illustrate the liquid container 50 in the state that the liquid container 50 is filled with ink as a liquid prior to being mounted on the mounting assembly unit 30 (i.e., before the ink is consumed by the printer 10) (unused state, initial stage). The Z axis, the K1 axis and the K2 orthogonal to one another are also illustrated as appropriate in diagrams that are referred to later in description of the liquid container 50. The following describes the configuration of the liquid container 50C as an example with reference to FIG. 7 and subsequent diagrams. The other liquid containers 50K, 50M and 50Y have the same configuration as that of the liquid container 50C.

The Z axis, the K1 axis and the K2 axis orthogonal to one another are defined as described below. In the state that the liquid container 50 is connected with the printer 10, the Z-axis direction is the direction of gravity (vertical direction). The +Z-axis direction is the direction opposite to the direction of gravity or upward in the direction of gravity (vertically upward), and the −Z-axis direction is downward in the direction of gravity (vertically downward). The K1-axis direction (first direction) along the K1 axis is horizontal direction. The −K1-axis direction is the connecting direction (moving direction) of the liquid container 50 when the liquid container 50 is connected to the printer 10. More specifically, as described later, in the course of connection of the liquid container 50 to the printer 10, a liquid supply unit 55 described later (shown in FIG. 7) is moved in the connecting direction (−K1-axis direction), so that the liquid supply unit 55 (more specifically, its liquid supply portion 57) is connected with the liquid introducing portion (liquid introducing portion) 362 provided on the printer 10, and a substrate unit 58 (more specifically, electrical connection structure 58) is connected with the electrical connection structure 382 provided on the printer 10. The +K1-axis direction is the demounting direction in which the liquid container 50 is demounted from the printer 10. The connecting direction is the −K1-axis direction that is the horizontal direction in this embodiment, but is not restrictive. The connecting direction may be any direction including a horizontal direction component. The K2-axis direction (second direction) is the direction orthogonal to both the direction of gravity (Z-axis direction) and the first direction (K1-axis direction).

As shown in FIG. 7, the liquid container 50 includes a liquid container body 52 and an operation member (coupling member, handle member) 53. The operation member 53 is mounted on the liquid container body 52. The operation member 53 includes a grip portion (support portion) 54, a liquid supply unit 55, a substrate unit (container-side electrical connection structure) 58 and a pressing portion 545 (shown in FIG. 8). The grip portion 54 is a part grasped by the user to support (hold) the liquid container 50. The grip portion 54 is thus also called "handle portion 54" or "handle part 54". The liquid supply unit 55 is a component corresponding to the liquid introducing portion 362 and the supply assembly support portion 42 of the mounting assembly unit 30 (shown in FIG. 6). The substrate unit 58 is a component corresponding to the electrical connection structure 382 and the substrate support portion 48 of the mounting assembly unit 30 (shown in FIG. 6). The grip portion 54 of the operation member 53 is formed in an approximately rectangular frame-like shape in this embodiment but may be formed in an approximate C shape or in an approximate T shape.

The liquid container body 52 is configured to contain ink as the liquid. The liquid container body 52 is mounted on the operation member 53 in the state that the bag surface (outer surface) of the liquid container body 52 is exposed. In other words, the liquid container body 52 is not placed in a casing or the like but is made visible from outside. The liquid container body 52 has the volume decreasing with a decrease in amount of the ink contained.

The liquid container body 52 has a first sheet 521, a second sheet 522 and a third sheet 523. The first to the third sheets 521 to 523 are arranged to define an inner space for containing ink. A side of the liquid container body 52 mounted on the operation member 53 is expressed as one end (one end portion, upper end, upper end portion) 501-side, and a side opposite to the one end 501 is expressed as the other end (the other end portion, bottom end, bottom end portion) 502-side. One end side (+K2-axis direction side) of the liquid container body 52 is expressed as first side end (first side end portion) 503-side, and the other end side (−K2-axis direction side) is expressed as second side end (second side end portion) 504-side. As shown in FIG. 8A, the liquid supply assembly 55 and the substrate unit 58 are located on the one end portion 501-side of the liquid container body 52. According to this embodiment, when the liquid container 50 is viewed along the K1-axis direction, the liquid supply assembly 55 and the substrate unit 58 are located to at least partly overlap with the one end portion 501.

When the liquid container 50 is connected to the printer 10, the liquid supply assembly 55 supports the liquid container body 52 at a position on the upper side (+Z-axis direction side) of the liquid container body 52 in the direction of gravity (Z-axis direction). More specifically, as described later, the liquid supply assembly 55 (more specifically its positioning structure 56 described later) is supported by the supply assembly support portion 42 of the movable member 40 (shown in FIG. 5), so as to support the liquid container body 52.

When the liquid container 50 is connected to the printer 10, the substrate unit 58 works in cooperation with the liquid supply assembly 55 to support the liquid container body 52 at a position on the upper side (+Z-axis direction side) of the liquid container body 52 in the direction of gravity (Z-axis direction). More specifically, as described later, the substrate unit 58 (more specifically its circuit board holding portion 59 described later) is supported by the substrate support portion 48 of the movable member 40 (shown in FIG. 5), so as to support the liquid container body 52.

As shown in FIG. 8A, in the connecting state of the liquid container 50, the liquid supply unit 55 and the substrate unit 58 are arrayed along the K2-axis direction (second direction). More specifically, when the liquid container 50 is viewed from the direction along the K2-axis direction, the liquid supply unit 55 and the substrate unit 58 are arranged to at least partly overlap with each other (as shown in FIG. 17H described later).

As shown in FIGS. 7 and 8, in the mounting state of the liquid container 50, the first sheet 521 and the second sheet 522 form a side surface of the liquid container body 52. In the mounting state of the liquid container 50, the third sheet 523 forms a bottom surface of the liquid container body 52. The first sheet 521 and the second sheet 522 are arranged to face each other. The first sheet 521 and the second sheet 522 respectively have peripheral areas 51W partly welded. More specifically, a one end 501-side part, a first side end 503-side part and a second side end 504-side part of the peripheral areas 51W are welded. In order to facilitate understanding, the welded parts of the first sheet 521 to the second sheet 522 are shown by cross-hatching in FIGS. 7 and 8. The operation member 53 is welded to the one end 501 of the liquid container body 52 (more specifically, the respective one ends of the first and the second sheets 521 and 522). In other words, the operation member 53 is provided as a member mountable on the one end 501 of the liquid container body 52. The operation member 53 is the member located on the one end portion 501-side of the liquid container body 52. In order to facilitate understanding, the welded part of the operation member 53 to the first and the second sheets 521 and 522 is shown by the solid line single-hatching in FIGS. 7 and 8. The first and the second sheets 521 and 522 are mounted on a mounting portion (joint portion) 549 of the operation member 53 by welding as described later in detail.

As shown in FIG. 7, a peripheral area 51Y of the third sheet 523 is welded to part of the peripheral areas 51W of the first and the second sheets 521 and 522. The welded part of the third sheet 523 to the first and the second sheets 521 and 522 is shown by the one-dot chain line single-hatching. As described above, the liquid container body 52 of the embodiment is in a form that the three sheets 521, 522 and 523 are bonded by welding or the like (pouch-like form having a bottom surface).

The first to the third sheets 521 to 523 are members having flexibility. The material used for the first to the third sheets 521 to 523 may be, for example, polyethylene terephthalate (PET), nylon or polyethylene. The first to the third sheets 521 to 523 may have layered structure formed by stacking a plurality of films made of these materials. In the layered structure, for example, an outer layer may be made of PET or nylon having excellent impact resistance, and an inner layer may be made of polyethylene having excellent ink resistance. A film having a deposition layer of, for example, aluminum may be included as one component member of the layered structure. This enhances the gas barrier property and suppresses, for example, a change in concentration of the ink contained in the liquid container body 52. In this manner, the material of the liquid container body 52 may be determined arbitrarily.

The shape and the size of the liquid container body 52 may also be determined arbitrarily. For example, the liquid container body 52K containing black ink may be made to have the larger capacity (larger size) than that of the liquid container body 52C containing another color ink (for example, cyan ink). According to this embodiment, the liquid container body 52 is in the form that the first to the third sheets 521 to 523 are bonded by welding or the like. The liquid container body 52 may alternatively be in a form that the first and the second sheets 521 and 522 are bonded by welding or the like with omission of the third sheet 523 (pillow-like form). As described above, the liquid container body 52 and the operation member 53 are separate members. Accordingly, the type of the liquid container body 52 (shape, size and material) may be readily changed, while the same operation member 53 is used. In other words, the shape, the size and the material of the liquid container body 52 may be determined according to the properties and the volume of the liquid to be contained in the liquid container body 52. This increases the flexibility of design.

The liquid container 50 additionally has a flow path member 70 that is configured to flow the ink contained in the liquid container body 52 to the liquid supply unit 55 (more specifically its liquid supply portion described later). According to this embodiment, the flow path member 70 is a tube. The flow path member 70 is placed inside of the liquid container body 52.

The respective components of the liquid container 50 have the following relationships as described below with reference to FIG. 8A. The width of the grip portion 54 at the one end portion 501 of the liquid container body 52 along the longitudinal direction (K2-axis direction) is specified as width W54. The width of the joint portion 549 along the longitudinal direction (K2-axis direction) is specified as width W549. The width W54 denotes a distance between one end (first handle end) 54A and the other end (second handle end) 54B of the grip portion 54 in the longitudinal direction (K2-axis direction). In the longitudinal direction (K2-axis direction), the liquid supply unit 55 and the substrate unit 58 are located between the respective ends 54A and 54B of the grip portion 54.

The liquid supply unit (liquid supply assembly) 55 and the substrate unit (container-side electrical connection structure) 58 are placed at positions across a center P54 of the handle portion 54 (center line C54) in the second direction (K2-axis direction, longitudinal direction). The center line C54 is a line that goes through the center P54 and is along the Z-axis direction.

The one end portion 501 of the liquid container body 52 has a first end portion 501A that is one end portion in the second direction (K2-axis direction) and a second end portion 501B that is the other end portion. The liquid supply unit (liquid supply assembly) 55 and the substrate unit (container-side electrical connection structure) 58 are placed at positions closer to a center P52 of the one end portion 501 (center line C52) than the first end portion 501A and the second end portion 501B in the second direction (K2-axis direction). The center line C52 is a line that goes through the center P52 and is along the Z-axis direction. According to this embodiment, the center line C52 and the center line C54 are substantially identical with each other.

Figure 9:
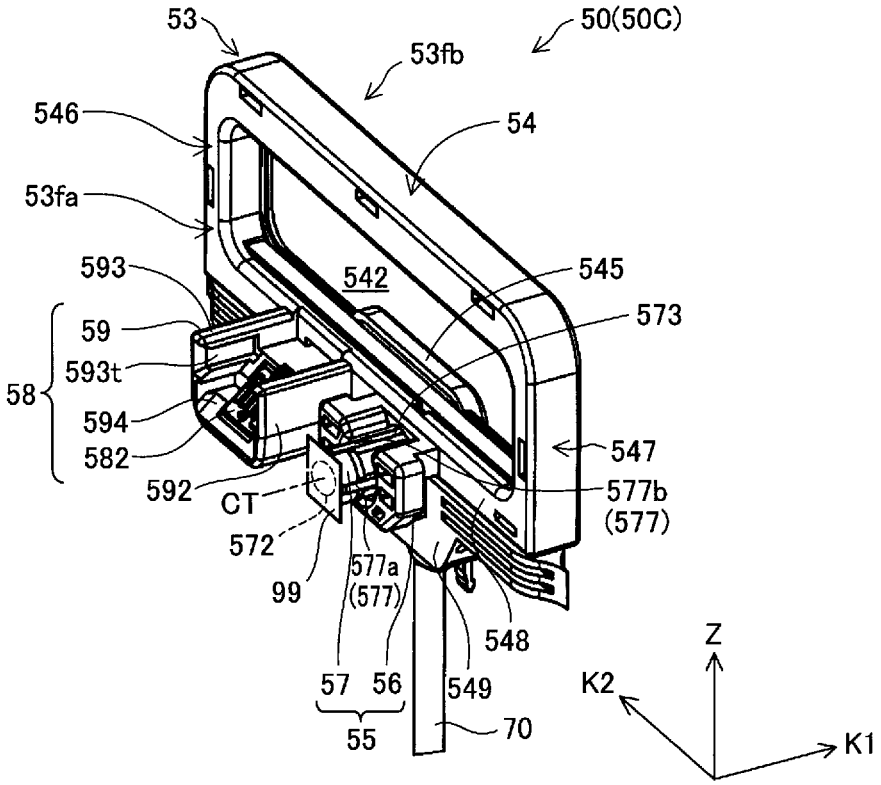
FIG. 9 is a first perspective view illustrating part of the liquid container.
Figure 10:
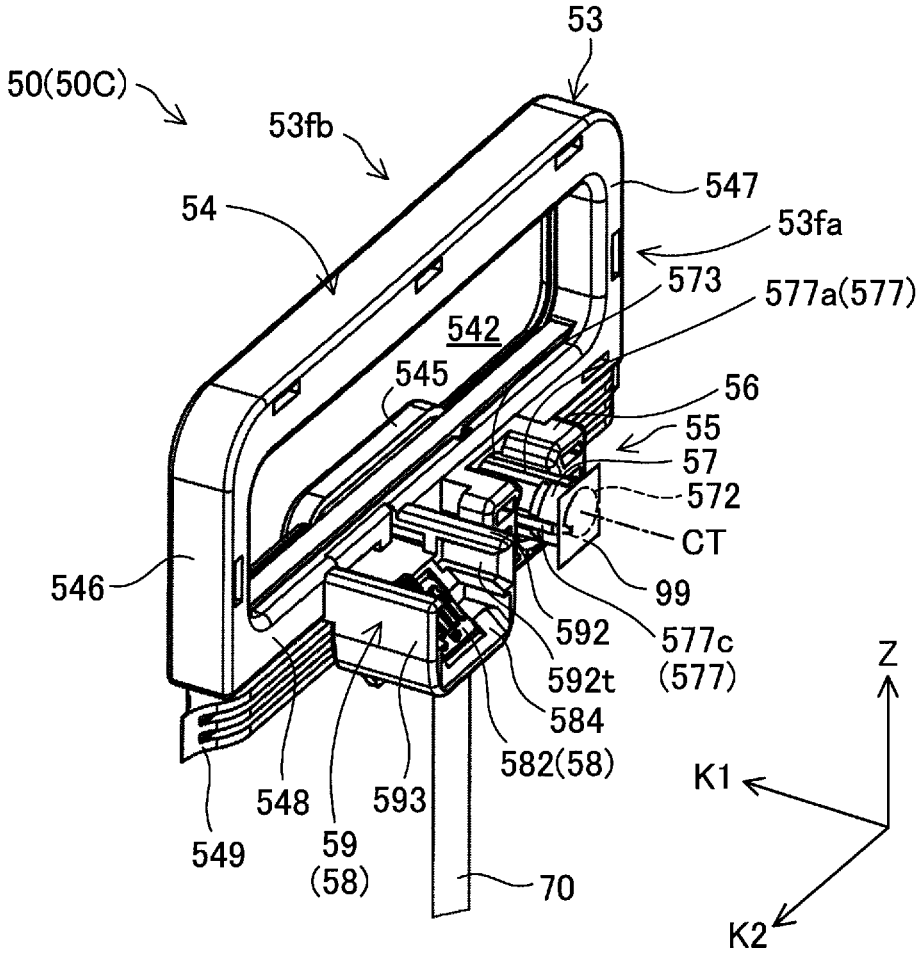
FIG. 10 is a second perspective view illustrating the part of the liquid container.
Figure 11:
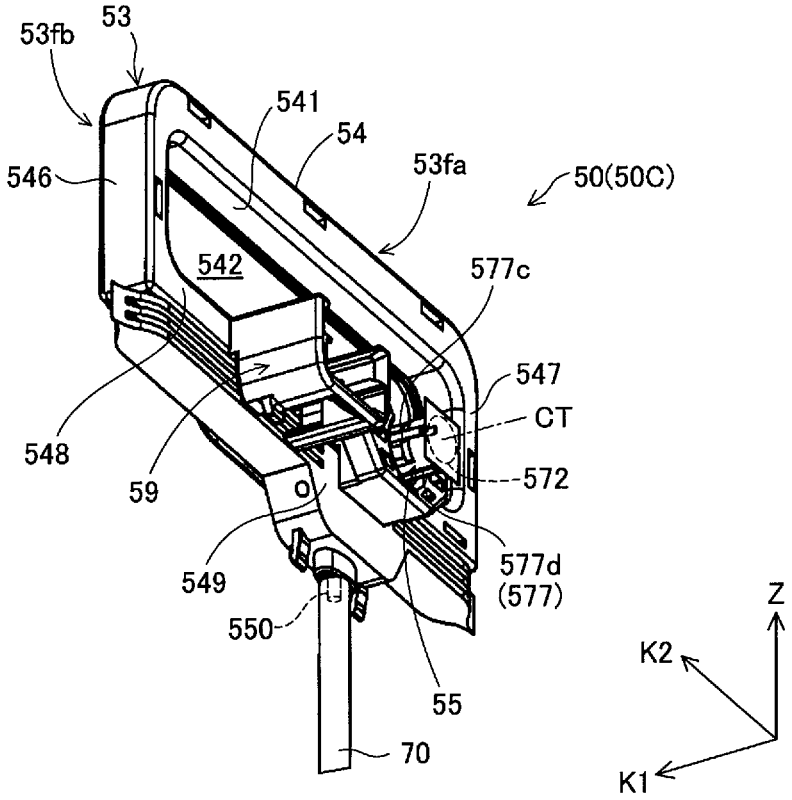
FIG. 11 is a third perspective view illustrating the part of the liquid container.
Figure 12:
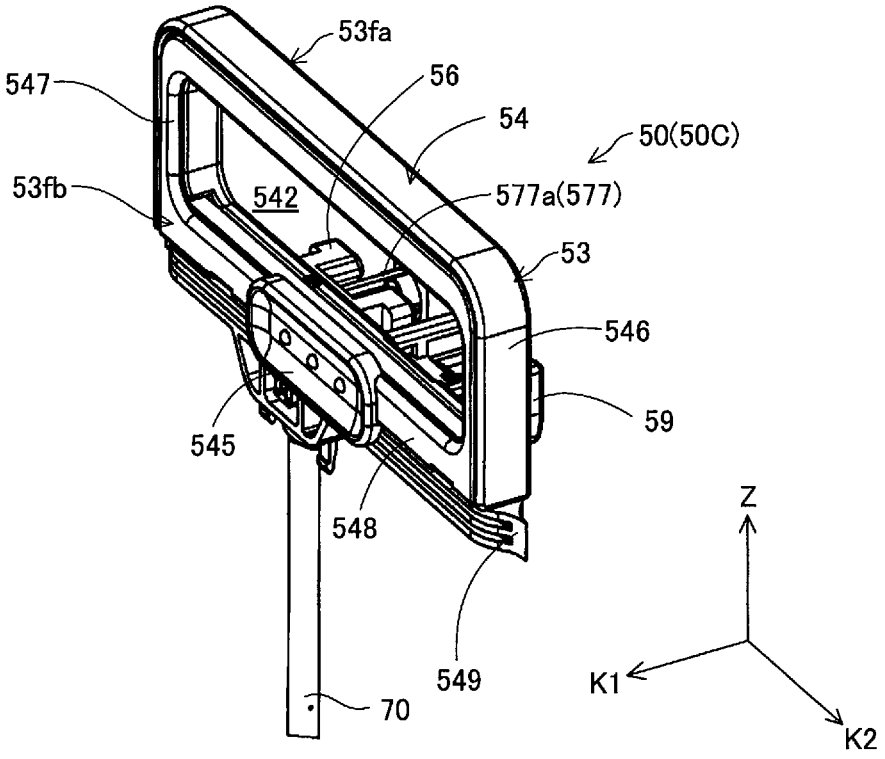
FIG. 12 is a fourth perspective view illustrating the part of the liquid container.
Figure 13:
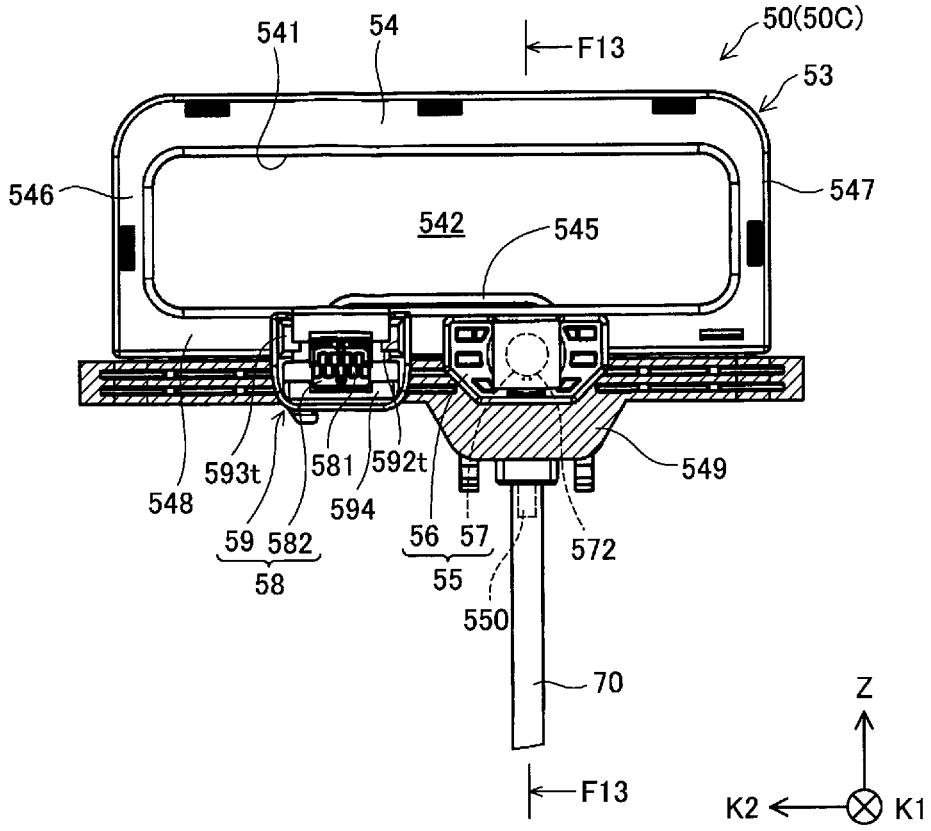
FIG. 13 is a front view illustrating the part of the liquid container.
Figure 14:
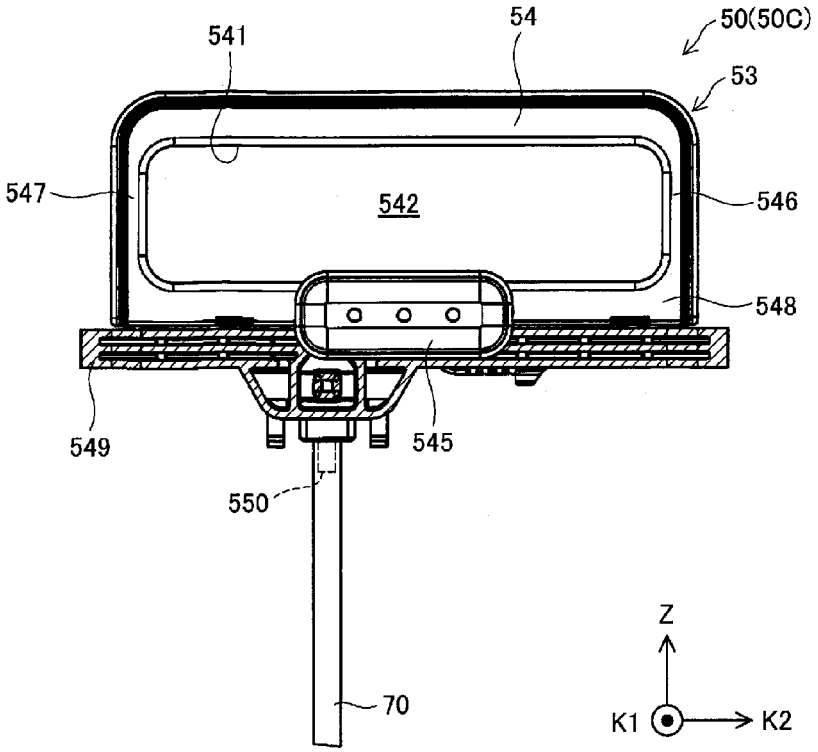
FIG. 14 is a rear view illustrating the part of the liquid container.
Figure 15:
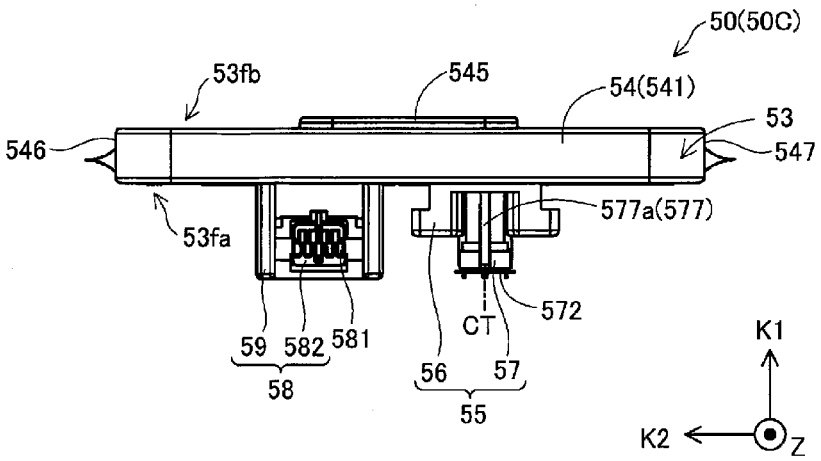
FIG. 15 is a top view illustrating the part of the liquid container.
Figure 16:
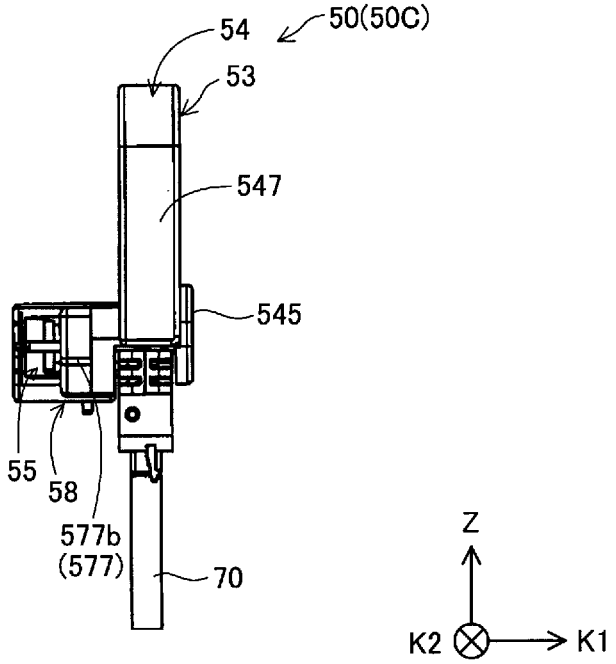
FIG. 16 is a right side view illustrating the part of the liquid container.
Figure 16A:
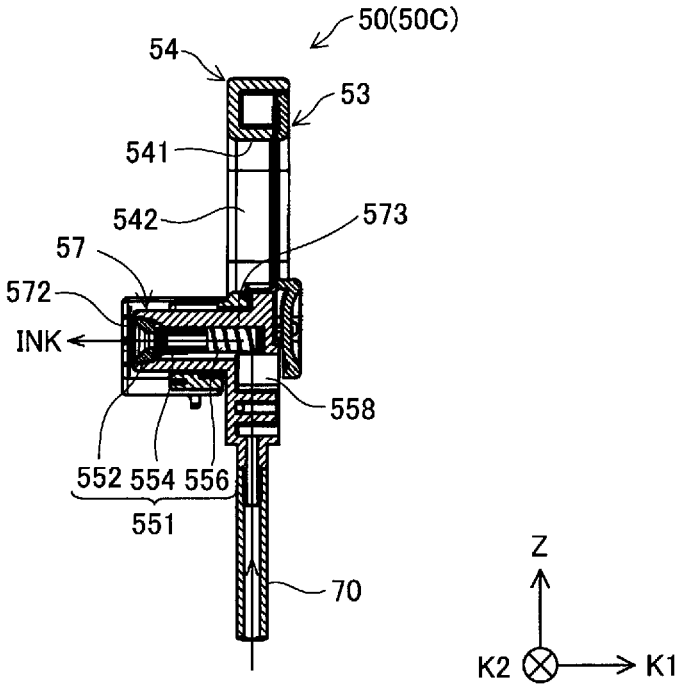
FIG. 16A is an F13-F13 sectional view of FIG. 13.
Figure 16B:
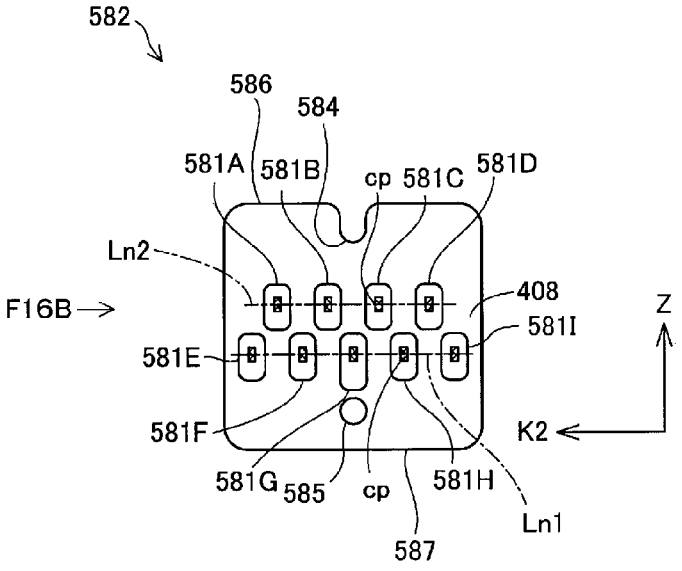
FIG. 16B is a front view illustrating a circuit board.
Figure 16C:
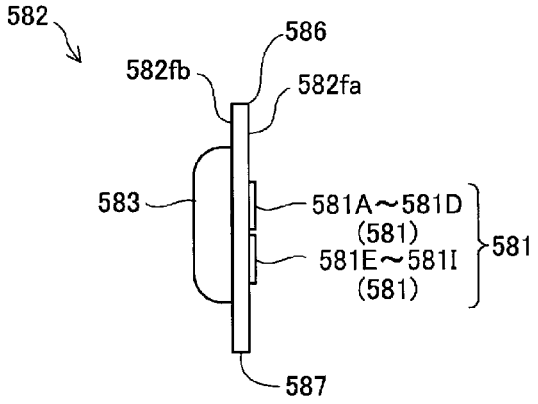
FIG. 16C is a view from an arrow F16B of FIG. 16B.

FIG. 9 is a first perspective view illustrating part of the liquid container 50. FIG. 10 is a second perspective view illustrating the part of the liquid container 50. FIG. 11 is a third perspective view illustrating the part of the liquid container 50. FIG. 12 is a fourth perspective view illustrating the part of the liquid container 50. FIG. 13 is a front view illustrating the part of the liquid container 50. FIG. 14 is a rear view illustrating the part of the liquid container 50. FIG. 15 is a top view illustrating the part of the liquid container 50. FIG. 16 is a right side view illustrating the part of the liquid container 50. FIG. 16A is an F13-F13 sectional view of FIG. 13. FIG. 16B is a front view illustrating a circuit board 582. FIG. 16C is a view from an arrow F16B of FIG. 16B. In FIGS. 9 to 16A, the liquid container body 52 of the liquid container 50 is omitted from the illustration.

As shown in FIGS. 9 and 10, the operation member (handle member) 53 includes the grip portion 54, a first connecting portion 546, a second connecting portion 547, a base portion (coupling portion) 548 and a mounting portion 549. With respect to the operation member 53, the Z-axis direction is also called "height direction", the K1-axis direction is also called "thickness direction", and the K2-axis direction is also called "width direction". According to this embodiment, the "height direction", the "thickness direction" and the "width direction" of the operation member 53 correspond to the "height direction", the "thickness direction" and the "width direction" of the liquid container 50. In this embodiment, the liquid container 50 has the height, the width and the thickness in descending order. The mounting portion 549 may be regarded as a component of the operation member 53 as described above or may be regarded as a separate component from the operation member 53.

The grip portion 54, the first connecting portion 546, the second connecting portion 547 and the base portion 548 are formed in rod-like shape. The grip portion 54, the first connecting portion 546, the second connecting portion 547 and the base portion 548 form a frame-like member. This accordingly forms an approximately rectangular insertion space 542 to accept the user's hand in the operation member 53.

The grip portion 54 is a holdable part. The grip portion 54 is a part grasped by the user to hold the liquid container 50. The grip portion 54 is extended along the K2-axis direction. As shown in FIG. 11, the grip portion 54 includes a grip surface (support surface) 541 that is in contact with the insertion space 542. The grip surface 541 is a plane substantially perpendicular to the Z-axis direction in the mounting state that the liquid container 50 is mounted on the mounting assembly unit 30.

As shown in FIG. 9, the first connecting portion 546 is a member extended from one end of the grip portion 54 in the K2-axis direction toward the base portion 548-side (−Z-axis direction side, liquid container body 52-side shown in FIG. 7). The second connecting portion 547 is a member extended from the other end of the grip portion 54 in the K2-axis direction toward the base portion 548-side (−Z-axis direction side, liquid container body 52-side shown in FIG. 7). The base portion 548 is a part opposed to the grip portion 54 across the insertion space 542. The base portion 548 is extended along the K2-axis direction. A positioning structure 56, a circuit board holding portion (contact array portion, substrate holding portion) 59 and a pressing portion 545 (shown in FIG. 12) described later are mounted to the base portion 548. In other words, the positioning structure 56 of the liquid supply unit 55 and the container-side electrical connection structure 58 including the circuit board holding portion (contact array portion) 59 are coupled with each other via the base portion 548. This causes the liquid supply unit 55 and the circuit board holding portion 59 to move in conjunction with the motion of the base portion 548. The user can thus control the motions of the liquid supply unit 55 and the circuit board holding portion 59 used to connect the liquid container 50 to the printer 10 by controlling the motion of one member (base portion 548 according to this embodiment). Herein "coupling" means that coupled members are connected such as to move in conjunction with each other.

The mounting portion (joint portion) 549 is located on the opposite side to the grip portion 54 across the base portion 548. The mounting portion 549 is arranged adjacent to the base portion 548. The mounting portion 549 is extended along the K2-axis direction. The mounting portion 549 is a part which one end 501 of the liquid container body 52 (shown in FIG. 7) is mounted to (joined with) by welding or the like. The mounting portion 549 is coupled with the operation member 53. As shown in FIGS. 13 and 16A, the mounting portion 549 has an outlet element 550 that is configured to flow the ink contained in the liquid container body 50 to the liquid supply portion 57. The flow path member 70 is connected with the outlet element 550, so that the ink flowing in the flow path member 70 flows through the outlet element 550 to the liquid supply portion 57. In order to facilitate understanding, the part of the mounting portion 549 which the liquid container body 52 is mounted to is shown by single-hatching in FIGS. 13 and 14.

As shown in FIGS. 9 and 10, the liquid supply unit 55 includes the liquid supply portion 57 and the positioning structure 56. The positioning structure 56 is configured separately from the liquid supply portion 57 and is arranged away from the liquid supply portion 57 across a slight gap. The liquid supply unit 55 (positioning structure 56) is provided to be extruded outward (in the −K1-axis direction) from the operation member 53.

The liquid supply portion 57 flows the ink contained in the liquid container body 52 to the printer. The liquid supply portion 57 includes a liquid supply port 572 at one end and a supply connecting portion 573 at the other end. The liquid supply port 572 is configured to communicate with inside of the liquid container body 52 and flow out the ink contained in the liquid container body 52 to outside (printer 10). The liquid introducing portion 362 (shown in FIG. 5) is inserted into the liquid supply port 572 in the mounting state of the liquid container 50. The liquid supply port 572 defines a plane perpendicular to the grip surface 541 (surface defined by the Z-axis direction and the K2-axis direction). The liquid supply port 572 is open toward the first direction (K1-axis direction). More specifically, the liquid supply port 572 is open toward the connecting direction (−K1-axis direction) with respect to the first direction (K1-axis direction). The opening direction is a direction perpendicular to the plane defined by the liquid supply port 572 and toward outside. The liquid supply port 572 is not limited to the configuration that is open toward the first direction but may be open toward a direction including a first direction component.

The supply connecting portion 573 is connected with the operation member 53. The liquid supply portion 57 is a tubular member (circular member) extended along the K1-axis direction (center axis CT direction). The liquid supply portion 57 is provided to be protruded outward (in the −K1-axis direction) from the operation member 53.

The liquid supply portion 57 has a center axis CT. The center axis CT is parallel to the K1-axis direction. With respect to the K1-axis direction, the direction from the liquid supply port 572 toward the supply connecting portion 573 is specified as +K1-axis direction, and the direction from the supply connecting portion 573 toward the liquid supply port 572 is specified as −K1-axis direction.

As shown in FIG. 15, the grip surface 541 is located on a direction side (+Z-axis direction side) perpendicular to the center axis CT direction (K1-axis direction) of the liquid supply portion 57. The operation member 53 including the grip surface 541 is provided to be offset relative to the liquid supply port 572 in the center axis CT direction. In other words, the liquid supply port 572 is located at a position that does not overlap with the grip surface 541 (operation member 53) when the liquid container 50 is viewed in the direction that is orthogonal to the grip surface 541 and is from the liquid supply portion 57 toward the grip surface 541 (i.e., in the +Z-axis direction). The grip surface 541 and the liquid supply port 572 are accordingly arranged in such a positional relationship that do not overlap with each other when the liquid container 50 is projected to a plane parallel to the grip surface 541.

As shown in FIG. 9, in the unused state of the liquid container 50, the liquid supply port 572 is closed by a film 99. This suppresses leakage of ink through the liquid supply port 572 to outside before the liquid container 50 is mounted on the mounting assembly unit 30 (shown in FIG. 5). The film 99 is broken by the liquid introducing portion 362 (shown in FIG. 5) when the liquid container 50 is mounted on the mounting assembly unit 30.

As shown in FIG. 16A, a valve mechanism 551 is placed inside of the liquid supply portion 57 to open and close a liquid flow path formed by the liquid supply portion 57. The valve mechanism 551 includes a valve seat 552, a valve element 554 and a spring 556. The valve seat 552, the valve element 554 and the spring 556 are placed in the liquid supply portion 57 in this sequence from the liquid supply port 572 toward the supply connecting portion 573 of the liquid supply portion 57.

The valve seat 552 is an approximately circular member. The valve seat 552 is made of an elastic material such as rubber or elastomer. The valve seat 552 is pressed in the liquid supply portion 57. The valve element 554 is an approximately cylindrical member. The valve element 554 is placed to close a hole (valve hole) formed in the valve seat 552 in the state before the liquid container 50 is mounted on the mounting assembly unit 30. The spring 556 is a compression coil spring. The spring 556 is arranged to bias the valve element 554 in a direction toward the valve seat 552. In the mounting state of the liquid container 50, the liquid introducing portion 362 (shown in FIG. 5) presses the valve element 554 toward the supply connecting portion 573, so as to move the valve element 554 toward the supply connecting portion 573. This motion separates the valve element 554 from the valve seat 552 to set the valve mechanism 551 to the open position. At the open position of the valve mechanism 551, the ink contained in the liquid container body 52 (shown in FIG. 7) may flow out through the flow path member 70, an inner flow path 558 of the operation member 53 and the liquid supply portion 57 to outside.

As shown in FIG. 9, the positioning structure 56 serves to roughly position the liquid container 50 including the liquid supply port 572 relative to the printer 10 when the liquid container 50 is connected to the printer 10. The positioning structure 56 is provided integrally with the operation member 53. According to this embodiment, the positioning structure 56 is formed by integral molding with the operation member 53, so as to be provided integrally with the operation member 53. Herein "provided integrally" means that the positioning structure 56 is provided on the operation member 53 to move in conjunction with the motion of the operation member 53. According to another embodiment, the positioning structure 56 may be mounted to the operation member 53 by welding or the like, so as to be provided integrally with the operation member 53. The positioning structure 56 is provided near to the liquid supply port 572 such as to surround the circumference of the liquid supply port 572 except the top thereof. In the case where the operation member 53 is made of a material unlikely to be deformed, the positioning structure 56 may be provided at a position slightly away from the liquid supply port 572 in the operation member 53. The positioning structure 56 is protruded from the operation member 53 in the −K1-axis direction.

As shown in FIGS. 9 and 10, the positioning structure 56 is placed near to the liquid supply port 572. As shown in FIG. 13, at least part of the positioning structure 56 is provided on the liquid container body 52-side (shown in FIG. 7) (i.e., on the −Z-axis direction side) of the liquid supply port 572. According to this embodiment, the positioning structure 56 is placed in the periphery of the liquid supply portion 57 about the center axis CT. More specifically, the positioning structure 56 is placed around the periphery of the liquid supply portion 57 except the grip portion 54-side. The positioning structure 56 is placed inside of the supply assembly support portion 42 of the mounting assembly unit 30 (shown in FIG. 5) when the liquid container 50 is connected to the printer 10. A plurality of planes defining the supply assembly support portion 42 (for example, first support plane 402, second support plane 403 and third support plane 404 shown in FIG. 5) hit against the positioning structure 56, so as to limit the motion of the liquid supply portion 57 and roughly position the liquid container 50. The liquid supply port 572 is then connected with the liquid introducing portion 362 in the state that the liquid supply port 572 is positioned by projections 577 (577*a*, 577*b*, 577*c* and 577*d*) provided on the liquid supply portion 57 at positions on the upper side, on the lower side, on the left side and on the right side of the liquid supply port 572 and positioning projections 366 (366*a*, 366*b*, 366*c* and 366*d*) provided at positions on the upper side, on the lower side, on the left side and on the right side of the liquid introducing portion 362 as shown in FIGS. 5 and 6. More specifically, the liquid supply port 572 is connected with the liquid introducing portion 362 in the state that the liquid supply port 572 is positioned by the projections 577*a* to 577*d* as container-side positioning elements (shown in FIGS. 9 to 11). The projections 577*a* to 577*d* are provided around the outer periphery about the center axis CT on the liquid supply portion 57. The projections 577*a* to 577*d* are provided on the liquid supply portion 57 at the positions on the upper side, on the lower side, on the left side and on the right side of the liquid supply port 572. More specifically, as shown in FIG. 9, the first projection 577*a* is located on the upper side in the direction of gravity (+Z-axis direction side) of the liquid supply portion 57. The second projection 577*b* is located on the −K2-axis direction side of the liquid supply portion 57. As shown in FIG. 10, the third projection 577*c* is located on the +K2-axis direction side of the liquid supply portion 57. As shown in FIG. 11, the fourth projection 577*d* is located on the lower side in the direction of gravity (−Z-axis direction side) of the liquid supply portion 57. When there is no need to distinguish among the first to the fourth projections 577*a* to 577*d*, these projections are expressed by symbol "577".

The liquid supply unit 55 serves to supply the ink contained in the liquid container body 52 (shown in FIG. 7) to the printer 10. The liquid supply unit 55 is thus also regarded as "liquid supply assembly". The liquid supply unit 55 as the liquid supply assembly includes the liquid supply portion (liquid flow portion) 57 having the liquid supply port 572 at one end and the positioning structure 56.

As shown in FIGS. 9 and 10, the substrate unit (container-side electrical connection structure) 58 includes the circuit board 582 and the circuit board holding portion 59. The substrate unit 58 is provided to be protruded outward (in the −K1-axis direction) from the operation member 53. The protruding direction of the substrate unit 58 is identical with the protruding direction (−K1-axis direction) of the liquid supply portion 57. The protruding direction of the substrate unit 58 may not be necessarily identical with the protruding direction of the liquid supply portion 57 but may be substantially parallel (approximately parallel) to the protruding direction of the liquid supply portion 57. Herein "substantially" means that the parallelism may include a slight error. The substrate unit 58 and the liquid supply portion 57 are protruded from the operation member 53 toward the same direction (toward the −K1-axis direction side) relative to the operation member 53.

As shown in FIG. 15, the substrate unit 58 is arrayed with the liquid supply unit 55 in a direction perpendicular to the grip surface 541. More specifically, the substrate unit 58 and the liquid supply unit 55 are arrayed in the K2-axis direction that is parallel to the grip surface 541 and is orthogonal to the center axis CT.

As shown in FIG. 9, the circuit board holding portion 59 serves to position the circuit board 582 relative to the printer 10 when the liquid container 50 is connected to the printer 10. The circuit board holding portion 59 is provided integrally with the operation member 53. According to this embodiment, the circuit board holding portion 59 is formed by integral molding with the operation member 53, so as to be provided integrally with the operation member 53. Herein "provided integrally" means that the circuit board holding portion 59 is provided on the operation member 53 to move in conjunction with the motion of the operation member 53. According to another embodiment, the circuit board holding portion 59 may be mounted to the operation member 53 by welding or the like, so as to be provided integrally with the operation member 53.

The circuit board holding portion 59 is formed in a concave shape open toward the +Z-axis direction side (side where the grip portion 54 is located). A bottom section 594 of the concave shape is inclined to the grip surface 541 (shown in FIG. 11). The circuit board 582 is mounted to the bottom section 594, such as to be held on the circuit board holding portion 59 in an inclined orientation as described above. At least part (bottom section 594) of the circuit board holding portion 59 is provided on the liquid container body 52-side (shown in FIG. 7) (i.e., −Z-axis direction side) of the circuit board 582 (contact portion cp). In other words, at least part (bottom section 594) of the substrate unit (container-side electrical connection structure) 58 that is different from the contact portion cp (shown in FIG. 17B) is provided on the liquid container body 52-side of the contact portion cp.

The circuit board holding portion 59 has a first side wall section 592 and a second side wall section 593 that are extended in the +Z-axis direction from the respective sides of the bottom section 594 in the K2-axis direction. As shown in FIG. 10, the first side wall section 592 has a groove 592*t*. As shown in FIG. 9, the second side wall section 593 has a groove 593*t*. When the liquid container 50 is connected to the printer 10, the circuit board holding portion 59 is first supported by the substrate support portion 48 (shown in FIG. 5). This roughly positions the circuit board holding portion 59 and the circuit board 582 relative to the device-side terminals 381 (shown in FIG. 5). By moving the movable member 40 of the mounting assembly unit 30 shown in FIG. 5 in the −K1-axis direction, the device-side substrate positioning structure 385 shown in FIG. 6 is fit in the groove 593*t* of the circuit board holding portion 59 (shown in FIG. 9), while the device-side substrate positioning structure 384 shown in FIG. 6 is fit in the groove 592*t* of the circuit board holding portion 59 (shown in FIG. 10). This positions the circuit board holding portion 59 and the circuit board 582 relative to the device-side terminals 381.

As shown in FIG. 13, the circuit board 582 has a plurality of terminals 581 provided on the surface thereof. According to this embodiment, nine terminals 581 are arrayed corresponding to the number of (nine) device-side terminals 381. According to this embodiment, the terminal 581 is formed in an approximately rectangular outer shape. A storage unit 583 (shown in FIG. 16C) is placed on the rear face of the circuit board 582. The storage unit 583 stores information with regard to the liquid container 50 (for example, the color of ink and the remaining amount of ink). The storage unit 583 is electrically connected with the plurality of terminals 581. In the mounting state, each of the plurality of terminals 581 is electrically connected with each corresponding device-side terminal 381 of the electrical connection structure 382 (shown in FIG. 6) of the printer 10.

As shown in FIG. 16B, a boss groove 584 is formed at an upper end 586 on the +Z-axis direction side of the circuit board 582, and a boss hole 585 is formed at a lower end 587 on the −Z-axis direction side of the circuit board 582. The circuit board 582 is fixed to the bottom section (placement element) 594 by means of the boss groove 584 and the boss hole 585.

As shown in FIGS. 16B and 16C, the circuit board 582 has a liquid container-side terminal group 580 provided on a surface 582*fa* and the storage unit 583 provided on a rear face 582*fb*. The surface 582*fa* and the rear face 582*fb* are planes.

The liquid container-side terminal group 580 includes nine terminals 581A to 581I. The storage unit 583 stores information with regard to the liquid container 50 (for example, the remaining amount of ink and the color of ink).

As shown in FIG. 16B, the nine liquid container-side terminals 581A to 581I are respectively formed in approximately rectangular shape and are arranged to form two lines Ln1 and Ln2 at different positions in the Z-axis direction. The lines Ln1 and Ln2 are parallel to the K2-axis direction.

Each of the liquid container-side terminals 581A to 581I has a contact portion cp on its center to come into contact with each corresponding device-side terminal 381. The above lines Ln1 and Ln2 may thus be regarded as lines formed by a plurality of contact portions cp. When there is no need to distinguish the nine liquid container-side terminals 581A to 581I from one another, the liquid container-side terminals are expressed by symbol "581".

As described above, the container-side electrical connection structure 58 has the contact portions cp to come into contact with the device-side electrical connection structure 382. The container-side electrical connection structure 58 is provided integrally with the operation member 53 as shown in FIG. 9.

As shown in FIG. 15, the grip surface 541 is placed on a side in the direction (+Z-axis direction) perpendicular to the center axis CT direction of the liquid supply portion 57. The substrate unit 58 as the container-side electrical connection structure is provided to be offset in the center axis CT direction relative to the operation member 53 including the grip surface 541. In other words, when the liquid container 50 is viewed from the direction (+Z-axis direction) that is orthogonal to the grip surface 541 and goes from the liquid supply portion 57 toward the grip surface 541, the substrate unit 58 is located at a non-overlapping position with the grip surface 541 (operation member 53). In other words, when the liquid container 50 is projected onto a plane perpendicular to the grip surface 541, the grip surface 541 and the substrate unit 58 have a non-overlapping positional relationship. In this configuration, there is a need that at least the circuit board 582 of the substrate unit 58 is located at a non-overlapping position with the grip surface 41 (operation member 53).

As shown in FIGS. 9 and 12, a −K1-axis direction side of the operation member 53 is specified as first side 53*fa*, and a +K1-axis direction side of the operation member 53 that is opposite to the first side 53*fa* is specified as second side 53*fb*. As shown in FIG. 9, the substrate unit 58 including the circuit board holding portion 59 and the positioning structure 56 are provided on the same first side 53*fa*.

As shown in FIGS. 12 and 15, the pressing portion 545 is provided on the second side 53*fb* that is opposite to the liquid supply unit (liquid supply assembly) 55 including the positioning structure 56 and the substrate unit (container-side electrical connection structure) 58 including the circuit board holding portion 59 across the operation member 53. As shown in FIG. 11, the positioning structure 56 and the circuit board holding portion 59 are provided on the surface of the base portion 548 on the first side 53*fa*. As shown in FIG. 12, the pressing portion 545 is provided on the surface of the base portion 548 on the second side 53*fb*. As shown in FIGS. 15 and 16, at least part of the pressing portion 545 is arranged opposite to the positioning structure 56 and the circuit board holding portion 59 across the operation member 53.

The pressing portion 545 is a part pressed by the user when the liquid container 50 is connected to the printer 10. In other words, the pressing portion 545 is a manually pressed part. The pressing portion 545 is pressed in the −K1-axis direction (connecting direction), so as to move the movable member 40 in which the liquid container 50 is set (shown in FIG. 6) in the −K1-axis direction.

The pressing portion 545 is provided to be protruded outward (in the +K1-axis direction) from the operation member 53. This makes the pressing portion 545 easily distinguishable from the other part and readily urges the user to press the pressing portion 545 in order to connect the liquid container 50 to the printer 10. As shown in FIG. 14, when the operation member 53 is viewed in a direction along the K1-axis direction, part of the outer shape of the pressing portion 545 is protruded outward from the base portion 548. This increases the surface area of the pressing portion 545 and facilitates the user to press the pressing portion 545.

The operation member 53, the circuit board holding portion 59, the positioning structure 56, the liquid supply portion 57 and the pressing portion 545 may be made of an identical material or may be made of different materials according to the application. The material employed for the operation member 53 may be, for example, a synthetic resin such as polyethylene (PE), polypropylene (PP) or ABS resin.

Figure 17A:
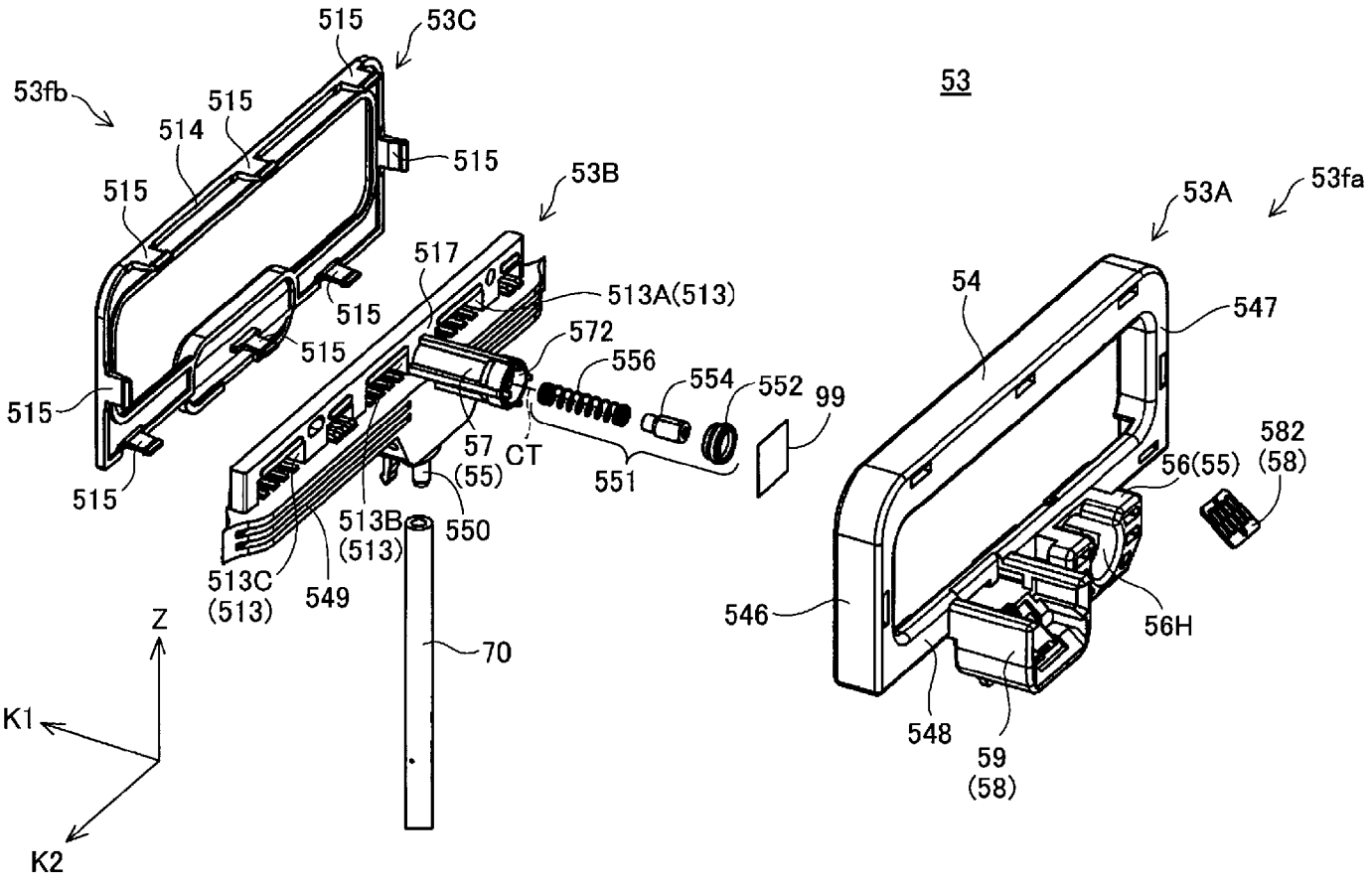
FIG. 17A is a first exploded perspective view illustrating an operation member.
Figure 17B:
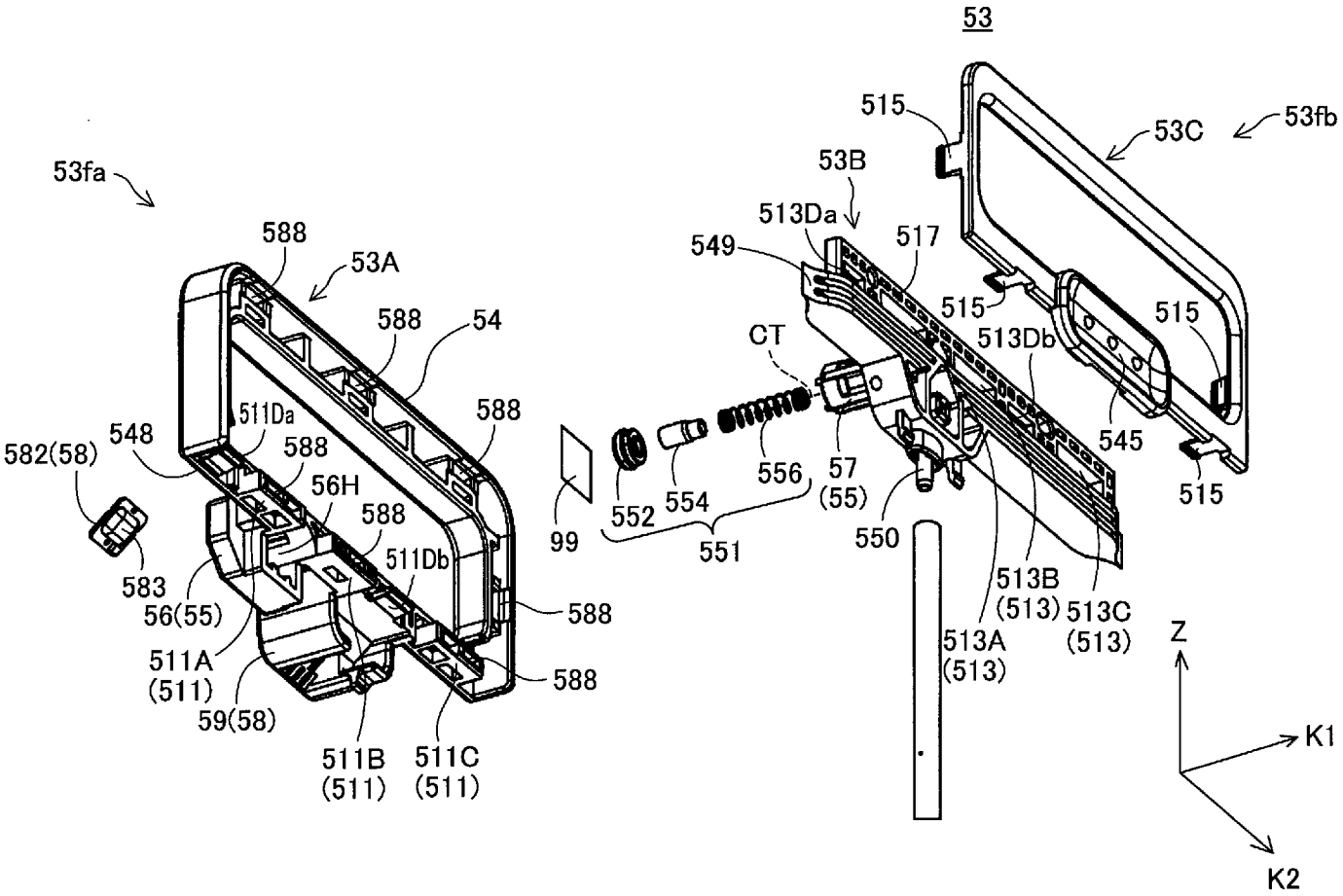
FIG. 17B is a second exploded perspective view illustrating the operation member.
Figure 17C:
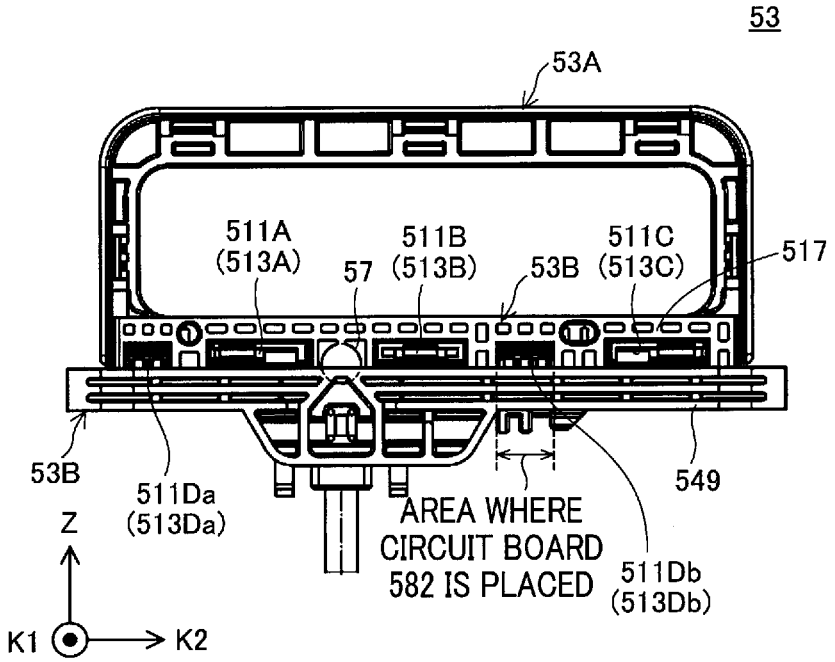
FIG. 17C is a rear view illustrating the operation member.
Figure 17D:
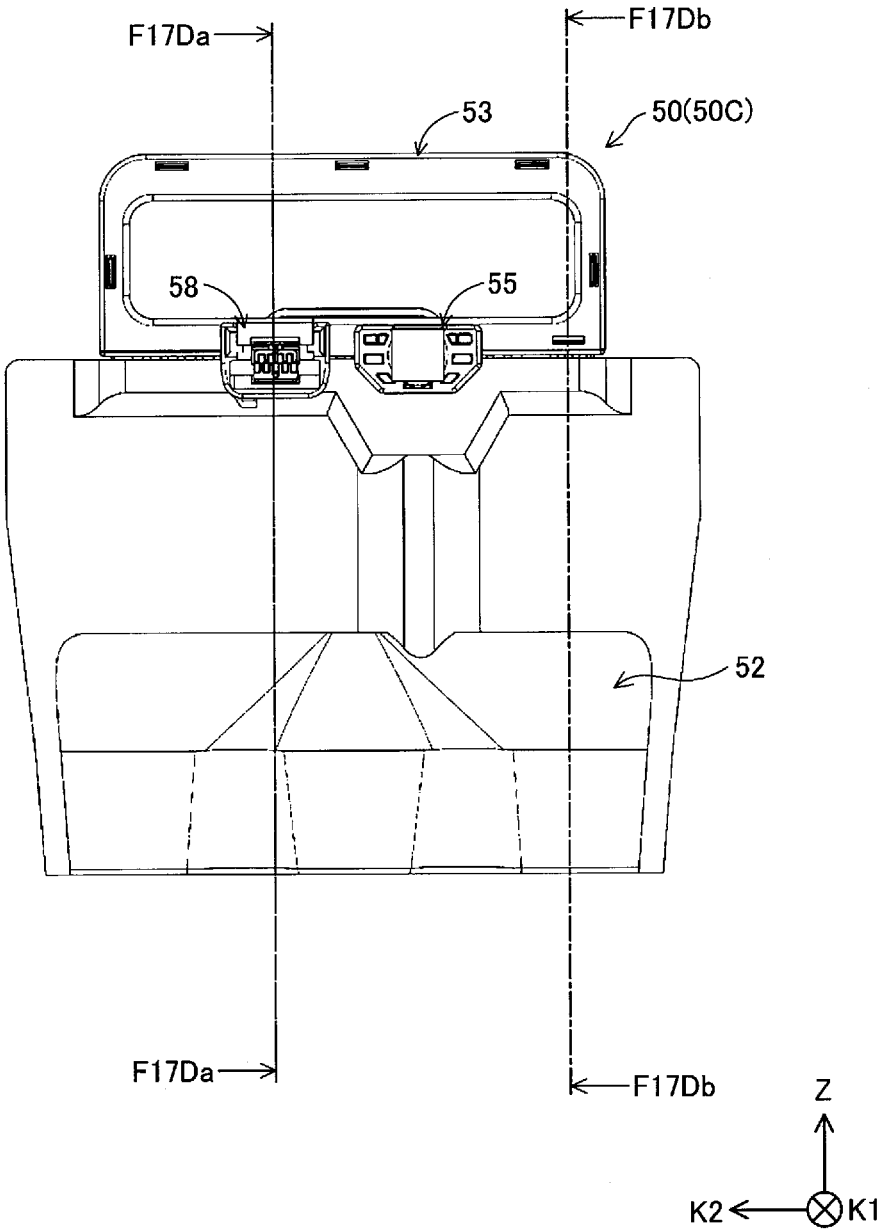
FIG. 17D is a front view illustrating the liquid container.
Figure 17E:
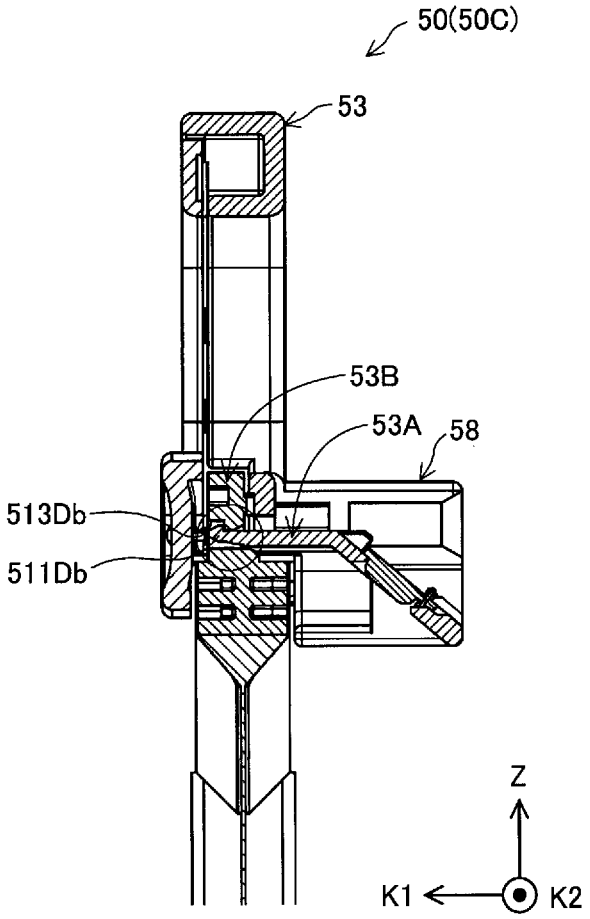
FIG. 17E is an F17Da-F17Da partial sectional view of FIG. 17D.
Figure 17F:
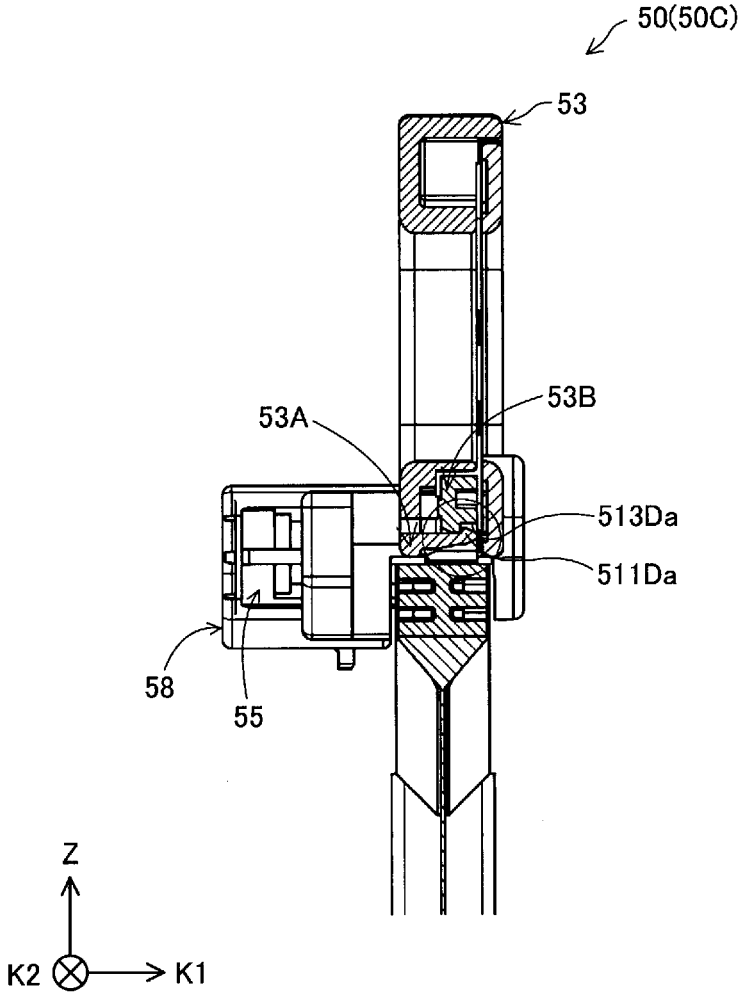
FIG. 17F is an F17Db-F17Db partial sectional view of FIG. 17D.

FIG. 17A is a first exploded perspective view illustrating the operation member 53. FIG. 17B is a second exploded perspective view illustrating the operation member 53. FIG. 17C is a rear view illustrating the operation member 53. FIG. 17D is a front view illustrating the liquid container 50. FIG. 17E is an F17Da-F17Da partial sectional view of FIG. 17D. FIG. 17F is an F17Db-F17Db partial sectional view of FIG. 17D. The flow path member 70 is also illustrated in FIGS. 17A to 17C, in order to facilitate understanding. FIG. 17C illustrates the state that a third member (pressing member) 53C described below is demounted.

As shown in FIGS. 17A and 17B, the operation member (coupling member, handle member) 53 includes a first member 53A, a second member 53B and a third member 53C. The first member 53A to the third member 53C are assembled to form the operation member 53. More specifically, the respective members 53A to 53C assembled such that the second member 53B is placed between the first member 53A and the third member 53C. The first member 53A to the third member 53C are respectively formed by integral molding a material such as a synthetic resin.

The first member 53A includes the grip portion 54. The first member 53A is formed in a frame-like shape. The first member 53A is a plate-like member along a plane perpendicular to the K1-axis direction (center axis CT direction). The positioning structure 56 and the circuit board holding portion 59 are connected by integral molding with the coupling portion 548 (more specifically, the first side 53*fa* of the coupling portion 548) of the first member 53A. As clearly understood from the foregoing, the first member 53A of the operation member 53 may be regarded as "coupling member 53A" or "handle member 53A".

As shown in FIG. 17B, the first member 53A has three engagement elements 511A, 511B and 511C provided on the second side 53*fb* to engage with the second member 53B and thereby couple (connect) the first member 53A with the second member 53B. The three engagement elements 511A, 511B and 511C are arrayed along the K2-axis direction (direction in which the positioning structure 56 and the circuit board holding portion 59 are arrayed). The number of the engagement elements 511A, 511B and 511C may be decreased to two or less or may be increased to four or more. When there is no need to distinguish among the three engagement elements 511A, 511B and 511C, the engagement elements are expressed by symbol "511".

The engagement elements 511 are provided on the base portion 548 on the second side 53*fb* of the first member 53A. The engagement element 511 is formed in an approximately rectangular parallelepiped shape. More specifically, the outer shape of the engagement element 511 is an approximately rectangular shape to surround a direction along the K1-axis direction (along the center axis CT direction of the liquid flow portion 57) (i.e., K1-axis direction). The engagement element 511 is a convex protruded from the base portion 548 toward the second member 53B (+K1-axis direction).

As shown in FIG. 17B, the first member 53A also has eight member engaging elements 588 (only seven are illustrated) provided on the second side 53*fb* to engage with the third member (pressing member) 53C and thereby couple (connect) the first member 53A with the third member 53C. The member engaging elements 588 are formed in concave shape.

As shown in FIGS. 17A and 17B, the liquid supply portion 57 is connected with the second member 53B by integral molding. The mounting portion (joint portion) 549 is also coupled (connected) with the second member 53 by integral molding.

The second member 53B also has three engagement elements 513A, 513B and 513C provided to engage with the engagement elements 511 and thereby mount the first member 53A to the second member 53B. When there is no need to distinguish among the three engagement elements 513A, 513B and 513C, the engagement elements are expressed by symbol "513". The number of the engagement elements 513 may be two or less or may be four or more.

The three engagement elements 513A, 513B and 513C are provided corresponding to the three engagement elements 513A, 513B and 513C of the first member 53A. The engagement element 513 is a through hole that passes through in the K1-axis direction. The engagement element 513 is formed in an outer shape that allows the engagement element 511 to be fit in. The outer shape of the engagement element 513 is an approximately rectangular shape to surround a direction along the K1-axis direction (along the center axis CT direction of the liquid flow portion 57) (i.e., K1-axis direction).

As shown in FIG. 17C, the engagement elements 511A, 511B and 511C as the convexes are fit in the corresponding engagement elements 513A, 513B and 513C as the through holes, so that the second member 53B is mounted to the first member 53A. Accordingly, a portion 517 provided with the engagement elements 513 is also called "protruded portion 517" that is protruded from the joint portion 549 to outside of the liquid container body 52 (shown in FIG. 7). The engagement elements 511 of the coupling member 53A are engaged with the engagement elements 513 of the protruded portion 517, so that the coupling member 53A is coupled with the joint portion 549.

The three engagement elements 511A, 511B and 511C of the handle member 53A are engaged with the second member 53B to which the liquid container boy 52 is mounted and thereby have the following functions. When the user grips the handle member 53A to hold the liquid container 50, the three engagement elements 511A, 511B and 511C serve as portions that receive a load produced by the dead weight of the liquid container body 52. Accordingly the three engagement elements 511A, 511B and 511C are also called support elements 511A, 511B and 511C.

The handle member 53A is assembled to the second member 53B and is thereby connected with the liquid supply portion 57. Herein the term "connect" includes not only a configuration that the handle member 53A and the liquid supply portion 57 are connected directly with each other but a configuration that the handle member 53A and the liquid supply portion 57 are connected indirectly via another member.

Engagement of the engagement element 511B with the engagement element 513B restricts the motion of the second member 53B relative to the coupling member 53A in the K2-axis direction and in the Z-axis direction. Engagement of the engagement element 511A with the engagement element 513A and engagement of the engagement element 511C with the engagement element 513C restrict the motion of the second member 53B relative to the coupling member 53A in the Z-axis direction. In other words, the engagement elements 511 and the engagement elements 513 respectively have the outer shapes that surround the direction along the center axis CT direction (K1-axis direction) (i.e., K1-axis direction), so as to suppress the positional misalignment between the coupling member 53A and the second member 53B in a planar direction orthogonal to the center axis CT direction (i.e., planar direction defined by the Z-axis direction and the K2-axis direction).

As shown in FIG. 17B, the coupling member 53A additionally has engaging claws 511Da and 511Db in convex shape. The engaging claws 511Da and 511Db are provided on the second side 53*fb* of the coupling portion 548. The second member 53B has through holes 513Da and 513Db at positions corresponding to the engaging claws 511Da and 511Db in convex shape.

As shown in FIGS. 17E and 17F, the engaging claws 511Da and 511Db are engaged with the member that forms the through holes 513Da and 513Db. This restricts the motion of the second member 53B relative to the coupling member 53A in the +K1-axis direction. Part of the second member 53 hits against part of the coupling member 53A. This restricts the motion of the second member 53B relative to the coupling member 53A in the −K1-axis direction.

As described above, the engagement elements 511 of the coupling member 53A are engaged with the engagement elements 513 of the second member 53B, so that these members 53A and 53B are positioned relative to each other. The circuit board holding portion 59 is connected or joined with the coupling member 53A, while the liquid supply portion 57 connected with the printer 10 is connected or joined with the second member 53B. Accordingly, the positional relationship between the liquid supply portion 57 and the circuit board holding portion 59 is determined by engagement of the engagement elements 511 of the coupling member 53A with the engagement elements 513 of the second member. The engagement elements 511 are thus also called "member positioning elements 511".

As shown in FIG. 17C, the engagement element 511A and the engagement element 511B are located at positions across the liquid supply portion 57 in the longitudinal direction of the joint portion 549 (K2-axis direction). The engagement element 511A and the engagement element 511C are also located at positions across the liquid supply portion 57 in the longitudinal direction (K2-axis direction). The engagement element 511B and the engagement element 511C are located across the circuit board 582 in the longitudinal direction (K2-axis direction). The engagement element 511A and the engagement element 511C are also located at positions across the circuit board 582 in the longitudinal direction (+K2-axis direction).

As shown in FIG. 17B, the third member 53C includes the pressing portion 545. The third member 53C is formed in a frame-like shape corresponding to the shape of the first member 53A. The third member 53C is a plate-like member along a plane perpendicular to the K1-axis direction (center axis CT direction). The third member 53C has eight engagement elements 515 provided on the first side 53*fa*. The number of the engagement elements 515 is not limited to this number. The engagement elements 515 are engaged with the member engaging elements 588 shown in FIG. 17B, so that the first member 53A and the third member 53C are coupled with each other.

The coupling member 53A (handle member 53A), the second member 53B and the third member 53C are respectively provided as separate members. According to this embodiment, the handle member 53A, the second member 53B and the third member 53C are made of different materials. It is preferable that at least the handle member 53A and the second member 53B are made of different materials.

The handle member 53A is made of a material having excellent deformation resistance or excellent creep resistance. The handle member 53A has sufficient deformation resistance or sufficient creep resistance and is thus unlikely to be deformed when the handle member 53A is gripped by the user to receive the load produced by the dead weight of the liquid container body 52. The handle member 53A is made of a material having more excellent (higher) deformation resistance than the second member 53B or the third member 53C. The handle member 53A is preferably made of a material having more excellent (higher) creep resistance than the second member 53B and the third member 53C. The handle member 53A is made of a material such as ABS resin, heat-resistant ABS resin having the enhanced heat resistance than standard ABS resin or polystyrene (PS). According to this embodiment, the handle member 53A is made of ABS resin. The heat-resistant ABS resin may be a material having the temperature of deflection of not lower than 120° C. under load of 1.82 MPa. At least part of the handle member 53A connecting with the liquid supply portion 57 may be made of a material having excellent deformation resistance or excellent creep resistance.

The deformation resistance may be evaluated by using the bending elastic modulus as the indication. The "material having excellent deformation resistance" is preferably a material having the bending elastic modulus according to, for example, JIS K 7171 of not lower than 1800 MPa, is more preferably a material having the bending elastic modulus of not lower than 2000 MPa and is furthermore preferably a material having the bending elastic modulus of not lower than 2500 MPa. The "material having excellent deformation resistance" may be a material having a higher bending elastic modulus according to JIS K 7171.

The creep resistance may be evaluated by using the amount of deformation (warpage) as the indication when a specified load (for example, 2.8 MPa) is continuously applied to a member made of a specified material. The "material having excellent creep resistance" is preferably a material having the less amount of deformation than polyethylene when a member of a predetermined shape is formed from the material.

The second member 53B is made of a material having resistance to ink contained in the liquid container body 52. The second member 53B is made of a material such as polyethylene (PE), polypropylene (PP) or polyacetal (POM).

The state "having resistance to a liquid" means the state "having chemical resistance". The "material having resistance to a liquid" means a material (or member made of material) that does not react with a liquid when the material is soaked in the liquid. In other words, the "material having resistance to a liquid" means a material (or member made of material) that does not produce impurities such as solid substances in the liquid at or above a certain level when the material is soaked in the liquid. The "material having resistance to a liquid" may be evaluated as described below. A member made of a material that is to be evaluated (second member 53B according to this embodiment) is soaked in the ink contained in the liquid container body 52 and is subsequently left in a high temperature environment (for example, at 80° C.) for a predetermined time duration (for example, 48 hours). After being left for the predetermined time duration, the second member 53B is observed with regard to the following viewpoints:

(i) the presence or the absence of any solid substance in the ink;

(ii) a variation in mass before and after the second member 53B is soaked in the ink; and (iii) whether a change in appearance shape is within ±5% before and after the second member 53B is soaked in the ink.

With regard to the above viewpoints (i) to (iii), the material in the state that substantially no solid substance is present in the ink, the mass is not significantly varied (within ±5%) and the appearance shape is not significantly changed is evaluated as the "material having resistance to the liquid". At least part of the second member 53B that is in contact with the ink (i.e., inner surface of the liquid supply portion 57) may be made of the material having resistance to ink.

As shown in FIGS. 17A and 17B, the third member 53C is made of a material such as polyethylene (PE), polypropylene (PP) or polyacetal (POM). The pressing portion 545 provided on the third member 53C is located on the opposite side to the liquid supply portion 57 across the handle member 53A. The third member 53C is colored with the color of ink contained in the liquid container body 52. For example, with regard to the liquid container 50Y containing yellow ink, the third member 53C is colored with yellow. Herein "colored with the color of ink" includes colored with a similar color to the color of ink. The "similar color" may be any color in an identifiable range of the color of the contained ink when the user visually recognizes the third member 53C. The "similar color" means, for example, colors having the hue differences of 0 (zero) to 3 in the 20 color wheel (also called modified Munsell color wheel) employed in JIS standards (JIS Z 8102) as described above.

As described above, the third member 53C serves as an identification part colored with the color of ink contained in the liquid container body 52 (contained ink). The identification part (colored part) may not be necessarily the entire third member 53C but may be part of the third member 53C visible from outside. For example, at least part of the pressing portion 545 on the third member 53C may serve as the identification part.

In order to allow the user to identify the color of the contained ink, the third member 53C may be colored with the same color as the color of ink. This is, however, not restrictive. The requirement is that the third member 53C has an appearance that allows for identification of the color of the contained ink. For example, the color of ink may be displaced as character information on the surface of the pressing portion 545.

The connecting member 40 (shown in FIG. 5) is also identifiable by the color of the contained ink. The third member 53C may thus be regarded to have a colored part that is colored with the same color as the color of the connecting member 40 to be connected. According to this embodiment, the colored part is the entire third member 53C. The color part may, however, be part of the third member (for example, at least part of the pressing portion 545).

Figure 17G:
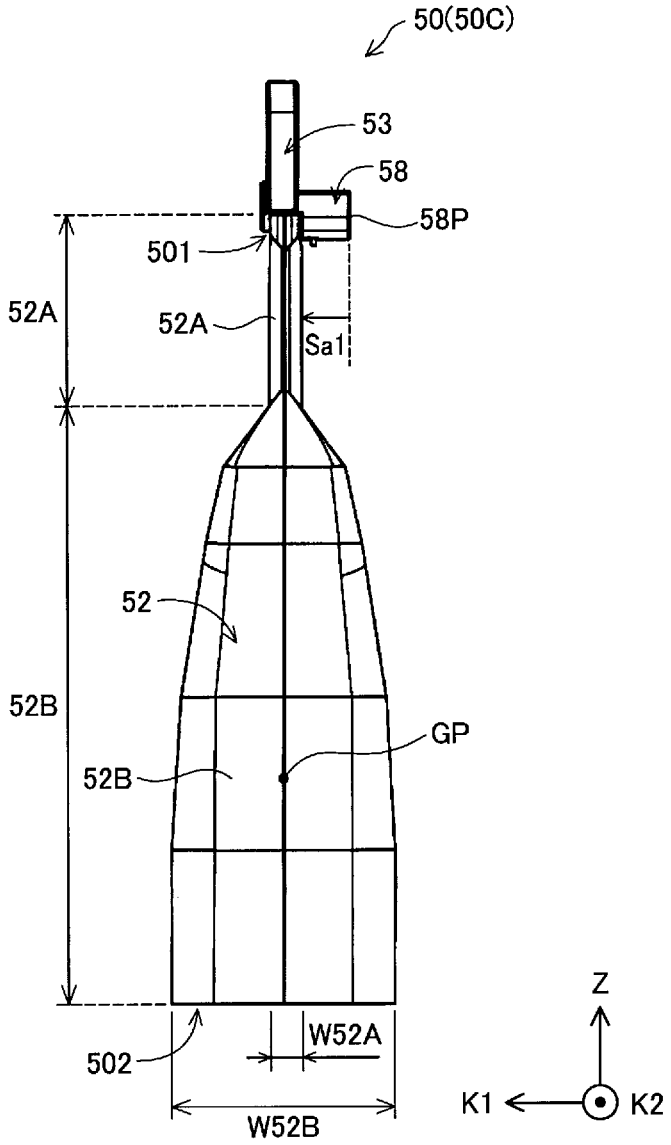
FIG. 17G is a left side view illustrating the liquid container.
Figure 17H:
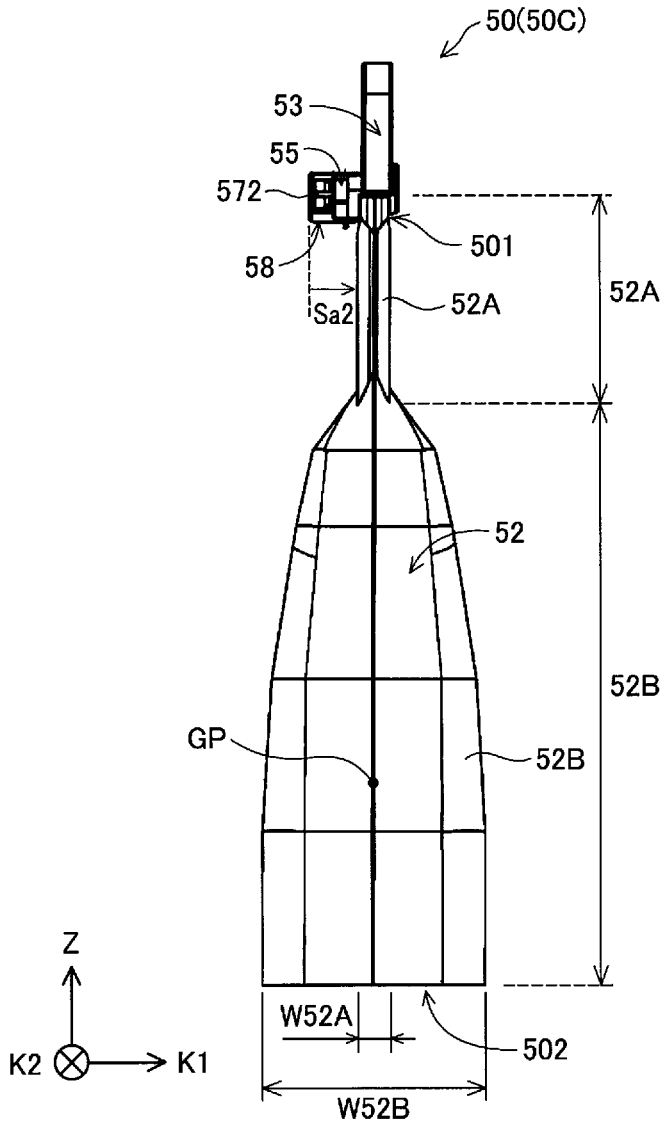
FIG. 17H is a right side view illustrating the liquid container.

FIG. 17G is a left side view illustrating the liquid container 50. FIG. 17H is a right side view illustrating the liquid container 50. The following further describes the liquid container 50 with reference to FIGS. 17G and 17H. The state of the liquid container 50 shown in FIGS. 17G and 17H is the initial state that the liquid container body 52 is filled with ink prior to consumption of ink by the printer 10. FIGS. 17G and 17H illustrate the state that the user grips the handle member 53 such that the liquid container body 52 is hung by its dead weight below the handle member 53 in the direction of gravity (Z-axis direction). In other words, FIGS. 17G and 17H illustrate the state that the liquid container body 52 is located on the lower side of the liquid supply assembly 55 and the container-side electrical connection structure 58 in the direction of gravity (Z-axis direction). FIGS. 17G and 17H also illustrate the connecting state that the liquid container 50 is connected to the printer 10.

The liquid container body 52 includes a first chamber 52A and a second chamber 52B. The first chamber 52A includes one end portion 501 of the liquid container body 52, and the second chamber 52B includes the other end portion 502 of the liquid container body 52. The first chamber 52A is connected with the handle member 53 via the joint portion 549 (shown in FIG. 7). The second chamber 52B is located on the lower side of the first chamber 52A in the direction of gravity (Z-axis direction). The first chamber 52A has a length W52A in the K1-axis direction (first direction, direction along the connecting direction), and the second chamber 52B has a length W52B in the K1-axis direction (first direction, connecting direction). The liquid container body 52 is filled with such an amount of ink that makes the length W52B greater than the length W52A. According to this embodiment, when the maximum amount of ink filled in the liquid container body 52 is 100%, the first chamber 52A and the second chamber 52B are formed by filling the liquid container body 52 with the amount of ink between 50% and 80% inclusive. The "maximum amount of ink filled in the liquid container body 52" denotes an amount of ink that damages (ruptures) the liquid container body 52 when any more ink is additionally filled.

As shown in FIG. 17G, one end (front end) 58P of the container-side electrical connection structure 58 is located on the −K1-axis direction (connecting direction) side of the first chamber 52A by a predetermined value Sa1. As shown in FIG. 17H, the liquid supply port 572 at one end of the liquid supply assembly 55 is located on the −K1-axis direction (connecting direction) side of the first chamber 52A by a predetermined value Sat. The liquid container body 52 has the center of gravity GP placed in the second chamber 52B.

A-4. Method of Mounting Liquid Container 50 to Mounting Assembly Unit 30

Figure 18:
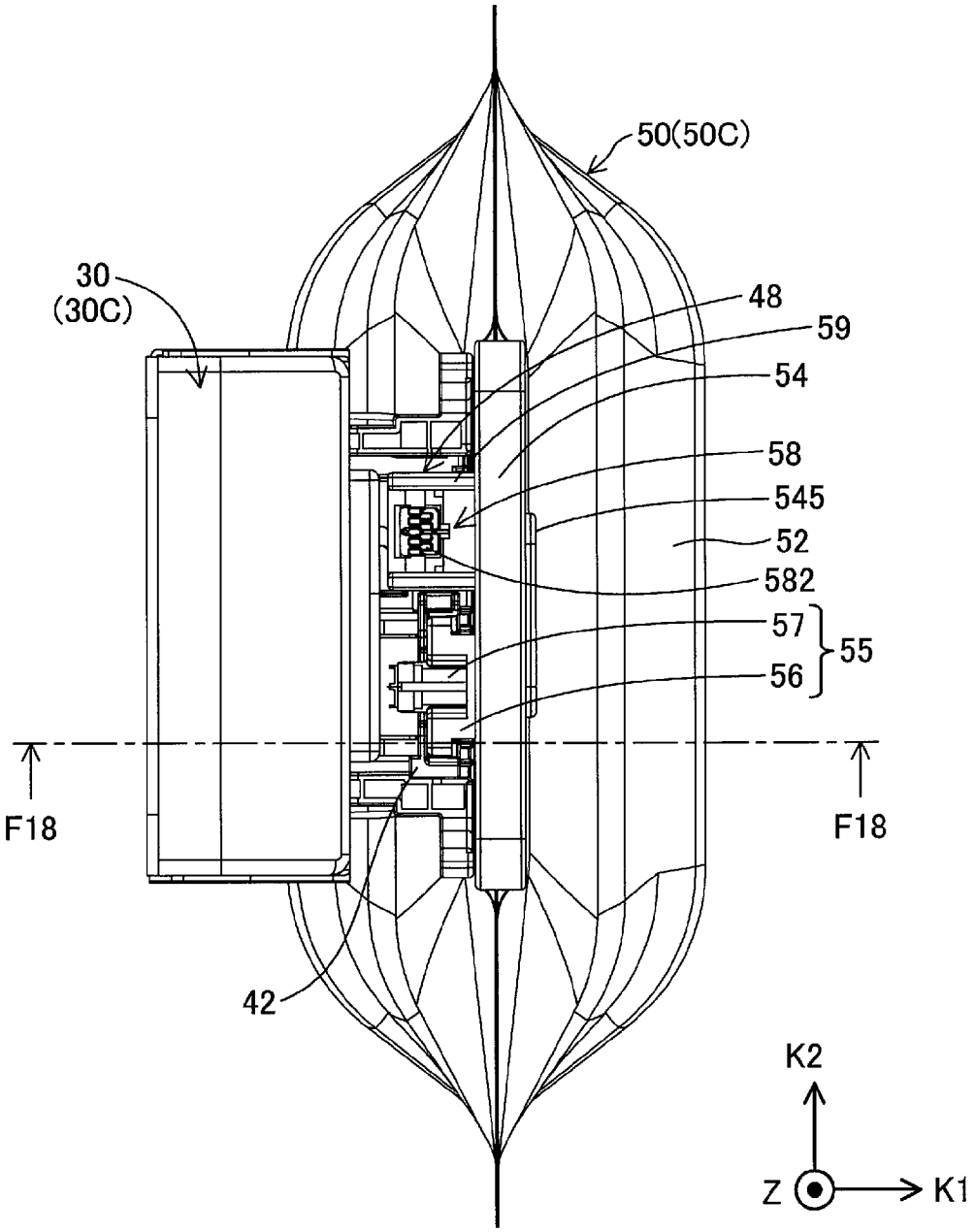
FIG. 18 is a diagram illustrating the state that the liquid container is set in the mounting assembly unit.
Figure 19:
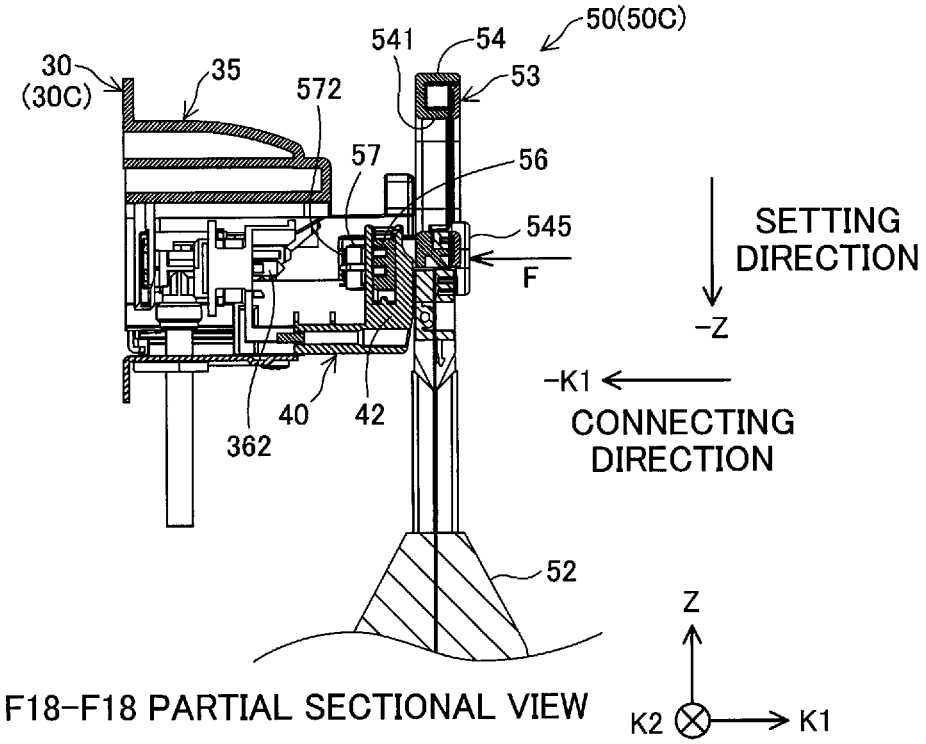
FIG. 19 is an F18-F18 partial sectional view of FIG. 18.
Figure 20:
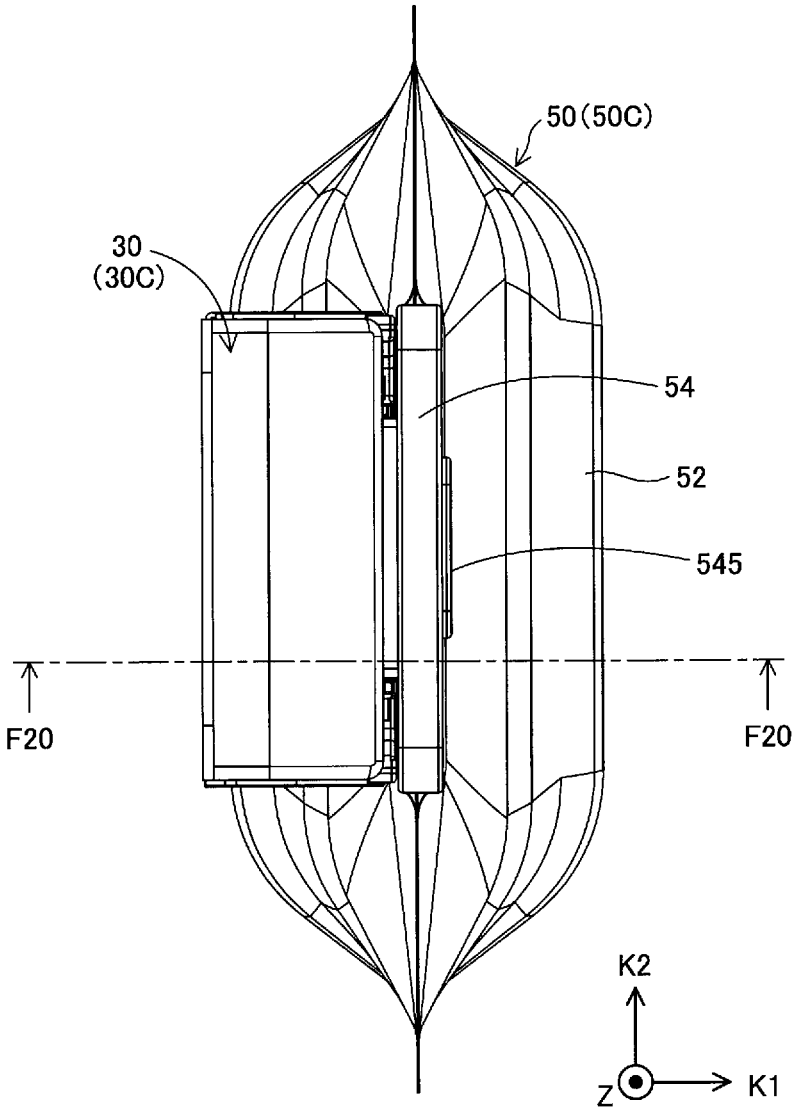
FIG. 20 is a diagram illustrating the state that the liquid container is mounted on the mounting assembly unit.
Figure 21:
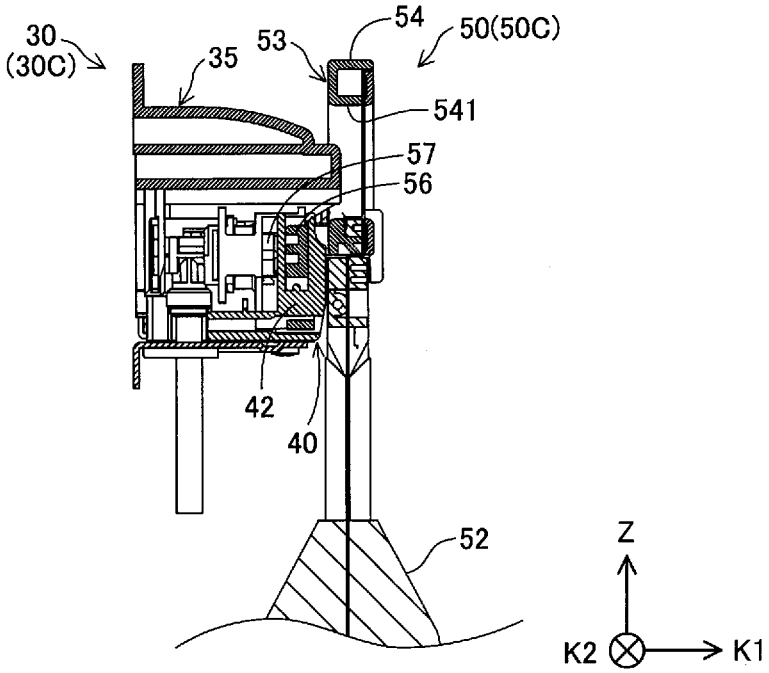
FIG. 21 is an F20-F20 partial sectional view of FIG. 20.

FIG. 18 is a diagram illustrating the state that the liquid container 50 is set in the mounting assembly unit 30. FIG. 19 is an F18-F18 partial sectional view of FIG. 18. FIG. 20 is a diagram illustrating the state that the liquid container 50 is mounted on the mounting assembly unit 30. FIG. 21 is an F20-F20 partial sectional view of FIG. 20. The state of the mounting assembly unit 30 shown in FIGS. 18 and 19 is the first state like FIG. 5. The state of the mounting assembly unit 30 shown in FIGS. 20 and 21 is the second state like FIG. 2.

As shown in FIG. 19, two operations, i.e., an operation of moving the liquid container 50 in a setting direction (setting operation or first operation) and an operation of moving the liquid container 50 in a connecting direction (connecting operation or second operation) are performed in the process of mounting the liquid container 50 to the mounting assembly unit 30. The setting direction is a direction including a vertically downward direction (−Z-axis direction) component. According to this embodiment, the setting direction is vertically downward direction. The connecting direction is a direction including a horizontal direction (first direction, K1-axis direction) component. According to this embodiment, the connecting direction is the −K1-axis direction that is the horizontal direction.

The user sets the liquid container 50 in the movable member 40 of the mounting assembly unit 30 that is in the first state. More specifically, the user grips the grip portion 54 in the state that the operation member 53 is located vertically on the upper side of the liquid container body 52. As shown in FIGS. 18 and 19, the positioning structure 56 of the liquid container 50 is located in the supply assembly support portion 42, and the circuit board holding portion 59 is located in the substrate support portion 48.

After the liquid container 50 is set in the movable member 40, the user presses the pressing portion 545 in the −K1-axis direction as shown by an arrow F in FIG. 19. This moves the liquid container 50 and the movable member 40 in the connecting direction (−K1-axis direction).

As shown in FIG. 21, in the second state of the mounting assembly unit 30 that the movable member 40 is placed in the stationary member 35, the liquid introducing portion 362 (shown in FIG. 19) is inserted in (connected with) the liquid supply portion 57. In the second state, the terminals 581 of the circuit board 582 (shown in FIG. 13) come into contact with the device-side terminals 381 of the electrical connection structure 382 (shown in FIG. 6), so that the circuit board 582 and the electrical connection structure 382 are electrically connected with each other.

As described above, "when the liquid container 50 is connected to the mounting assembly unit 30 (printer 10)" denotes at least part of a time duration from the time when the user grips the handle member 53 and starts the setting operation to the time when connection of the liquid container 50 to the printer 10 is completed by the connecting operation. According to this embodiment, part of the time duration means a time duration between the time when the liquid container 50 is set in the movable member 40 and is moved to some extent in the connecting direction and the time when the connection is completed.

A-5. Relationship between Printer 10 and Liquid Container 50

Figure 22:
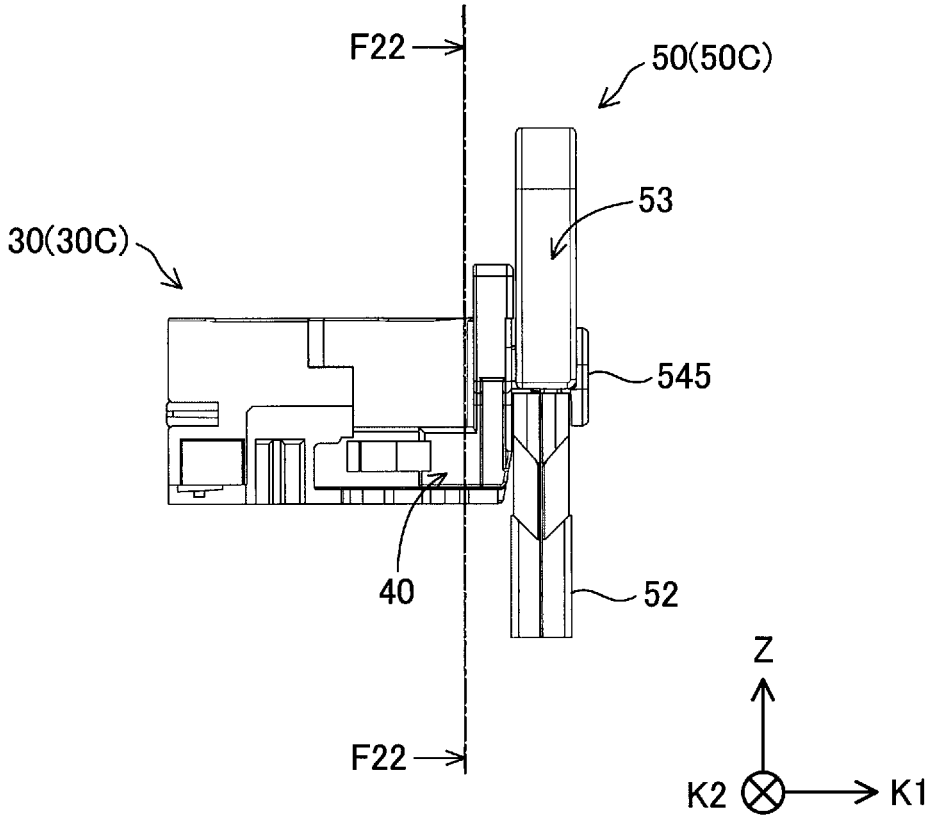
FIG. 22 is a side view illustrating the state that the liquid container is set in a movable member.
Figure 23:
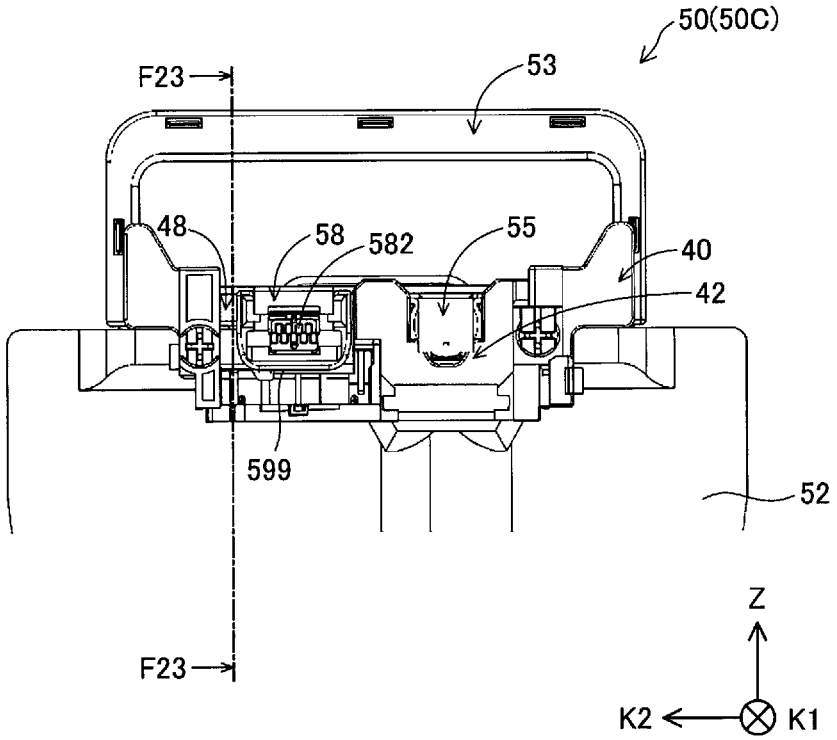
FIG. 23 is a front view illustrating the state that the liquid container is set in the movable member.
Figure 24:
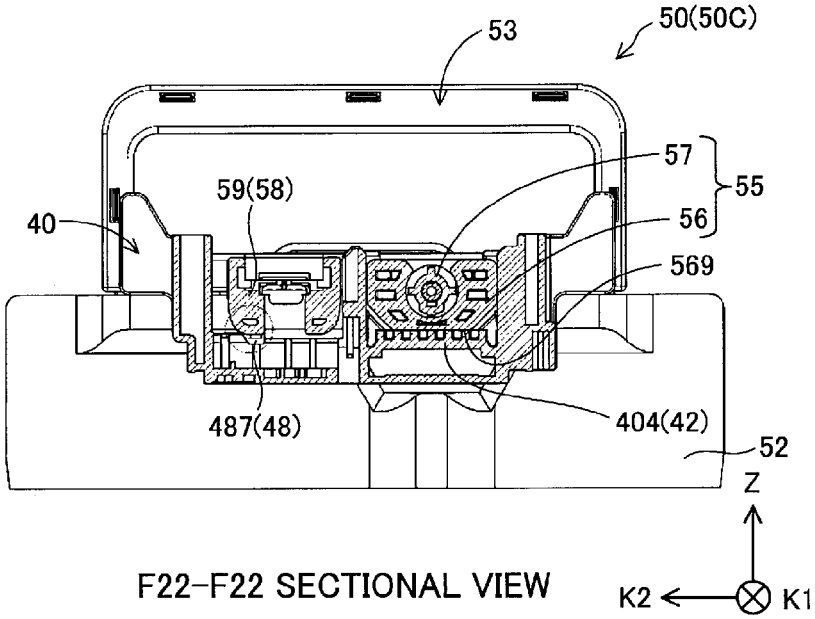
FIG. 24 is an F22-F22 sectional view of FIG. 22.
Figure 25:
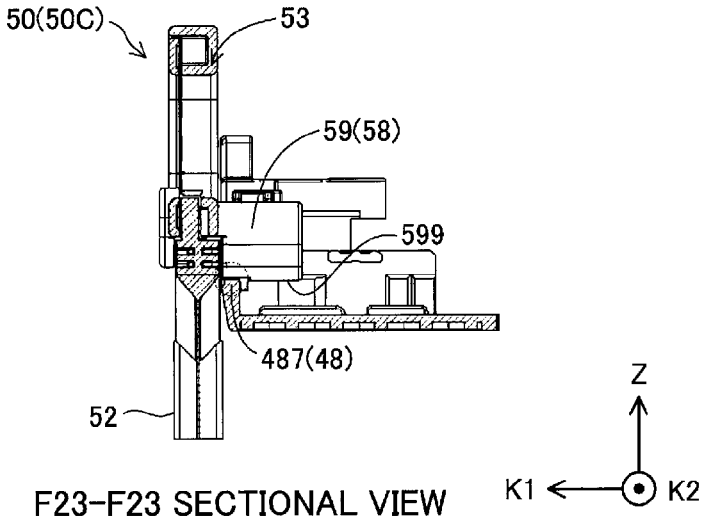
FIG. 25 is an F23-F23 sectional view of FIG. 23.
Figure 26:
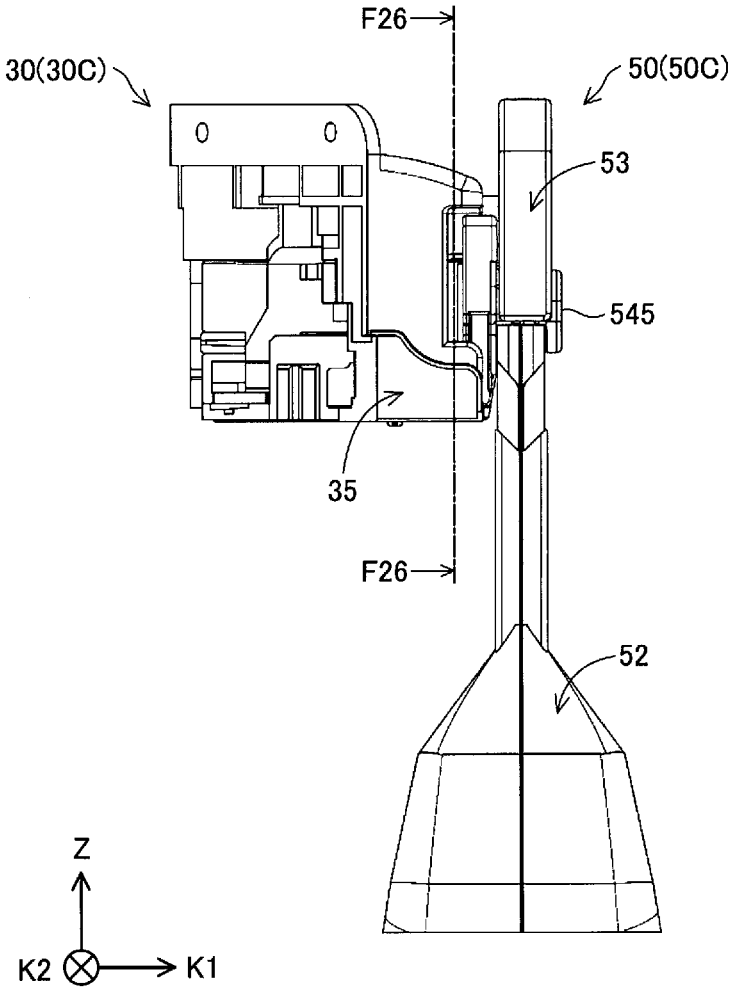
FIG. 26 is a side view illustrating the state that mounting (connection) of the liquid container to the mounting assembly unit is completed.
Figure 27:
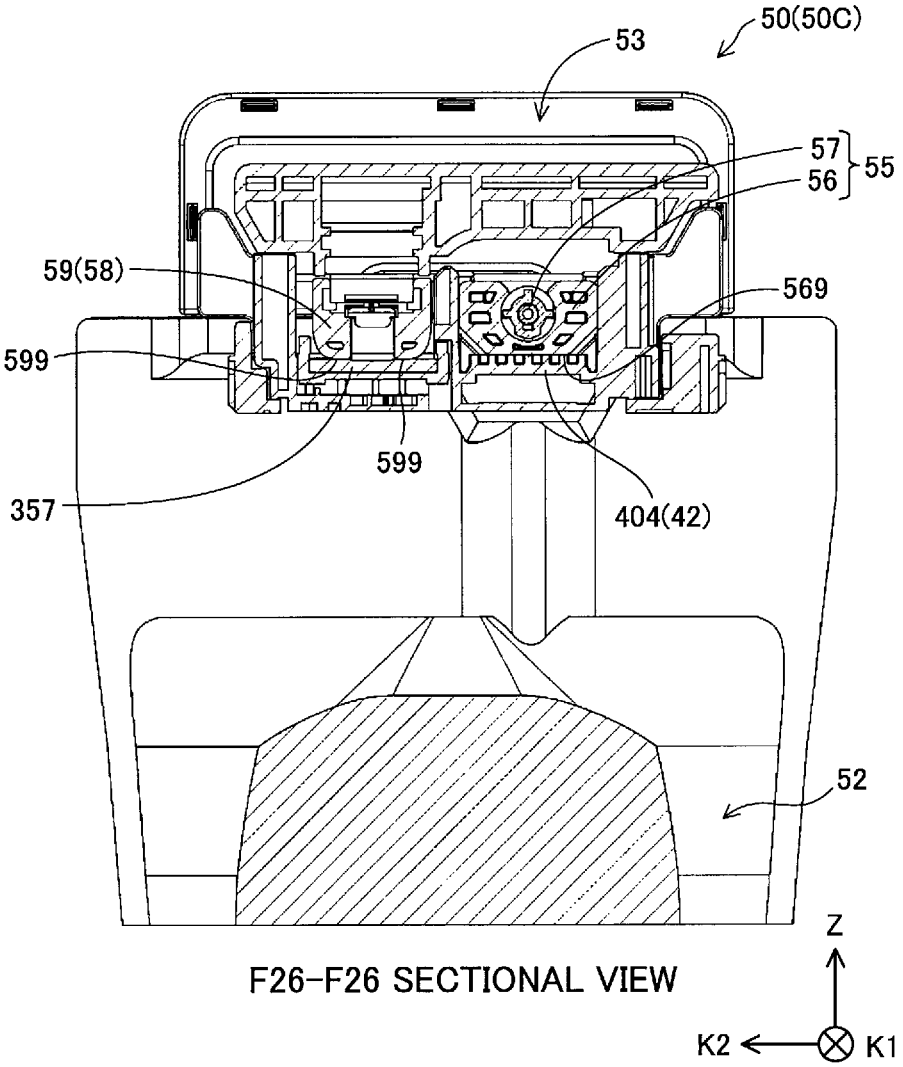
FIG. 27 is an F26-F26 sectional view of FIG. 26.

FIG. 22 is a side view illustrating the state that the liquid container 50 is set in the movable member 40 of the mounting assembly unit 30. FIG. 23 is a front view illustrating the state that the liquid container 50 is set in the movable member 40 of the mounting assembly unit 30. FIG. 24 is an F22-F22 sectional view of FIG. 22. FIG. 25 is an F23-F23 sectional view of FIG. 23. FIG. 26 is a side view illustrating the state that mounting (connection) of the liquid container 50 to the mounting assembly unit 30 is completed. FIG. 27 is an F26-F26 sectional view of FIG. 26. The state of the mounting assembly unit 30 shown in FIG. 22 is the first state like FIG. 5. The state of the mounting assembly unit 30 shown in FIG. 26 is the second state like FIG. 6.

As shown in FIG. 24, when the liquid container 50 is set in the movable member 40, the liquid supply unit 55 supports the liquid container body 52 on the upper side (+Z-axis direction side) of the liquid container body 52 in the direction of gravity. As shown in FIG. 24, a bottom outer surface 569 of the positioning structure 56 comes into contact with the third support plane 404 of the supply assembly support portion 42. This restricts the motion of the liquid container 50 downward in the direction of gravity (−Z-axis direction). This means supporting a −K2-axis direction side of the liquid container body 52.

As in the state that the liquid container 50 is set in the movable member 40, in the state that the liquid container 50 is connected with the mounting assembly unit 30 (in the mounting state), as shown in FIG. 27, the liquid supply unit 55 and the substrate unit 58 support the liquid container body 52 on the upper side (+Z-axis direction side) of the liquid container body 52 in the direction of gravity. More specifically, a bottom outer surface 599 of the circuit board holding portion 59 comes into contact with a bottom 357 of the stationary member 35. This restricts the motion of the liquid container 50 downward in the direction of gravity (−Z-axis direction). The bottom outer surface 569 of the positioning structure 56 comes into contact with the third support plane 404 of the supply assembly support portion 42. This restricts the motion of the liquid container 50 downward in the direction of gravity (−Z-axis direction). The container-side electrical connection structure 58 and the liquid supply assembly 55 serve to restrict the motion of the liquid container 50 downward in the direction of gravity and thereby support the liquid container 50. The contact of the bottom 357 of the stationary member 35 with the circuit board holding portion 59 is started between the time when the liquid container 50 is set in the movable member 40 and is moved in the connecting direction and the time when the connection is completed.

Figure 28A:
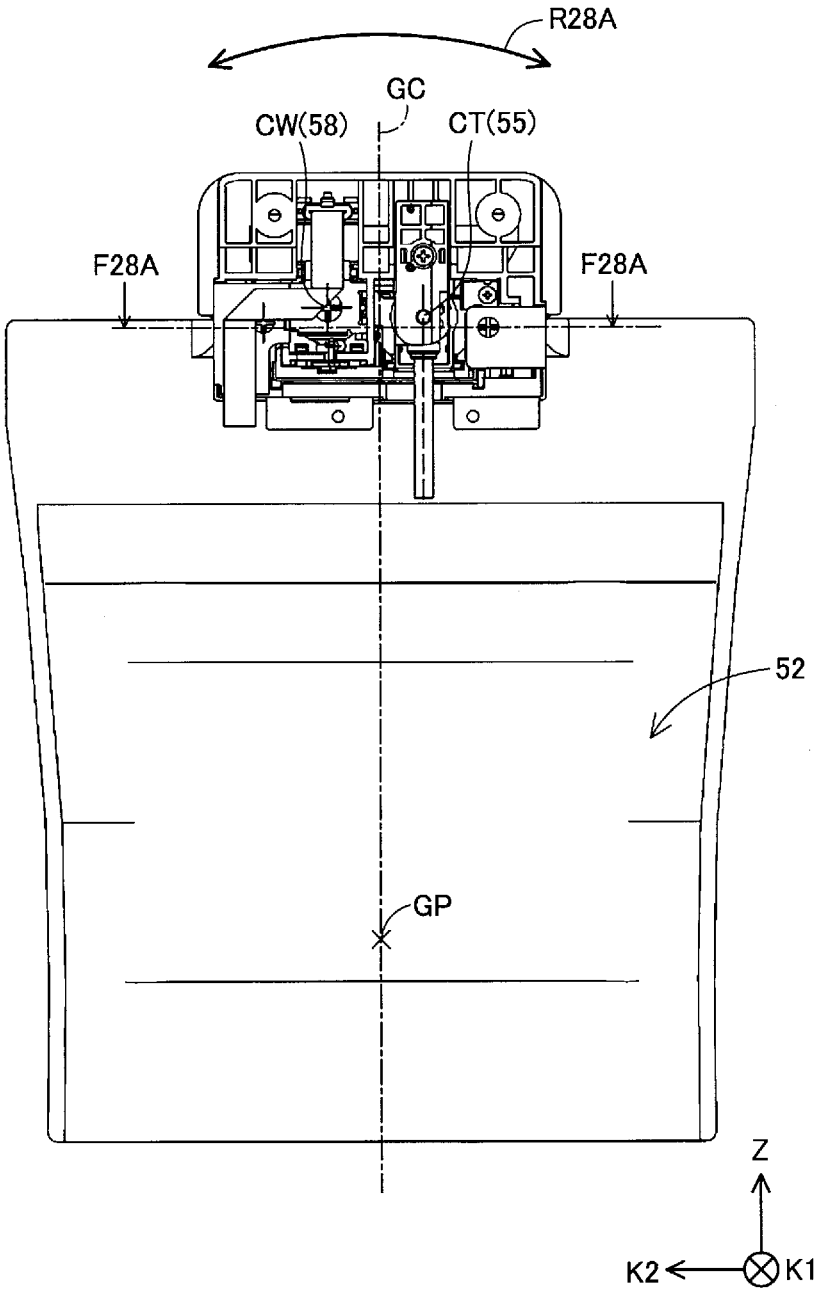
FIG. 28A is a sectional view illustrating the state that connection of the liquid container to the mounting assembly unit is completed (connecting state)
Figure 28B:
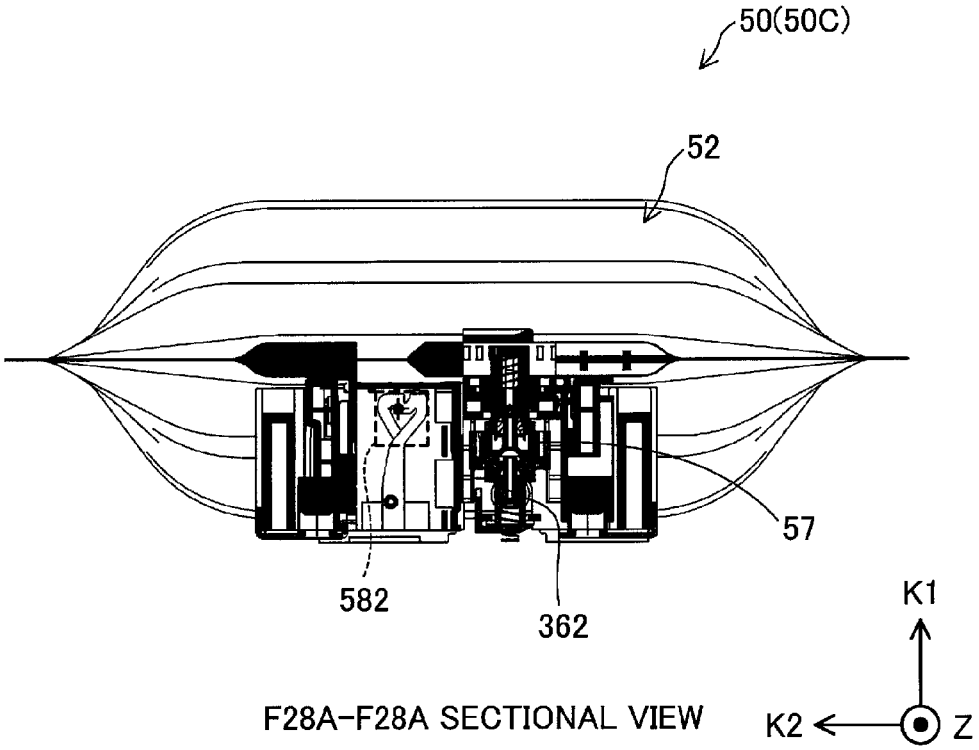
FIG. 28B is an F28A-F28A sectional view of FIG. 28A.

FIG. 28A is a sectional view illustrating the state that connection of the liquid container 50 to the mounting assembly unit 30 is completed (connecting state). FIG. 28B is an F28A-F28A sectional view of FIG. 28A. The liquid container 50 shown in FIG. 28A illustrates the state prior to consumption of ink by the printer 10. In FIG. 28A, symbol "GC" represents a center of gravity line that goes through the center of gravity GP of the liquid container body 52 and is along the Z-axis direction.

As shown in FIG. 28A, the liquid supply assembly 55 and the substrate unit (container-side electrical connection structure) 58 are located at positions across the center of gravity GP (center of gravity line GC) with regard to the K2-axis direction (second direction). The requirement is that the center (center axis) CT of the liquid supply assembly 55 and the center CW of the container-side electrical connection structure 58 are at least located at positions across the center of gravity (GP) (center of gravity line GC). The center CW denotes the center of the length of the circuit board 582 shown in FIG. 15 in the K2-axis direction.

The positioning structure 56 is supported by the supply assembly support portion 42 (shown in FIG. 27). The circuit board holding portion 59 is supported by the substrate support portion 48 (shown in FIG. 27) as described later. In the mounting state of the liquid container 50, the liquid container body 52 is thus hung by its dead weight on the lower side of the support position in the direction of gravity.

It is assumed that the liquid supply unit 55 and the substrate unit 58 having the part that supports the liquid container body 52 are biased to one side across the center of gravity GP of the liquid container body 52 in the K2-axis direction. In this case, a load is applied to the supporting part by the dead weight of the liquid container body 52. There is accordingly a possibility that the liquid container body 52 is rotated in the direction of an arrow R28A including a K2-axis direction component about the supporting part.

According to this embodiment, the liquid supply unit 55 and the substrate unit 58 are located at positions across the center of gravity GP in the K2-axis direction. This configuration supports the liquid container boy 52 on both sides across the center of gravity GP and thereby suppresses rotation of the liquid container body 52 in the direction of the arrow R28A.

A-6. Advantageous Effects

According to the above embodiment, as shown in FIG. 8A, the liquid supply assembly 55 is located on the one end portion 501-side of the liquid container body 52. As shown in FIG. 24, when the liquid container 50 is connected to the printer 10, the liquid supply assembly 55 supports the liquid container body 52 on the upper side (+Z-axis direction side) of the liquid container body 52 in the direction of gravity. As shown in FIG. 19, the liquid supply assembly 55 is moved in the connecting direction (−K1-axis direction) including the first direction (K1-axis direction) component that is the horizontal direction component, so as to be connected with the liquid introducing portion 362 provided on the printer 10.

Accordingly, when the liquid container 50 is connected to the printer 10, the liquid supply assembly 55 supports the liquid container body 52 such as to be hung in the direction of gravity (more specifically, −Z-axis direction that is downward in the direction of gravity). This eliminates the need to support the liquid container body 52 in the horizontal direction when the liquid container 50 is connected to the printer 10 and suppresses size expansion of the printer 10 in the horizontal direction. This also eliminates the need for a casing to support the liquid container body 52 in the horizontal direction, thus reducing the total number of components and simplifying the configuration. The liquid supply assembly 55 is located on the upper side (+Z-axis direction side) of the liquid container body 52 in the direction of gravity. This configuration causes the connecting part (for example, the liquid supply assembly 55) to be readily visible in the process of connecting the liquid container 50 to the printer 10 and accordingly facilitates the connecting operation (connecting action). For example, the user can visually recognize the liquid supply assembly 55 and the container-side electrical connection structure 58 without interference with other members as shown in FIG. 18. The "container-side electrical connection structure" may be regarded as the "substrate unit 58", may be regarded as the "circuit board 582" or may be regarded as the "contact portions cp".

According to the above embodiment, as shown in FIG. 19, the connecting direction of the liquid container 50 to the printer 10 is the horizontal direction. More specifically, the connecting direction is the −K1-axis direction that is one direction of the horizontal direction. Setting the connecting direction to one direction further facilitates the connecting operation.

According to the above embodiment, as shown in FIGS. 9 and 10, the liquid supply port 572 is open toward the first direction (more specifically, −K1-axis direction). The connecting direction is the first direction (more specifically, −K1-axis direction) as shown in FIG. 19. Accordingly, the opening direction of the liquid supply port 572 and the connecting direction of the liquid container 50 have identical direction components. This configuration enables the liquid introducing portion 362 (shown in FIG. 19) of the printer 10 to be readily inserted into the liquid supply port 572 by moving the liquid container 50 in the connecting direction (−K1-axis direction). This further facilitates connection of the liquid container 50 to the printer 10.

According to the above embodiment, as shown in FIG. 8A, the container-side electrical connection structure 58 is located on the one end portion 501-side of the liquid container body 52. As shown in FIGS. 24 and 27, when the liquid container 50 is connected to the printer 10, the container-side electrical connection structure 58 supports the liquid container body 52 on the upper side (+Z-axis direction side) of the liquid container body 52 in the direction of gravity. As shown in FIG. 19, the container-side electrical connection structure 58 is moved in the connecting direction (−K1-axis direction) to be electrically connected with the device-side electrical connection structure 382 provided on the printer 10. This configuration causes the liquid container body 52 to be supported and hung in the direction of gravity (more specifically, −Z-axis direction that is downward in the direction of gravity) by the container-side electrical connection structure 58 as well as the liquid supply assembly 55 when the liquid container 50 is connected to the printer 10. This enables the liquid container body 52 to be more securely supported. The container-side electrical connection structure 58 is located on the upper side (+Z-axis direction side) of the liquid container body 52 in the direction of gravity. This configuration causes the connecting part (for example, the container-side electrical connection structure 58) to be readily visible in the process of connecting the liquid container 50 to the printer 10 and accordingly facilitates the connecting operation.

According to the above embodiment, as shown in FIG. 18, the liquid supply assembly 55 and the container-side electrical connection structure 58 are arranged to be arrayed in the second direction (K2-axis direction) in the process of connecting the liquid container 50 to the printer 10. This configuration makes the liquid supply assembly 55 and the container-side electrical connection structure 58 readily visible in the process of moving the liquid container 50 in the connecting direction (−K1-axis direction), for example, as shown in FIG. 18 and thus allows the user to readily check the positions of the liquid supply assembly 55 and the container-side electrical connection structure 58. This configuration enables the liquid supply assembly 55 and the container-side electrical connection structure 58 to be connected to the printer 10 with high accuracy.

According to the above embodiment, as shown in FIG. 8A, the liquid supply assembly 55 and the container-side electrical connection structure 58 are located at positions closer to the center P52 of the one end portion 501 than the first end portion 501A and the second end portion 501B. This configuration reduces the amount of rotation of the liquid container 50 in the case where one of the liquid supply assembly 55 and the container-side electrical connection structure 58 is connected prior to the other, compared with the configuration that the liquid supply assembly 55 and the container-side electrical connection structure 58 are located at positions closer to the first end portion 501A and the second end portion 501B than the center P52 of the one end portion 501.

According to the above embodiment, as shown in FIG. 8A, the liquid supply assembly 55 and the container-side electrical connection structure 58 are located between the first handle end 54A and the second handle end 54B. This configuration enables the liquid supply assembly 55 and the container-side electrical connection structure 58 to be readily positioned relative to the printer 10 when the user grips the handle member 53. In other words, this configuration facilitates connection of the liquid supply assembly 55 and the container-side electrical connection structure 58 to the printer 10. For example, even in the case where the user grips the handle portion 54 and causes the liquid container 50 to be rotated about the handle portion 54 in the process of connecting to the printer 10, this configuration reduces the amounts of rotation of the liquid supply assembly 55 and the container-side electrical connection structure 58. This improves the operability in the process of connecting the liquid container 50 with the printer 10.

According to the above embodiment, as shown in FIG. 8A, the liquid supply assembly 55 and the container-side electrical connection structure 58 are located across the center P54 of the handle portion 54. For example, even in the case where the user grips the handle portion 54 and causes the liquid container 50 to be rotated about the handle portion 54, this configuration reduces the amounts of rotation of the liquid supply assembly 55 and the container-side electrical connection structure 58. This further improves the operability in the process of connecting the liquid container 50 with the printer 10.

According to the above embodiment, as shown in FIGS. 17G and 17H, the liquid container body 52 includes the first chamber 52A that is connected with the handle member 53 and the second chamber 52B that is located on the lower side (−Z-axis direction side) of the first chamber 52A in the direction of gravity and has the greater length than that of the first chamber 52A in the first direction (K1-axis direction). This configuration ensures a sufficient amount of ink to be contained by the second chamber 52B and also reduces the likelihood that the first chamber 52A interferes with smooth connection of the liquid supply assembly 55 and the container-side electrical connection structure 58 to the printer 10 when the liquid container 50 is moved in the connecting direction including the first direction (K1-axis direction) component to be connected to the printer 10. The following further describes these advantageous effects with reference to FIGS. 29 to 34.

Figure 29:
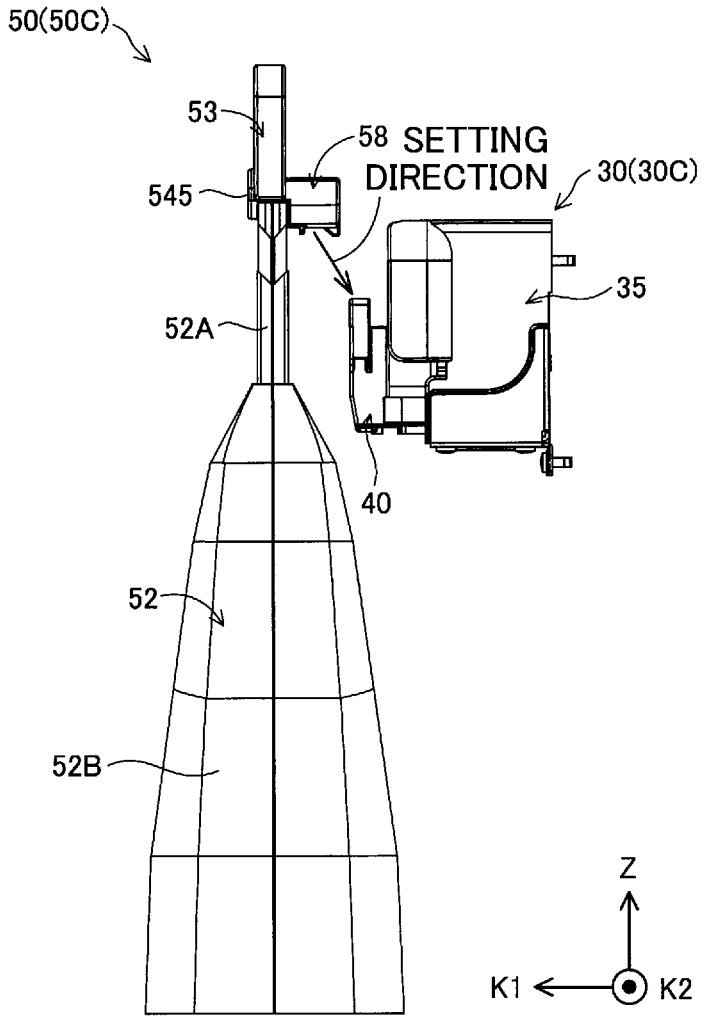
FIG. 29 is a first diagram illustrating the state before the liquid container is set in the mounting assembly unit.
Figure 30:
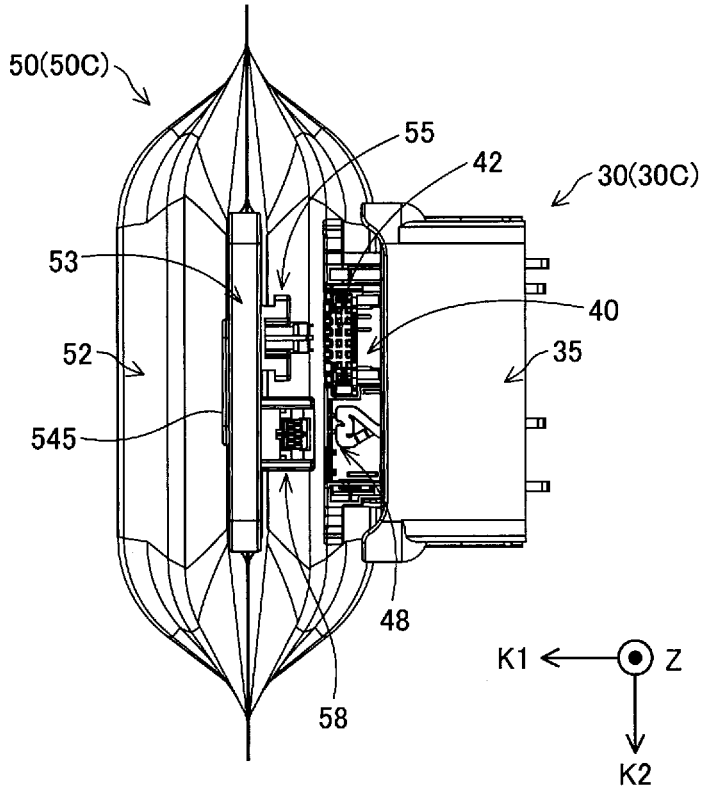
FIG. 30 is a diagram of FIG. 29 viewed from a +Z-axis direction side.
Figure 31:
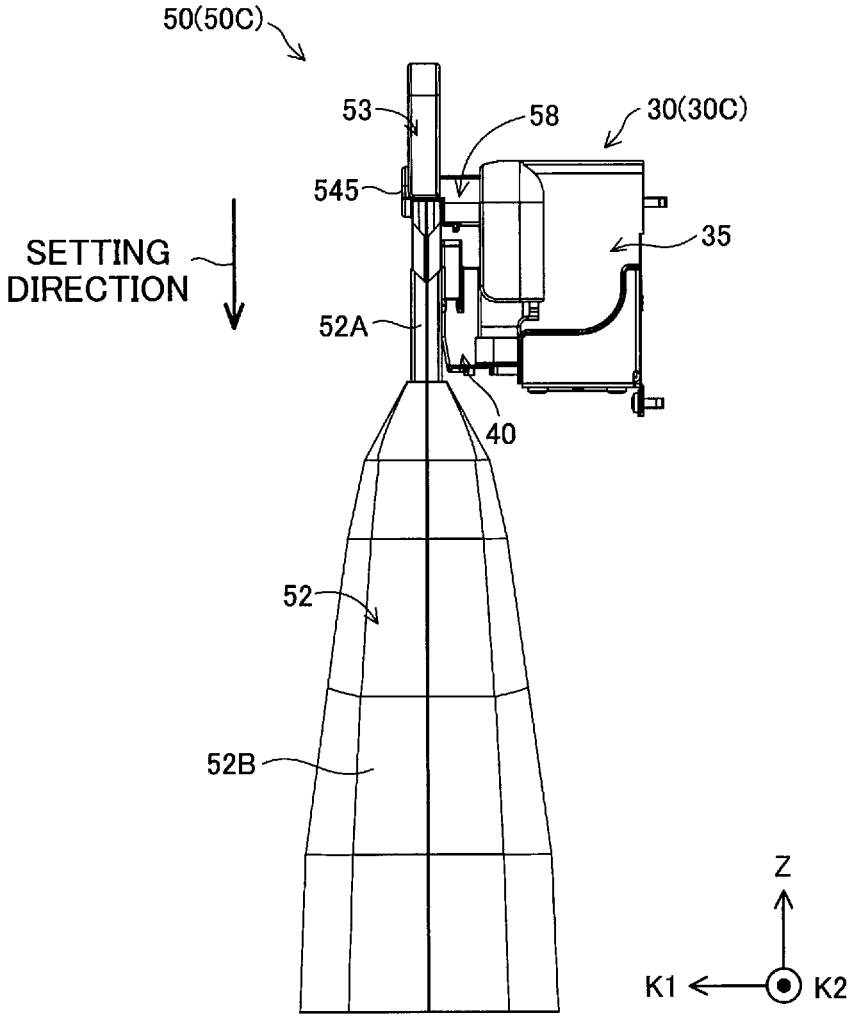
FIG. 31 is a second diagram illustrating the state before the liquid container is set in the mounting assembly unit.
Figure 32:
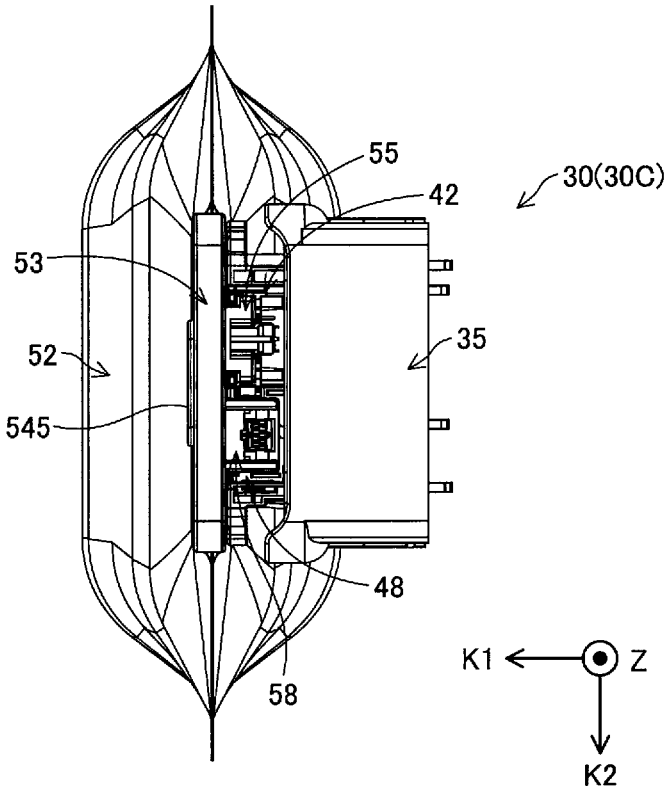
FIG. 32 is a diagram of FIG. 31 viewed from the +Z-axis direction side.
Figure 33:
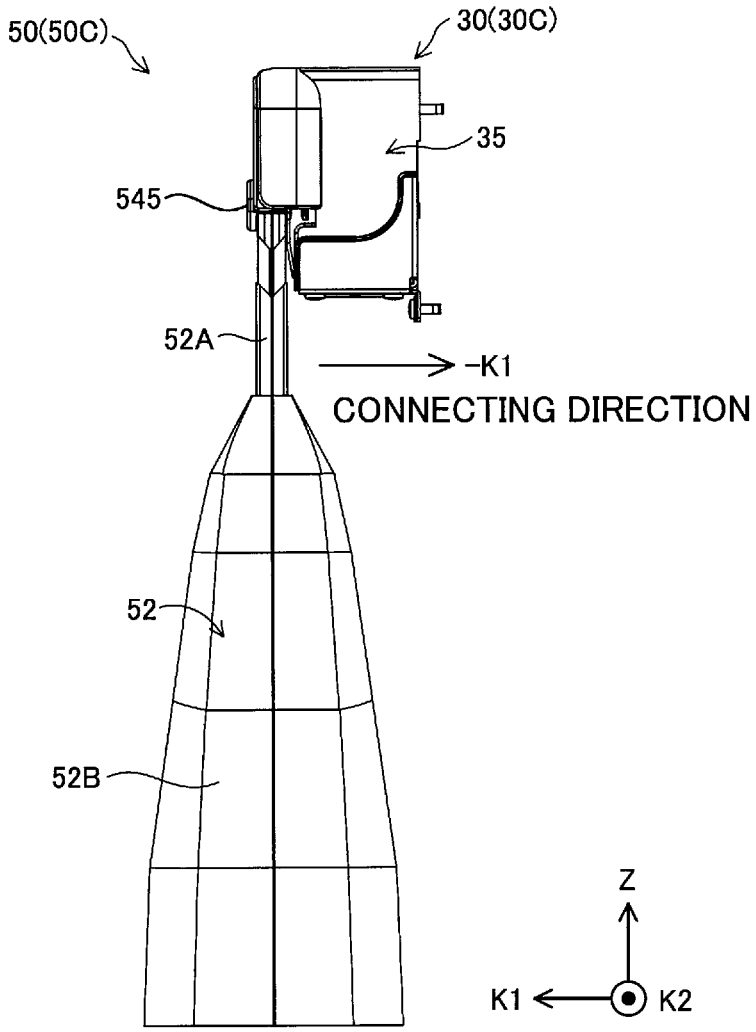
FIG. 33 is a diagram illustrating the state that the liquid container is mounted on the mounting assembly unit.
Figure 34:
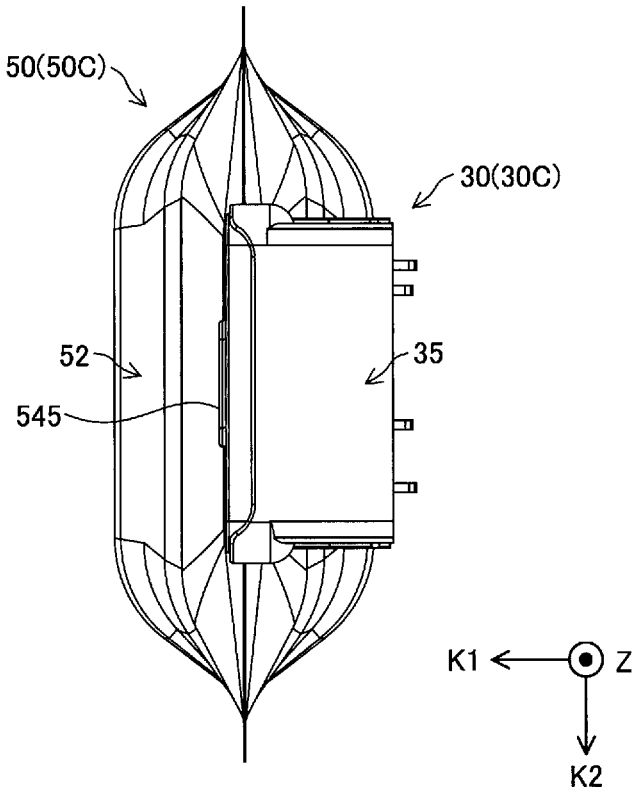
FIG. 34 is a diagram of FIG. 33 viewed from the +Z-axis direction side.

FIG. 29 is a first diagram illustrating the state before the liquid container 50 is set in the mounting assembly unit 30. FIG. 30 is a diagram of FIG. 29 viewed from the +Z-axis direction side. FIG. 31 is a second diagram illustrating the state before the liquid container 50 is set in the mounting assembly unit 30. FIG. 32 is a diagram of FIG. 31 viewed from the +Z-axis direction side. FIG. 33 is a diagram illustrating the state that the liquid container 50 is mounted on the mounting assembly unit 30. FIG. 34 is a diagram of FIG. 33 viewed from the +Z-axis direction side. In the process of mounting the liquid container 50 on the mounting assembly unit 30, the liquid container 50 is moved in the sequence of FIG. 29, FIG. 31 and FIG. 33. The mounting method shown in FIGS. 29 to 34 differs from the mounting method described above with reference to FIGS. 18 to 21 by the setting direction, and is otherwise similar to the mounting method of FIGS. 18 to 21.

As shown in FIG. 29, in order to set the liquid container 50 in the movable member 40, the user moves the liquid container 50 obliquely downward toward the movable member 40. As shown in FIG. 31, the user subsequently locates the members of the liquid container 50 (the substrate unit 58 and the liquid supply unit 55) to be set in the movable member 40 immediately above the movable member 40 and moves the liquid container 50 downward in the direction of gravity (−Z-axis direction). This causes the liquid container 50 to be set in the mounting assembly unit 30. The user then presses the pressing portion 545 to move the liquid container 50 set in the movable member 40 in the connecting direction (−K1-axis direction), so that the liquid container 50 is connected with the mounting assembly unit 30 as shown in FIG. 33.

As shown in FIGS. 31 and 32, in order to set the liquid container 50 in the mounting assembly unit 30, the user may locate the liquid supply assembly 55 immediately above the supply assembly support portion 42 and locate the container-side electrical connection structure 58 immediately above the substrate support portion 48. As shown in FIG. 31, the first chamber 52A connected with the handle member 53 has the smaller length than that of the second chamber 52B in the K1-axis direction. More specifically, the liquid supply assembly 55 and the container-side electrical connection structure 58 are configured to be protruded in the connecting direction (−K1-axis direction) from the first chamber 52A by the predetermined values Sa1 and Sa2. This configuration reduces the likelihood that the liquid container body 52 interferes with setting the liquid supply assembly 55 and the container-side electrical connection structure 58 in the mounting assembly unit 30 when the liquid container body 52 is moved to be connected to the printer 10.

According to the above embodiment, as shown in FIG. 28A, in the connecting state, the liquid supply assembly 55 and the container-side electrical connection structure 58 are located at positions across the center of gravity GP (center of gravity line GC) in the second direction (K2-axis direction). This configuration reduces the amount of rotation of the liquid container 50 about one of the liquid supply assembly 55 and the container-side electrical connection structure 58 as the point of support in the connecting state.

According to the above embodiment, the positioning structure 56 and the container-side electrical connection structure 58 including the circuit board holding portion 59 that are required for connection with the printer 10 are provided integrally with the operation member 53 (shown in FIG. 9). This configuration eliminates the need for providing another component (for example, a casing for mounting the liquid container 50) to connect the liquid container 50 to the printer 10. This achieves the function of connecting the liquid container 50 to the printer 10 by a less number of components. The configuration that the positioning structure 56 and the container-side electrical connection structure 58 including the circuit board holding portion 59 are provided integrally with the operation member 53 enables the user to grip the operation member 53 and handle the liquid container 50 in the process of connecting the liquid container 50 to the printer 10. This configuration has the better operability compared with a configuration without the operation member 53.

This eliminates the need to mount the liquid container 50 in a casing in advance and thereby simplifies the process of connecting the liquid container 50 to the printer 10. This also eliminates the need for the casing and allows for downsizing of the liquid container 50. Additionally, since there is no need for the casing, the liquid container body 52 after ink consumption is readily reduced in size and disposed.

According to the above embodiment, the liquid container body 52 is mounted on the operation member 53 in such a state as to be visible from outside of the liquid container 50 (shown in FIG. 7). This configuration enables the amount of ink contained in the liquid container body 52 to be readily recognized from outside according to a change in state of the liquid container body 52, for example, a change in volume, a change in shape or a change in ink volume.

According to the above embodiment, the positioning structure 56 and the container-side electrical connection structure 58 including the circuit board holding portion 59 are provided on the first side 53*fa* of the operation member 53. The pressing portion 545 is provided on the second side 53*fb* that is opposite to the positioning structure 56 and the container-side electrical connection structure 58 including the circuit board holding portion 59 across the operation member 53 (shown in FIGS. 9 and 12). Accordingly the positioning structure 56 and the container-side electrical connection structure 58 including the circuit board holding portion 59 used for positioning relative to the printer 10 and the pressing portion 545 to be pressed in the process of connecting the liquid container 50 to the printer 10 are made readily visible from outside. Accordingly this facilitates the connecting operation of the liquid container 50 to the printer 10. The pressing force applied by the user to the pressing portion 545 is transmitted directly to the liquid supply assembly 55 and the container-side electrical connection structure 58. This stabilizes the motion of the liquid supply assembly 55 and the container-side electrical connection structure 58 to the motion along the connecting direction (−K1-axis direction).

In the case where the liquid container 50 is dropped down, it is highly likely that the liquid container body 52 of the larger weight in which ink is contained comes below the operation member 53. According to the above embodiment, at least part of the positioning structure 56 is provided on the liquid container body 52-side (−Z-axis direction side) of the liquid supply port 572 (shown in FIGS. 7 and 13). Even in the case where the liquid container 50 is dropped down, this configuration of the positioning structure 56 reduces the likelihood that the liquid supply port 572 collides with an object such as ground surface. This accordingly reduces the likelihood that the liquid supply port 572 is damaged.

According to the above embodiment, at least part of the circuit board holding portion 59 (i.e., part of the container-side electrical connection structure 58 other than the contact portions cp) is provided on the liquid container body 52-side (−Z-axis direction side) of the circuit board 582 (contact portions cp) (shown in FIGS. 7 and 13). Even in the case where the liquid container 50 is dropped down, this configuration of the circuit board holding portion 59 reduces the likelihood that the circuit board 582 (contact portions cp) collides with an object such as ground surface. This accordingly reduces the likelihood that the circuit board 582 (contact portions cp) is damaged.

According to the above embodiment, the operation member 53 is provided to make the grip surface 541 offset in the center axis CT direction relative to the liquid supply port 572 when the grip surface 541 is located relative to the liquid supply portion 57 in the direction (+Z-axis direction) perpendicular to the center axis CT direction of the liquid supply portion 57 (shown in FIG. 15). When the user holds the grip portion 54 of the operation member 53 to mount the liquid container 50 on the printer 10, this configuration causes the liquid supply port 572 to be not hidden by the operation member 53 but to be visually recognizable. This facilitates the user to mount the liquid container 50 on the printer 10. The user grips the operation member 53 to handle the liquid container 50. This reduces the likelihood that the user touches the liquid container body 52. This accordingly reduces the likelihood that the liquid container body 52 is damaged and ink contained inside of the liquid container body 52 leaks outside.

According to the above embodiment, the liquid supply unit 55 is provided to be protruded outward (toward −K1-axis direction) from the operation member 53 (shown in FIGS. 9 and 10). This configuration enables the user to readily recognize that the protruding direction of the liquid supply unit 55 indicates the connecting direction to connect the liquid container 50 to the printer 10 (shown in FIG. 9). This further facilitates the user to mount the liquid container 50 on the printer 10.

According to the above embodiment, the liquid container 50 has the positioning structure 56 (shown in FIG. 9). The positioning structure 56 serves to roughly position the liquid container 50 including the liquid supply portion 57 relative to the printer 10. This enables the liquid container 50 to be mounted on the printer 10 adequately (i.e., in the adequate mounting state).

According to the above embodiment, the substrate unit 58 is provided to be offset relative to the grip surface 541 when the grip surface 541 is located in the direction (+Z-axis direction) that is perpendicular to the center axis CT direction of the liquid supply portion 57 (shown in FIG. 15). This configuration makes the substrate unit 58 visible when the user holds the grip surface 541 of the operation member 53 and mounts the liquid container 50 on the printer 10. This further facilitates the user to mount the liquid container 50 on the printer 10.

According to the above embodiment, the protruding direction of the substrate unit 58 (−K1-axis direction) is identical with the protruding direction of the liquid supply portion 57 (−K1-axis direction) (shown in FIGS. 9 and 10). This configuration facilitates the user to simultaneously recognize the substrate unit 58 and the liquid supply portion 57 in the process of mounting the liquid container 50 on the printer 10. This facilitates connection of the liquid supply portion 57 with the printer 10 and electrical connection of the substrate unit 58 with the printer 10. This configuration also enables the user to recognize that the connecting direction of the substrate unit 58 to the printer 10 (−K1-axis direction) is identical with the connecting direction of the liquid supply portion 57 to the printer 10 (−K1-axis direction) as shown in FIG. 19 when the user holds the grip surface 541 of the operation member 53 and mounts the liquid container 50 on the printer 10. This further facilitates the user to mount the liquid container 50 on the printer 10. Additionally, connecting the liquid supply portion 57 with the printer 10 provides electrical connection of the substrate unit 58 with the printer 10.

According to the above embodiment, the substrate unit 58 and the liquid supply unit 55 are provided to be arrayed in the K2-axis direction that is parallel to the grip surface 541 and is orthogonal to the center axis CT (shown in FIGS. 9 and 10). These units 58 and 55 are thus arrayed in the direction orthogonal to the connecting direction (−K1-axis direction). This further facilitates electrical connection of the substrate unit 58 with the device-side electrical connection structure 382 and connection of the liquid supply portion 57 with the printer 10.

According to the above embodiment, the liquid supply unit 55 (more specifically its positioning structure 56) and the circuit board holding portion 59 are coupled with each other by the coupling member 53A (shown in FIG. 17A). When the user holds the grip portion 54 to move the coupling member 53A, this configuration causes the liquid supply unit 55 and the circuit board holding portion 59 to move in conjunction with the motion of the coupling member 53A. The cooperative motions of the liquid supply unit 55 and the circuit board holding portion 59 eliminate the need to independently connect the liquid supply unit 55 and the circuit board holding portion 59 with the corresponding mechanisms 36 and 38 of the printer 10 (shown in FIG. 6). This facilitates connection of the liquid supply unit 55 and the circuit board holding portion 59 to the printer 10.

The coupling member 53A has the grip portion 54 that is holdable, so that an external force is likely to be applied to the coupling member 53A and members joined with the coupling member 53A (for example, the joint portion 549). According to the above embodiment, as shown in FIG. 17A, the liquid supply portion 57 is integrally molded with the joint portion 549. In other words, the liquid supply portion 57 is connected with the joint portion 549. As shown in FIG. 17A, the coupling member 53A is assembled with the second member 53B, so as to be coupled with the joint portion 549. This reduces the likelihood that an external force is applied to (main part of) the liquid container body 52 other than the part mounted on the joint portion 549 and thereby reduces the likelihood that the main part of the liquid container body 52 is damaged. This accordingly reduces the likelihood that ink contained in the liquid container body 52 leaks outside.

According to the above embodiment, as shown in FIG. 17B, the coupling member 53A including the grip portion 54 and the second member 53B including the joint portion 549 that is to be mounted to the liquid container body 52 are configured by separate members. The engagement elements 513 provided on the protruded portion 517 of the second member 53B are engaged with the engagement elements 511 provided on the coupling member 53A, so that the coupling member 53A is coupled with the second member 53B. In other words, the joint portion 549 mounted to the liquid container body 52 and the coupling member 53A may be formed by separate members. This increases the flexibility of design. For example, the engagement elements 511 of the coupling member 53A may be formed in a shape corresponding to the shape of the engagement elements 513 of the second member 53B. This allows coupling members 53A of various different shapes to be coupled with the second member 53B.

According to the above embodiment, as shown in FIG. 17B, the engagement elements 511 of the coupling member 53A are engaged with the engagement elements 513 of the second member 53B, so that the coupling member 53A and the second member 53B are positioned relative to each other. In other words, the engagement elements 511 serving as the member positioning elements readily position the liquid supply portion 57 and the circuit board 582 relative to each other. This ensures connection of the liquid supply portion 57 and the circuit board 582 to the printer 10 with high accuracy.

According to the above embodiment, as shown in FIG. 17B, the engagement element 511 serving as the member positioning element has the outer shape (more specifically approximately rectangular shape) to surround the direction along the center axis CT of the liquid supply portion 57 (K1-axis direction). This configuration suppresses positional misalignment between the second member 53B provided with the liquid supply portion 57 and the first member 53A provided with the circuit board 582 in the direction perpendicular to the center axis CT (planar direction defined by the Z-axis direction and the K2-axis direction).

According to the above embodiment, as shown in FIG. 17B, the coupling member 53A has the three engagement elements 511A, 511B and 511C that are arrayed in the direction (K2-axis direction) intersecting with the direction of gravity (Z-axis direction). When the user grips the grip portion 54, this configuration causes the load produced by the dead weight of the liquid container body 52 to be distributed to the three engagement elements 511A, 511B and 511C. This reduces the likelihood that the engagement elements 511 are damaged.

According to the above embodiment, as shown in FIG. 17C, the engagement element 511A and the engagement element 511B or the engagement element 511A and the engagement element 511C are provided at the positions across the liquid supply portion 57 in the longitudinal direction of the joint portion 549 (K2-axis direction). This configuration causes the load produced by the dead weight of the liquid container body 52 to be applied to the respective sides of the coupling member 53A and the second member 53B across the liquid supply portion 57. This reduces the likelihood that one side (+K2-axis direction side) of the joint portion 549 is more significantly inclined (more significantly deformed) than the other side (−K2-axis direction side) relative to the liquid supply portion 57. This accordingly suppresses positional misalignment of the liquid supply portion 57 and thus enables the liquid supply portion 57 to be connected with the printer 10 with high accuracy.

According to the above embodiment, as shown in FIG. 17C, the engagement element 511B and the engagement element 511C or the engagement element 511A and the engagement element 511C are provided at the positions across the circuit board 582 in the longitudinal direction of the joint portion 549 (K2-axis direction). This configuration causes the load produced by the dead weight of the liquid container body 52 to be applied to the respective sides of the coupling member 53A and the second member 53B across the circuit board 582. This reduces the likelihood that one side (+K2-axis direction side) of the joint portion 549 is more significantly inclined (more significantly deformed) than the other side (−K2-axis direction side) relative to the circuit board 582. This accordingly suppresses positional misalignment of the circuit board 582 and thus enables the circuit board 582 to be connected with the printer 10 with high accuracy.

According to the above embodiment as shown in FIG. 8A, the width W52 of the grip portion 54 is smaller than the width W549 of the joint portion 549, and the liquid supply unit 55 and the substrate unit 58 are located between the respective ends 54A and 54B of the grip portion 54. This configuration causes the liquid supply unit 55 and the substrate unit 58 to be securely supported by the grip portion 54 when the user grips the grip portion 54.

According to the above embodiment, as shown in FIG. 17A, the handle member 53A and the liquid supply portion 57 are formed by separate members. This increases the flexibility in design of the liquid container 50. For example, even when there is a need to change the material of the liquid supply portion 57 with a change of the type of ink contained in the liquid container body 52, there is no need to change the material of the handle member 53A. In a certain case, when the type of ink is changed, a mass of the generally used liquid supply portion 57 may be eluted in the changed ink. In this case, there is a need to newly form the liquid supply portion 57 from a material having chemical resistance to the changed ink. According to this embodiment, however, the second member 53B provided with the liquid supply portion 57 and the handle member 53A provided with the grip portion 54 are formed by separate members. There is accordingly no need to change the material of the handle member 53A. In other words, the handle member 53A and the liquid supply portion 57 may be separately formed from materials according to the applications.

According to the above embodiment, the liquid supply portion 57 is made of the material having resistance to the ink contained in the liquid container body 52. This reduces the likelihood that the liquid supply portion 57 is deteriorated (damaged) by the ink. This also reduces the likelihood that impurities are produced in the ink that is supplied to the printer 10, for example, by elution of part of the liquid supply portion 57 into the ink.

The handle member 53A is a part that is gripped by the user to directly receive an external force. According to the above embodiment, the handle member 53A is formed from the material having excellent deformation resistance or excellent creep resistance. This suppresses deformation of the handle member 53A. The positioning structure 56 and the circuit board holding portion 59 are connected with the handle member 53A. The positioning structure 56 and the circuit board holding portion 59 are important parts involved in, for example, positioning of the liquid container 50 relative to the printer 10 in the process of connecting the liquid container 50 to the printer 10. Suppressing deformation of the handle member 53A suppresses positional misalignment of these parts 56 and 59 relative to the handle member 53A. This accordingly ensures adequate connection of the liquid container 50 to the printer 10.

According to the above embodiment, as shown in FIGS. 15 and 17B, the liquid container 50 has the pressing portion 545 provided at the position opposite to the liquid supply unit 55 across the handle member 53A. This configuration facilitates connection of the liquid supply portion 57 with the printer 10 by the user's simple press of the pressing portion 545.

According to the above embodiment, as shown in FIG. 17A, the handle member 53A and the third member 53C having the pressing portion 545 are formed by separate members. This increases the flexibility in design of the liquid container 50. For example, the shape and the area of the pressing portion 545 may be freely set irrespective of the shape and the size of the handle member 53A. This enables part of the pressing portion 545 to be arranged to overlap with the liquid container body 52. Such arrangement that part of the pressing portion 545 overlaps with the liquid container body 52 expands the outer shape of the pressing portion 545 by effectively using the limited space and ensures the volume of the liquid container body 52 to or above a certain level.

According to the above embodiment, the pressing portion 545 has the appearance that allows for identification of the color of ink contained in the liquid container body 52. More specifically, according to the above embodiment, the third member 53C including the pressing portion 545 (shown in FIG. 17B) is colored with the color of ink. This enables the user to readily identify the color of ink contained in the liquid container body 52 by visually recognizing the third member 53C. In the case where the color of ink contained in the liquid container body 52 is changed, only the third member 53C is to be replaced. The color of the pressing portion 545 is identical with the color of the connecting member 40 (shown in FIG. 5). This configuration enables the user to readily identify the connecting member 40 corresponding to the liquid container 50 by visually recognizing the pressing portion 545. This reduces the likelihood that the unexpected liquid container 50 containing different color of ink is mistakenly connected with the printer 10.

A-7. Preferable Aspects of Liquid Container 50

Figure 35:
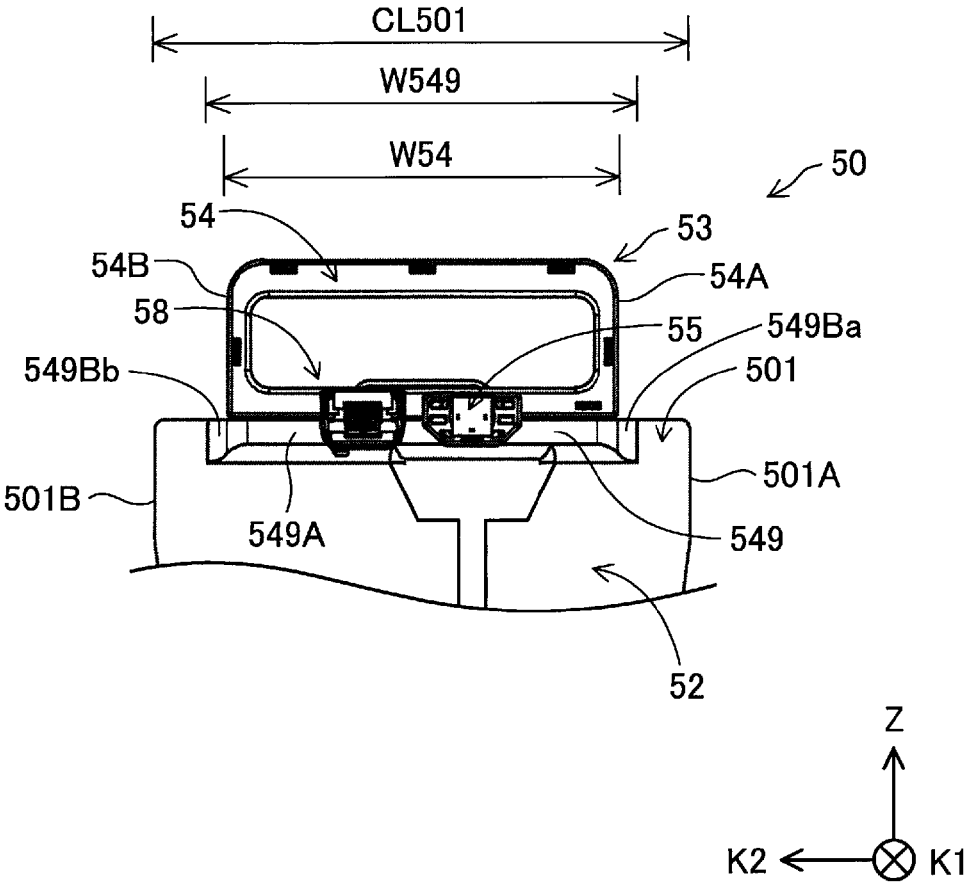
FIG. 35 is a diagram further illustrating the liquid container.
Figure 36:
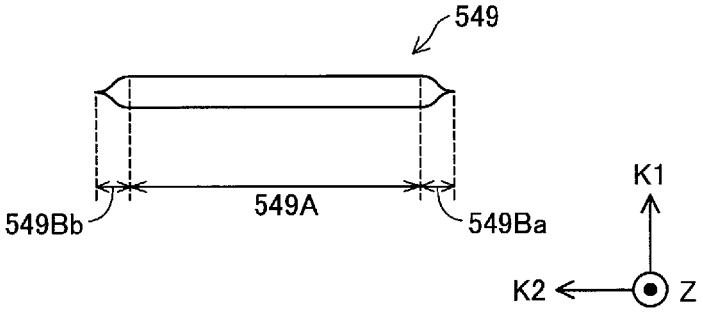
FIG. 36 is a diagram illustrating a joint portion.

FIG. 35 is a diagram further illustrating the liquid container 50. FIG. 36 is a diagram illustrating the joint portion 549. As shown in FIG. 35, the liquid container body 52 is mounted to the joint portion 549 by welding. In the state before mounting the liquid container body 52 to the joint portion 549, the one end portion 501 of the liquid container body 52 is open. The joint portion 549 is inserted into the open one end portion 501 and is joined with the one end portion 501 by welding. The outer circumference of the open one end portion 501 is specified as outer circumference CL501. The outer circumference CL501 denotes the outer length of the one end portion 501 when the one end portion 501 is viewed from the +Z-axis direction.

As shown in FIG. 36, the joint portion 549 includes a first joint end section 549Ba located at one end in the K2-axis direction, a second joint end section 549Bb located at the other end, and a middle section 549A located between the respective end sections 549Ba and 549Bb. The middle section 549A is formed in an approximately rectangular parallelepiped shape. The middle section 549A has a fixed length in the K1-axis direction. The first joint end section 549Ba and the second joint end section 549Bb have lengths in the K1-axis direction decreasing toward respective edges of the joint portion 549 in the K2-axis direction. In other words, the first joint end section 549Ba and the second joint end section 549Bb are formed in chamfered shape. As described above, the joint portion 549 includes the first and the second joint end sections 549Ba and 549Bb that have curvatures to decrease the lengths in the K1-axis direction toward the respective edges when the liquid container 50 is viewed from the upper side (+Z-axis direction side) in the direction of gravity, and the middle section 549A that has the fixed length in the K1-axis direction and is arranged to connect the first and the second joint end sections 549Ba and 549Bb with each other. The outer circumference when the joint portion 549 is viewed from the +Z-axis direction is specified as outer circumference CL549.

As shown in FIG. 35, the joint portion 549 is joined with the one end portion 501 of the liquid container body 52 with intervals from the first end portion 501A and the second end portion 501B. According to this embodiment, the joint portion 549 is joined with the one end portion 501 with same intervals from the first end portion 501A and the second end portion 501B.

The liquid container 50 preferably satisfies the relationship of outer circumference CL501×0.5≤ outer circumference CL549≤ outer circumference cL501×0.95. Controlling the outer circumference CL549 of the joint portion 549 to be not less than 50% of the outer circumference CL501 of the one end portion 501 adequately distributes the load that is produced by the dead weight of the liquid container body 52 and is applied to the bonded part of the joint portion 549 and the liquid container body 52. This reduces the likelihood that the bonded part of the liquid container body 52 and the joint portion 549 is damaged. Controlling the outer circumference CL549 of the joint portion 549 to be close to the outer circumference CL501 of the one end portion 501 increases the bonding area of the one end portion 501 and the joint portion 549 and allows for better distribution of the load applied to the bonded part.

Controlling the outer circumference CL549 to a specified preferable range forms the joint portion 549 and the operation member 53 connected with the joint portion 549 in specified shapes and produces the liquid container 50 using various sizes of the liquid container body 52.

As shown in FIG. 35, it is preferable that the first handle end 54A is located in the range where the first joint end section 549Ba is located and that the second handle end 54B is located in the range where the second joint end section 549Bb is located with regard to the K2-axis direction (longitudinal direction of the one end portion 501). In other words, it is preferable that the first handle end 54A is located in the first joint end section 549Ba and that the second handle end 54B is located in the second joint end section 549Bb when the liquid container 50 is viewed from the +Z-axis direction. This configuration increases the length in the K2-axis direction of the handle member 53 joined with the joint portion 549 and thereby distributes the load (stress) applied to the handle member 53 by the dead weight of the liquid container body 52. This reduces the amount of deformation or the amount of creep deformation of the handle member 53.

The following describes preferable aspects of the liquid container 50 based on the above description. The symbols in parentheses denote the symbols of the respective components described in the above embodiment.

[Aspect 1]

A liquid container (50) that is configured to be connectable with a liquid consuming device (10), the liquid container (50) comprising:

a liquid container body (52) that is configured to contain a liquid;

a liquid supply portion (57) that is configured to flow the liquid contained in the liquid container body (52) to the liquid consuming device (10); and a joint portion (549) that is connected with the liquid supply portion (57) and is inserted into one end portion (501) forming an opening of the liquid container body (52), so as to be mounted to the liquid container body (52), wherein in a connecting state that the liquid container (50) is connected with the liquid consuming device (10), when the liquid container (50) is viewed from one direction side (+Z-axis direction side) in an opposing direction (Z-axis direction) in which the one end portion (501) of the liquid container body (52) is opposed to the other end portion (502) of the liquid container body (52), the liquid container (50) satisfies a relationship of outer circumference CL501×0.5≤ outer circumference CL549≤ outer circumference CL501×0.95, where CL501 denotes outer circumference of the one end portion (501) and CL549 denotes outer circumference of the joint portion (549).

The liquid container according to this aspect adequately distributes a load that is produced by dead weight of the liquid container body 52 and is applied to a bonded part of the joint portion 549 and the liquid container body 52. This reduces the likelihood that the mounting part of the liquid container body 52 and the joint portion 549 is damaged.

[Aspect 2]

The liquid container (50) according to the above aspect, further comprising a handle member (53) that is connected with the joint portion (549) and includes a portion (54) gripped by a user, wherein the joint portion (549) comprises:

a first joint end section (549Ba) that is one end section at the one end portion (501) in a longitudinal direction (K2-axis direction) orthogonal to the opposing direction and has a length in a thickness direction (K1-axis direction) orthogonal to the opposing direction and the longitudinal direction decreasing toward an edge in the longitudinal direction when the liquid container (50) is viewed from the one direction side (+Z-axis direction side) in the opposing direction (Z-axis direction) in the connecting state;

a second joint end section (549Bb) that is the other end section in the longitudinal direction (K2-axis direction) and has a length in the thickness direction (K1-axis direction) decreasing toward an edge in the longitudinal direction when the liquid container (50) is viewed from the one direction side (+Z-axis direction side) in the connecting state; and a middle section (549A) that is arranged to connect the first joint end section and the second joint end section (549Ba, 549Bb) with each other and has a substantially fixed length in the thickness direction, wherein in the connecting state, when the liquid container (50) is viewed from the one direction side (+Z-axis direction side), one end (54A) of the handle member (53) in the longitudinal direction (K2-axis direction) is located in a range where the first joint end section (549Ba) is located, and the other end (54B) of the handle member (53) is located in a range where the second joint end section (549Bb) is located.

[Aspect 3]

The liquid container (50) according to the above aspect, wherein the liquid supply portion (57) is located between the one end (54A) and the other end (54B) in the longitudinal direction (K2-axis direction).

[Aspect 4]

The liquid container (50) according to the above aspect, further comprising a circuit board (582) that is located between the one end (54A) and the other end (54B) in the longitudinal direction (K2-axis direction) and is electrically connectable with the liquid consuming device.

[Aspect 5]

The liquid container (50) according to the above aspect, further comprising:

a positioning structure (56) that is located between the one end (54A) and the other end (54B) in the longitudinal direction (K2-axis direction) and is configured to position the liquid supply portion 57 relative to the liquid consuming device (10); and a circuit board holding portion (59) that is located between the one end (54A) and the other end (54B) in the longitudinal direction (K2-axis direction) and is configured to hold the circuit board.

The liquid container 50 of the above embodiment may be defined by the following aspects.

[Aspect A]

A liquid container (50) that is connected with a liquid consuming device (10) and is configured to supply a liquid, the liquid container (50) comprising:

a liquid container body (52) that is configured to contain the liquid;

a liquid supply port (572) that is located on one end portion (501)-side of the liquid container body (52) and is configured to receive part of the liquid consuming device (10) inserted to supply the liquid contained in the liquid container body to the liquid consuming device (10); and a handle member (53) that is located on the one end portion (501)-side of the liquid container body (52) and is gripped by a user, wherein when the handle member is gripped, the liquid container body (52) is located by dead weight below the handle member in a direction of gravity, and the liquid supply port (572) is open toward a direction including a horizontal direction (K1-axis direction) and is located in a range that does not overlap with the handle member when the liquid container (50) is viewed from a handle member side.

The liquid container according to this aspect enables the user to visually recognize the liquid supply port without interference with the handle member. This configuration facilitates an operation to insert the liquid supply port into the liquid consuming device.

[Aspect B]

According to the above embodiment, a liquid container (50) includes a liquid container body (52) and a container body support assembly that is connected with a one end portion (501) of the liquid container body (52).

The container body support assembly includes a liquid supply unit (55) that is moved in a connecting direction (−K1-axis direction) including a first direction (K1-axis direction) component to be connectable with a liquid introducing portion (362) of a liquid consuming device (10).

The liquid supply unit (55) may include:

a liquid supply port (572) at one end that is connected with the liquid introducing portion (362); and a positioning structure (56) that is configured to support the liquid container body (52) below the container body support assembly in the direction of gravity when the liquid container (50) is connected with the liquid consuming device (10).

The container body support assembly may further have a substrate unit (58), and the substrate unit (58) may include

- a circuit board (582) that is electrically connected with device-side terminals (381) of the liquid consuming device (10); and
- a circuit board holding portion (59) that is configured to hold the circuit board (582).

The circuit board holding portion (59) may be configured to work in cooperation with the positioning structure (56) to support the liquid container body (52) below the container body support assembly in the direction of gravity when the liquid container (50) is connected with the liquid consuming device (10).

The container body support assembly may further include a pressing portion (545) that is pressed in the connecting direction when the liquid container (50) is connected with the liquid consuming device.

The pressing portion (545) may be located on an opposite side to the liquid supply unit (55) and the substrate unit (58) of the container body support assembly.

The container body support assembly may include a handle member (53).

The handle member (53) may include a grip portion (54) that is gripped by a user and is located above the liquid supply unit (55) and the substrate unit (58) in the direction of gravity when the grip portion (54) is gripped to hang the liquid container body (52) by dead weight.

When the liquid container body (50) is viewed from an upper side in the direction of gravity in the state that the liquid container body (52) is hung by dead weight, the liquid supply unit (55) and the substrate unit (58) may be protruded from the handle member (53) toward the connecting direction (−K1-axis direction).

As described above, the container body support assembly includes at least one of the liquid supply unit 55, the substrate unit 58, the pressing portion 545 and the handle member 53.

B. Modifications

The invention is not limited to the embodiment or the aspects described above but may be implemented by a diversity of other aspects without departing from the scope of the invention. Some examples of possible modification are given below.

B-1. First Modification

According to the above embodiment, the liquid container body 52 is made of the material having flexibility. This is, however, not restrictive, and the liquid container body 52 may have any configuration serving as a liquid container body that is configured to contain a liquid. For example, the liquid container body 52 may be partly made of a material having flexibility or may be made of a hard material that substantially has no change in volume irrespective of the consumption of the liquid. Forming at least part of the liquid container body 52 from the material having flexibility causes the volume of the liquid container body 52 to be changed according to the amount of ink contained in the liquid container body 52.

B-2. Second Modification

According to the above embodiment, the operation member 53 is formed in the frame-like shape (shown in FIG. 13). The shape is, however, not restricted to this shape but may be any shape that is holdable by the user. For example, the operation member 53 may be formed in a rod-like shape (plate-like shape) extended along the Z-axis direction.

B-3. Third Modification

According to the above embodiment, as shown in FIG. 17C, for example, the handle member 53A, the liquid supply unit 55 and the circuit board holding portion 59 are formed by combining the three members 53A, 53B and 53C. This configuration is, however, not restrictive. For example, an assembly formed by combining the three members 53A, 53B and 53C may be formed integrally. The method employed for integral forming may be, for example, integral molding or a method of joining the respective members 53A, 53B and 53C with one another by using an adhesive or the like. This facilitates manufacture of the liquid container 50. This modification integrally forms the liquid supply unit 55 with the substrate unit 58 and thus positions these units 55 and 58 relative to each other with high accuracy. This modification also integrally forms the coupling member 53A with the joint portion 549. This reduces the likelihood that the joint portion 549 and the coupling member 53A are separated from each other by the weight of the liquid container body 52 when the user grips the coupling member 53A. When the user grips the coupling member 53A, the load produced by the dead weight of the liquid container body 52 is applied to the coupling member 53A via the joint portion 549. This reduces an external force applied to the liquid container body 52 itself and thereby reduces the likelihood that the liquid container body 52 is damaged.

B-4. Fourth Modification

According to the above embodiment, as shown in FIG. 19, the connecting direction of the liquid container 50 with the mounting assembly unit 30 is the horizontal direction (K1-axis direction). This is, however, not restrictive, but the connecting direction may be any direction including a first direction (K1-axis direction) component. For example, the connecting direction may be a direction including a −Z-axis direction component and a −K1-axis direction component. In this case, the movable member 40 is also moved in a direction corresponding to the connecting direction of the liquid container 50.

B-5. Fifth Modification

The present invention is not limited to the inkjet printer or its liquid container 50 but is also applicable to any printing device (liquid consuming device) configured to eject another liquid but ink and a liquid container configured to contain another liquid. For example, the invention may be applied to any of various liquid consuming devices and their liquid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) liquid consuming device configured to eject a bioorganic material-containing liquid used for manufacturing biochips;

(5) sample ejection device used as a precision pipette;

(6) ejection device of lubricating oil;

(7) ejection device of a resin solution;

(8) liquid consuming device for pinpoint ejection of lubricating oil on precision machines such as watches or cameras;

(9) liquid consuming device configured to eject a transparent resin solution, such as an ultraviolet curable resin solution, onto a substrate in order to manufacture a hemispherical microlens (optical lens) used for, for example, optical communication elements;

(10) liquid consuming device configured to eject an acidic or alkaline etching solution in order to etch a substrate or the like; and

(11) liquid consuming device equipped with a liquid ejection head for ejecting a very small volume of droplets of any other liquid.

The "droplet" herein means the state of liquid ejected from the liquid consuming device and may be in a granular shape, a teardrop shape or a tapered threadlike shape. The "liquid" herein may be any material ejectable by the liquid consuming device. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application using a liquid container configured to contain UV ink curable by UV radiation and connected with the printer, the arrangement of the liquid container coming off the placement surface reduces the likelihood that the UV ink is cured by transmission of heat from the placement surface to the liquid container.

B-6. Sixth Modification

Figure 37:
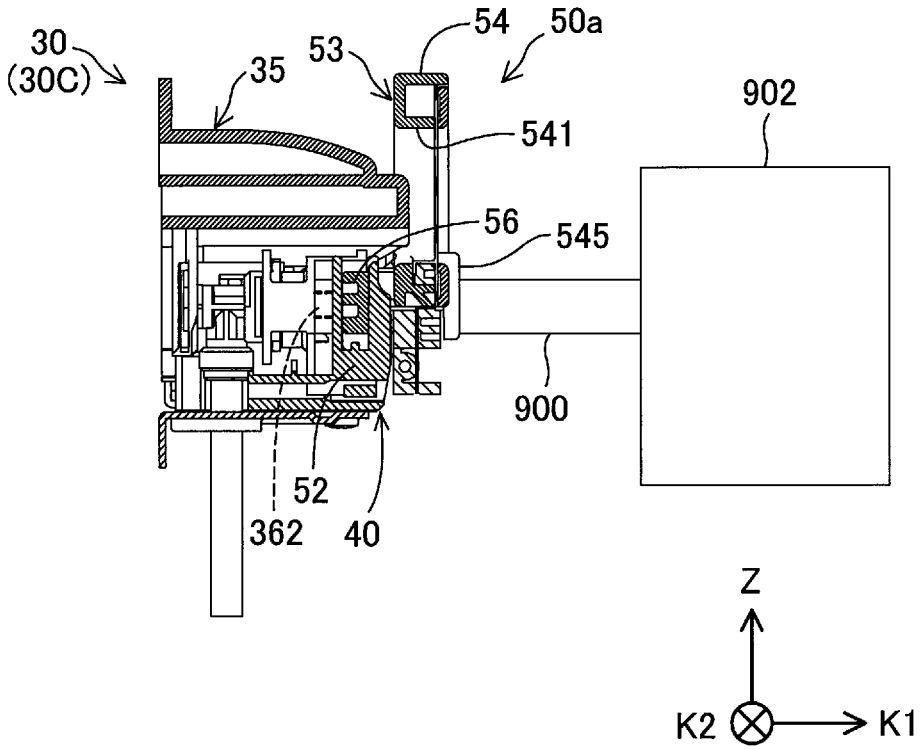
FIG. 37 is a diagram illustrating an electrical connection body.

FIG. 37 is a diagram illustrating an electrical connection body 50*a*. The liquid container 50 includes the liquid container body 52 and the liquid supply portion 57 in the above embodiment (shown in FIGS. 7 and 9), but may be configured as the electrical connection body 50*a* without these components. More specifically, the electrical connection body 50*a* is configured by omitting the liquid container body 52 and the liquid supply portion 57 from the liquid container 50, and otherwise has similar configuration to that of the liquid container 50. In an application using this electrical connection body 50*a*, ink is supplied from an externally placed tank (liquid reservoir) 902 for containing ink through a liquid flow pipe (hose) 900 arranged to connect the tank 902 with the liquid introducing portion 362 to the printer 10. This configuration has the similar advantageous effects to those of the above embodiment. For example, in the process of connecting the electrical connection body 50*a* with the printer 10, the user may grip the operation member 53 to handle the electrical connection body 50*a*. This has the better operability compared with a configuration without the operation member 53. The liquid flow pipe (hose) 900 may be connected in the middle of a liquid flow pipe arranged to connect the liquid introducing portion 362 with a liquid consuming device of the printer 10.

B-7. Seventh Modification

The container-side electrical connection structure 58 includes the circuit board 582 according to the above embodiment, but this is not restrictive. The container-side electrical connection structure 58 may have any configuration including a contact portion cp that comes into contact with the device-side electrical connection structure 382. For example, the circuit board 582 may not be provided with the storage unit 583. In one example, the container-side electrical connection structure 58 may include a contact portion of a terminal that is used for detection of mounting and demounting of the liquid container 50. In another example, the container-side electrical connection structure 58 may include a general circuit board including a flexible cable such as flexible printed circuit (FPC). This circuit board has a contact portion at one end that comes into contact with the device-side electrical connection structure 382. The other end may be connected with, for example, a reset device. This modification may be employed instead of the circuit board 582 or in addition to the circuit board 582.

The invention is not limited to any of the embodiment, the examples and the modifications described herein but may be implemented by a diversity of other configurations without departing from the scope of the invention. For example, the technical features of the embodiment, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SIGNS LIST

10 printer
11 recording mechanism
16 feed tray
17 eject tray
20 liquid supply device
20A first liquid supply device
20B second liquid supply device
22 cover member
22A cover member
22B cover member
23 one end
24 other end
26 housing space
26A housing space
26B housing space
30 (30C, 30K, 30M, 30Y) mounting assembly unit
35 stationary member
36 liquid introducing mechanism
38 contact mechanism
40 movable member (connecting member)
41 base portion
42 supply assembly support portion
48 substrate support portion
50 (50C, 50K, 50M, 50Y) liquid container
50*a* electrical connection body
51W peripheral area
51Y peripheral area
52 liquid container body
52A first chamber
52B second chamber
53 operation member
53A first member (coupling member, handle member)
53B second member (pressing member)
53C third member
53*fa* first side
53*fb* second side
54 grip portion (handle portion)
54A first end (first handle end)
54B second end (second handle end)
55 liquid supply unit (liquid supply assembly)
56 positioning structure
57 liquid supply portion (liquid flow portion)
58 substrate unit (container-side electrical connection structure)
59 circuit board holding portion
70 flow path member
99 film
102 device first surface
104 device second surface
106 device third surface
302 screw
362 liquid introducing portion
366 (366*a*-366*d*) positioning projection
381 device-side terminal
382 electrical connection structure
384 device-side substrate positioning structure
385 device-side positioning structure
402 first support plane
403 second support plane
404 third support plane
406 cutout
407 groove
482 first substrate support plane
487 bottom outer surface
501 one end (one end portion)
502 other end portion
501A first end portion
501B second end portion
503 first side end (first side end portion)
504 second side end (second side end portion)
511 member positioning element (engagement element, support element)
511A engagement element (support element)
511B engagement element (support element)
511C engagement element (support element)
511Da, 511Db engaging claw
513 engagement element
513A engagement element
513B engagement element
513C engagement element
513Da through hole
515 engagement element
517 protruded portion
521 first sheet
522 second sheet
523 third sheet
541 grip surface
542 insertion space
545 pressing portion
546 first connecting portion
547 second connecting portion
548 base portion (coupling portion)
549 mounting portion (joint portion)
549A middle section
549Ba first joint end section
549Bb second joint end section
550 outlet element
551 valve mechanism
552 valve seat
554 valve element
556 spring
558 inner flow path
569 bottom outer surface
572 liquid supply port
573 supply connecting portion
577 projection
577*a* first projection
577*b* second projection
577*c* third projection
577*d* fourth projection
581 terminal
582 circuit board
583 storage unit
588 member engaging element
592 first side wall section
592*t* groove
593 second side wall section
593*t* groove
594 bottom section
900 liquid flow pipe
902 tank
1000 liquid consuming system CT center axis
CL center axis
CW center
GC center of gravity line
GP center of gravity
P54 center
C54 center line
cp contact portion

The invention claimed is:

1. A liquid container that is detachably mountable on a liquid consuming device, the liquid container comprising:

a liquid container body that is at least partly formed from a material having flexibility and is configured to contain a liquid;

an operation member that is located at one end of the liquid container body and is configured to include a holdable grip surface; and a liquid supply portion that is configured to have a liquid supply port at one end, wherein the operation member is configured such that the grip surface is offset relative to the liquid supply port in an axial direction of the liquid supply portion, the operation member including a container-side electrical connection structure that is configured to be connectable with a device-side electrical connection structure provided on the liquid consuming device, and the container-side electrical connection structure is configured to be offset relative to the grip surface in the axial direction of the liquid supply portion.

2. The liquid container according to claim 1, wherein the liquid supply portion is protruded outward from the operation member in the axial direction.

3. The liquid container according to claim 1, further comprising a positioning structure that is configured to position the liquid container relative to the liquid consuming device in mounting the liquid container on the liquid consuming device.

4. A liquid container that is configured to be connectable with a liquid consuming device, having a height direction defined by the direction of gravity, a horizontal width direction orthogonal to the height direction and a horizontal thickness direction orthogonal to both the width and height directions, the liquid container comprising:

a liquid container body that is configured to contain a liquid; and a liquid supply portion that is located in one end portion of the liquid container body, that is configured to support the liquid container body on an upper side of the liquid container body in a direction of gravity when the liquid container is connected to the liquid consuming device, and that is moved in a connecting direction including a component in the horizontal thickness direction to be connectable with a liquid introducing portion of the liquid consuming device, wherein the dimensions of the liquid container body in the thickness direction are shorter than the dimensions of the liquid container body in the height or the width directions.

5. The liquid container according to claim 4, wherein the connecting direction is the horizontal thickness direction.

6. The liquid container according to claim 4, wherein the liquid supply portion has a liquid supply port at one end to receive the liquid introducing portion inserted therein, wherein the liquid supply port is open toward a direction including a component of the horizontal thickness direction.

7. The liquid container according to claim 4, further comprising a container-side electrical connection structure that is located on the one end portion-side of the liquid container, works in cooperation with the liquid supply portion to support the liquid container body on the upper side of the liquid container body in the direction of gravity when the liquid container is connected to the liquid consuming device, and is moved in the connecting direction to be connectable with a device-side electrical connection structure of the liquid consuming device.

8. The liquid container according to claim 7, wherein the liquid supply portion and the container-side electrical connection structure are arranged to be arrayed along the horizontal width direction that is orthogonal to the direction of gravity and the horizontal thickness direction when the liquid container is connected to the liquid consuming device.

9. The liquid container according to claim 8, wherein the one end portion of the liquid container body has a first end portion that is one end portion in the horizontal width direction and a second end portion that is the other end portion in the horizontal width direction, and the liquid supply portion and the container-side electrical connection structure are arranged at positions closer to a center of the one end portion in the horizontal width direction than are the first end portion and the second end portion.

10. The liquid container according to claim 8, further comprising a handle member that is provided on the one end portion-side of the liquid container body, the handle member configured to be holdable, wherein the handle member comprises a first handle end that is one end in the horizontal width direction and a second handle end that is the other end in the horizontal width direction, and wherein the liquid supply portion and the container-side electrical connection structure are located between the first handle end and the second handle end in the horizontal width direction.

11. The liquid container according to claim 10, wherein the liquid supply portion and the container-side electrical connection structure are arranged at positions across a center of the handle member in the horizontal width direction.

12. The liquid container according to claim 11, wherein the container-side electrical connection structure is protruded from the operation member in a direction substantially parallel to a protruding direction of the liquid supply portion.

13. The liquid container according to claim 11, wherein the container-side electrical connection structure is arrayed with the liquid supply portion in a direction substantially parallel to the grip surface.

14. The liquid container according to claim 10, wherein in an initial state of the liquid container that the liquid is contained in the liquid container body prior to consumption of the liquid by the liquid consuming device, when the liquid container body is located on a lower side of the liquid supply portion and the container-side electrical connection structure in the direction of gravity, the liquid container body comprises:

a first chamber that is connected with the handle member; and a second chamber that is located below the first chamber in the direction of gravity and has a greater length than the length of the first chamber in the horizontal thickness direction.

15. The liquid container according to claim 8, wherein in an initial state of the liquid container that the liquid is contained in the liquid container body prior to consumption of the liquid by the liquid consuming device, the liquid supply portion and the container-side electrical connection structure are arranged at positions in the horizontal width direction across a center of gravity of the liquid container body in a connecting state in which the liquid container is connected to the liquid consuming device.

16. The liquid container according to claim 7, further comprising a pressing portion that is configured to be pressed in the connecting direction when the liquid container is connected to the liquid consuming device.

17. The liquid container according to claim 16, wherein the pressing portion is located at a position opposite to the liquid supply portion and the container-side electrical connection structure.

* * * * *